US011931639B2

(12) United States Patent
Coughlan et al.

(10) Patent No.: US 11,931,639 B2
(45) Date of Patent: Mar. 19, 2024

(54) WEIGHTED BAG AND SHELL FOR HOLDING ONE OR MORE WEIGHTED ARTICLES

(71) Applicant: Coulter Ventures, LLC., Columbus, OH (US)

(72) Inventors: Laurie Ann Coughlan, Hilliard, OH (US); William Henniger, Columbus, OH (US); Tyler McClure, Galena, OH (US); Ahmik Jones, Upper Arlington, OH (US); Anelia Perez, Hilliard, OH (US)

(73) Assignee: Coulter Ventures, LLC., Columbus, OH (US)

( * ) Notice: Subject to any disclaimer, the term of this patent is extended or adjusted under 35 U.S.C. 154(b) by 274 days.

(21) Appl. No.: 17/316,289

(22) Filed: May 10, 2021

(65) Prior Publication Data

US 2021/0346777 A1 Nov. 11, 2021

Related U.S. Application Data

(60) Provisional application No. 63/126,927, filed on Dec. 17, 2020, provisional application No. 63/021,907, filed on May 8, 2020.

(51) Int. Cl.

| | |
|---|---|
| ***A63B 71/00*** | (2006.01) |
| ***A63B 21/00*** | (2006.01) |
| ***A63B 21/06*** | (2006.01) |

(52) U.S. Cl.

CPC ..... *A63B 71/0036* (2013.01); *A63B 21/0603* (2013.01); *A63B 21/06* (2013.01);
(Continued)

(58) Field of Classification Search

CPC ..... A45C 7/0063; A45C 2003/007; A63B 21/0603; A63B 21/072; A63B 21/0004;
(Continued)

(56) References Cited

U.S. PATENT DOCUMENTS

| | | | |
|---|---|---|---|
| 2,616,467 | A | 11/1952 | Cicero |
| 4,046,393 | A | 9/1977 | Vadnais |

(Continued)

OTHER PUBLICATIONS

Product listing for Rogue Strongman Sandbags from https://web.archive.org/web/20160812070131/https://www.roguefitness.com/rogue-strongman-sandbags , dated Aug. 12, 2016.

(Continued)

*Primary Examiner* — Megan Anderson
(74) *Attorney, Agent, or Firm* — Banner & Witcoff, Ltd.

(57) ABSTRACT

A shell assembly configured for holding one or more weighted articles includes an outer shell having an outer surface and an inner surface defining a cavity configured for receiving the article(s) therein, with an opening providing access to the cavity, a closure configured for selectively opening and closing the opening, and a securing structure configured for securing the article(s) within the cavity to limit movement of the article(s). The securing structure includes a plurality of adjustable straps each connected to the inner surface of the outer shell at a first securing point and a second securing point on opposite sides of the opening. Each of the straps is adjustable with respect to the outer shell to increase or decrease an effective length of the respective strap between the respective securing points, to increase or decrease a distance between the respective securing points and thereby constrict or expand the outer shell.

28 Claims, 45 Drawing Sheets

(52) U.S. Cl.
CPC ..... *A63B 21/0605* (2013.01); *A63B 21/4034* (2015.10); *A63B 2225/09* (2013.01)

(58) Field of Classification Search
CPC . A63B 21/06; A63B 21/0601; A63B 21/0602; A63B 21/0604; A63B 21/0605; A63B 21/0607; A63B 21/065; A63B 21/0724; A63B 21/0726; A63B 21/0728; A63B 21/075; A63B 21/4019; A63B 21/4021; A63B 21/4033; A63B 21/4034; A63B 60/14; A63B 60/20; A63B 71/0036; A63B 2225/09; A63B 2209/00; A63B 2209/10; A63B 2210/50
See application file for complete search history.

(56) References Cited

U.S. PATENT DOCUMENTS

D262,690 S 1/1982 Berry et al.
4,527,796 A 7/1985 Critelli
D291,015 S 7/1987 Torrens et al.
4,802,344 A 2/1989 Livingston et al.
5,251,460 A 10/1993 DeMarco et al.
5,413,199 A 5/1995 Clement
5,417,635 A 5/1995 Sell
D368,125 S 3/1996 Wiseman
D372,858 S 8/1996 Sunley
5,584,599 A 12/1996 Knittel
5,593,077 A 1/1997 Izzo
D395,750 S 7/1998 Dominique et al.
D395,751 S 7/1998 Dominique et al.
5,816,982 A 10/1998 Croushore
6,149,555 A 11/2000 Kinback
6,186,662 B1 2/2001 Jackson
6,217,489 B1 4/2001 Nicholson
D443,134 S 6/2001 Vazquez
6,581,736 B1 6/2003 Scicluna
D492,115 S 6/2004 Bertelsen et al.
6,953,277 B2 10/2005 Karslake et al.
D516,307 S 3/2006 Koenig et al.
D526,785 S 8/2006 Brasset
D532,574 S 11/2006 Clark et al.
D554,373 S 11/2007 Fenton et al.
D567,595 S 4/2008 Christopher
D577,483 S 9/2008 Tagliati et al.
D584,054 S 1/2009 Massie
D592,854 S 5/2009 Gonzalez
D596,847 S 7/2009 Nelson
D605,855 S 12/2009 Boehnlein
D615,137 S 5/2010 Ivanov
D617,560 S 6/2010 Wu
D636,184 S 4/2011 Scicluna et al.
D647,695 S 11/2011 Enghard
D653,445 S 2/2012 Enghard
D656,071 S 3/2012 Treon
D669,314 S 10/2012 Quigley et al.
8,276,351 B1 10/2012 Henkin
D672,414 S 12/2012 Januszek
D685,440 S 7/2013 Tuttle
D696,735 S 12/2013 Jaidar
8,622,877 B2 1/2014 Raines et al.
D707,062 S 6/2014 Fraioli
8,894,552 B2 11/2014 Wilson et al.
8,936,253 B1 1/2015 Rizzi
D725,723 S 3/2015 Eddie
D726,842 S 4/2015 Ross
D738,444 S 9/2015 Hilson
9,320,938 B1 4/2016 Belmore
D760,495 S 7/2016 Baram
D762,797 S 8/2016 Pajonk-Taylor et al.
D770,571 S 11/2016 Rahnasto et al.
D784,687 S 4/2017 Miller
9,616,272 B1 4/2017 Bennett
D792,531 S 7/2017 Bossier
D797,392 S 9/2017 Desanti et al.
9,789,349 B2 10/2017 Rahnasto et al.
9,820,514 B2 11/2017 Nykoluk
D806,186 S 12/2017 Catania
9,914,002 B2 3/2018 Stroup
D814,180 S 4/2018 Morelli
D818,390 S 5/2018 Held
9,999,798 B2 6/2018 Hannula
D823,953 S 7/2018 Kuka
D824,672 S 8/2018 Jusic
10,105,566 B2 10/2018 Buikema
10,149,997 B1 12/2018 Henniger et al.
D846,271 S 4/2019 Cantrell
10,252,097 B1 4/2019 Raines
D850,282 S 6/2019 Kikuta
D851,395 S 6/2019 Jusic
10,343,009 B2 7/2019 Peyton
10,350,474 B1 7/2019 Magrino et al.
D864,573 S 10/2019 Jones
D865,354 S 11/2019 Magrino et al.
D868,182 S 11/2019 Catania
D871,072 S 12/2019 Coughlan et al.
D875,851 S 2/2020 Ben
D876,558 S 2/2020 Ross
10,561,885 B1 2/2020 Lewis, Jr.
D885,498 S 5/2020 Pecqueur
10,864,982 B2 12/2020 Haas
D937,370 S 11/2021 Coughlan et al.
D939,827 S 1/2022 Jones
D944,001 S 2/2022 Coughlan
D944,904 S 3/2022 He et al.
D948,155 S 4/2022 Haas
11,318,345 B2 * 5/2022 Bassoo ..... A63B 21/0552
D954,162 S 6/2022 Coughlan et al.
11,504,566 B2 11/2022 Fujii
D972,289 S 12/2022 Ying
2005/0023779 A1 2/2005 Kalvelage
2006/0137950 A1 * 6/2006 Nassanian ..... A45C 7/0063 190/119
2008/0057805 A1 3/2008 Alexander
2009/0051131 A1 2/2009 Warrington
2009/0062093 A1 3/2009 Clark
2010/0022361 A1 1/2010 Raines et al.
2010/0048363 A1 2/2010 Gilberti et al.
2011/0287904 A1 11/2011 Morris
2012/0058863 A1 3/2012 Brizard et al.
2012/0149536 A1 6/2012 Trimble et al.
2012/0184418 A1 7/2012 Wilson
2013/0274080 A1 10/2013 Matsushita
2013/0343675 A1 12/2013 Gourchounian
2014/0011643 A1 1/2014 Jaidar
2014/0226919 A1 8/2014 Fu et al.
2015/0061245 A1 3/2015 Rogier
2015/0182777 A1 7/2015 Rarity, IV
2015/0202486 A1 7/2015 Childs
2016/0129292 A1 5/2016 Stroup
2016/0317854 A1 11/2016 Stoddard
2017/0036056 A1 2/2017 Tomellini et al.
2018/0085619 A1 3/2018 Chen
2019/0184252 A1 6/2019 Raines
2019/0269956 A1 9/2019 Henniger et al.
2019/0299046 A1 10/2019 Tomellini et al.
2021/0346777 A1 11/2021 Coughlan et al.
2022/0143451 A1 * 5/2022 Tomellini ..... A63B 21/4043

OTHER PUBLICATIONS

Photos of shoulder carry bag available at https://www.roguefitness.com/rogue-feed-sack, dated Sep. 21, 2018, product available at least as early as Jul. 27, 2014.
Photos of Rogue Sandbags available at https://www.roguefitness.com/rogue-sandbags, dated Sep. 21, 2018, product available at least as early as Apr. 12, 2016.
Product listing for Rogue Sandbags from http://web.archive.org/web/20160412084703/http://www.roguefitness.com:80/rogue-sandbags dated Apr. 12, 2016.
Product listing for Wreck Bag from https://www.roguefitness.com/wreck-bag, dated Sep. 21, 2018, product available at least as early as Aug. 13, 2016.

(56) References Cited

OTHER PUBLICATIONS

Product listing for Wreck Bag Mini from https://www.roguefitness.com/wreck-bag-mini, dated Sep. 21, 2018, product available at least as early as Dec. 13, 2016.
Product listing for StrongFit Classic Sandbags from https://www.roguefitness.com/strongfit-classic-sandbags, dated Sep. 21, 2018, product available at least as early as Aug. 13, 2016.
Web page from https://web.archive.org/web/20160808024400/http://www.roguefitness.com:80/conditioning/strength-equipment/sandbags, dated Aug. 8, 2016.
Product listing for Rogue Tactical Sandbags from https://web.archive.org/web/20150331060530/http://www.roguefitness.com:80/tactical-sandbags , dated Mar. 31, 2015.
Photos of product taken Sep. 20, 2018, product known to be available earlier than Aug. 13, 2016.
Feb. 5, 2019—(WO) International Search Report and Written Opinion—App PCT/US2018/046716.
"2017 Arnold Strongman Classic—Weight Over Bar/4K" (Rogue Fitness) Mar. 6, 2017 (Mar. 6, 2017) [online] retrieved from <URL: https://www.youtube.com/watch?v=tJUa5qIMOoA> entire document, especially demonstration 0:25-0:34, 4:50.
"Rogue Sandbags" (ROGUE FITNESS) Jun. 20, 2017 (Jun. 20, 2017) [online] retrieved from <URL: http://www.roguecanada.ca:80/rogue-sandbags>entire document.
Product listing for Rogue Strongman Throw Bag from <https://www.roguefitness.com/rogue-strongman-throwbag>, dated Mar. 29, 2020, product disclosed at least as early as May 30, 2018.
Product listing for Rogue Cyclone Strongman Sandbags from <https://www.roguefitness.com/rogue-cyclone-strongman-sandbags>, dated Mar. 29, 2020, product disclosed at least as early as Mar. 16, 2018.
Product listing for Rogue Feed Sack from <https://www.roguefitness.com/rogue-feed-sack>, dated Mar. 29, 2020, product disclosed at least as early as May 16, 2018.
Ludus Imperium Strongman sandbag, Heavy Duty Workout sandbags for Training, Fitness, cross-training & Exercise, Workouts, Sandbag Weights; (https://www.amazon.co.uk/Ludus-Imperium-Strongman-Sandbags-Cross-training/dp/B07F1YP89Y/ref=sr_1_5?dchild=1&keywords=rogue%2Bcyclone%2Bsandbag&qid=1616886133&sr=8-5&th=1), date first available Jun. 26, 2018.
Rogue Cyclone Sandbags, (https://www.roguefitness.com/rogue-cyclone-strongman-sandbags), Available 2018.
Just Launched. Rogue Cyclone Strongman Sandbags & Rogue Fanny Pack!; https://emailtuna.com/roguefitness.com/106880; First Available Feb. 16, 2018.
Amazon.com, Lionheart Sand Fillable Weight Plates, First available Jun. 15, 2022, <https://www.amazon.com/Lionheart-Plate-Pair-Fillable-Barbell/dp/B09WHYYWDB?source=ps-sl-shoppingads-ipcontext&ref_=fplfs&smid=A1EHPQSX94GBYQ&th=1>.

* cited by examiner

WEIGHTED BAG AND SHELL FOR HOLDING ONE OR MORE WEIGHTED ARTICLES

CROSS-REFERENCE TO RELATED APPLICATIONS

This application is a non-provisional of U.S. Provisional Application No. 63/021,907, filed May 8, 2020, and U.S. Provisional Application No. 63/126,927, filed Dec. 17, 2020, both of which prior applications are incorporated herein by reference and made part hereof.

BACKGROUND OF THE DISCLOSURE

1. Field of the Disclosure

The disclosure relates in general to weightlifting devices, and more particularly, to a weighted bag for use in various weightlifting and other exercises.

2. Background Art

The use of different devices in the lifting of weights and general exercising is well known in the art. Many such exercises and lifts generally utilize a rigid or solid weight that is coupled to a handle, a bar or a cable and pulley system. Such devices include lat machines, barbells, kettlebells, dumbbells and the like.

Increasingly, however, dynamic, or shape changing devices have been utilized. These devices include, but are not limited to shape changing platforms, such as hemispherically shaped structures which are semi-rigid, inflatable structures and the like. Other such devices include balls or bags that can be lifted, carried, thrown or otherwise manipulated.

Problematically, these non-rigid, flexible devices tend to experience unpredictable forces and non-uniform loading depending on how they are manipulated and/or how they are grasped, dropped or otherwise impacted. At the same time, the material from which such devices are made, by definition, are generally flexible and capable of shape changing. Moreover, where a handle or the like is introduced, the coupling of the handle to the bag is problematic and often a source of deterioration, degradation and failure of the bag. For example openings, tears, rips and the like are often formed proximate the stitching or other joining between the handle and the bag panels, as stress concentrations are experienced in such locations.

BRIEF SUMMARY

The disclosure generally relates to various embodiments of a bag having an outer shell defining an inner cavity configured to receive a filler material or other weighted article(s) to create a weighted bag.

Aspects of the disclosure relate to a shell assembly configured for holding one or more weighted articles, the shell assembly including an outer shell having an inner surface defining a cavity configured for receiving the one or more weighted articles therein, and an outer surface opposite the inner surface, the outer shell further having an opening providing access to the cavity, a closure configured for selectively opening and closing the opening, and a securing structure configured for securing the one or more weighted articles within the cavity to limit movement of the one or more weighted articles. The securing structure includes a plurality of adjustable straps each connected to the inner surface of the outer shell at a first securing point and a second securing point on opposite sides of the opening. Each of the adjustable straps is adjustable with respect to the outer shell to increase or decrease an effective length of the respective adjustable strap between the respective first and second securing points, to increase or decrease a distance between the respective first and second securing points and thereby constrict or expand the outer shell around the one or more weighted articles.

According to one aspect, the plurality of adjustable straps includes a first strap extending across the opening in a first direction, a second strap spaced from the first strap and extending across the opening in the first direction, and a third strap extending across the opening in a second direction perpendicular to the first direction, such that the first and second straps cross the third strap. In one configuration, the third strap has a first slot and a second slot spaced along a length of the third strap, wherein the first strap and the second strap extend through the first and second slots.

According to another aspect, each of the plurality of adjustable straps has a buckle connected to the inner surface of the outer shell at the second securing point, and each of the adjustable straps is adjustably threaded through the respective buckle to enable adjustment of the adjustable strap with respect to the outer shell. In one configuration, each of the buckles is removably connected to the outer shell.

According to a further aspect, the outer shell has a bottom configured to contact a ground surface during use, and the bottom of the outer shell is seamless.

According to yet another aspect, the outer shell has a bottom configured to contact a ground surface during use, a top opposite the bottom, two opposed ends, and two opposed sides extending between the two ends. The outer shell includes a plurality of panels joined together, the plurality of panels including a bottom panel forming a bottom of the outer shell, and extending upward from the bottom along the two ends and along the two sides. In one configuration, the plurality of panels further includes a top panel connected to the bottom panel and at least partially forming a top of the outer shell and the two sides of the outer shell, and two end panels connected to the top panel and the bottom panel at the two opposed ends of the outer shell, wherein the two end panels each form a portion of the respective end of the outer shell. In another configuration, each of the plurality of panels is formed of at least one fabric layer, and the bottom panel has a greater number of fabric layers than the other panels.

According to a still further aspect, the closure includes a moveable flap having a first portion fixedly connected to the outer shell and a second portion releasably connected to the outer shell for selectively opening and closing the opening.

Additional aspects of the disclosure relate to a shell assembly configured for holding one or more weighted articles, the shell assembly including an outer shell having an inner surface defining a cavity configured for receiving the one or more weighted articles therein, and an outer surface opposite the inner surface, the outer shell further having an opening providing access to the cavity and a plurality of adjustable straps configured for securing the one or more weighted articles within the cavity to limit movement of the one or more weighted articles. The plurality of adjustable straps includes a first strap connected to the inner surface of the outer shell at two securing points on opposite sides of the opening and extending across the opening in a first direction, a second strap connected to the inner surface of the outer shell at two securing points on opposite sides of the opening and extending across the opening in the first direction, the second strap being spaced from the first strap, and a third strap connected to the inner surface of the outer shell at two securing points on opposite sides of the opening and extending across the opening in a second direction perpendicular to the first direction, such that the first and second straps cross the third strap. Each of the adjustable straps is adjustable with respect to the outer shell to increase or decrease an effective length of the respective adjustable strap between the respective securing points, to increase or decrease a distance between the respective securing points and thereby constrict or expand the outer shell around the one or more weighted articles.

According to one aspect, the third strap has a first slot and a second slot spaced along a length of the third strap, and the first strap and the second strap extend through the first and second slots.

According to another aspect, each of the plurality of adjustable straps has a buckle connected to the inner surface of the outer shell at one of the securing points, and each of the adjustable straps is adjustably threaded through the respective buckle to enable adjustment of the adjustable strap with respect to the outer shell. In one embodiment, each of the buckles is removably connected to the outer shell.

According to a further aspect, the outer shell has a bottom configured to contact a ground surface during use, and the bottom of the outer shell is seamless.

According to yet another aspect, the outer shell has a bottom configured to contact a ground surface during use, a top opposite the bottom, two opposed ends, and two opposed sides extending between the two ends. The outer shell includes a plurality of panels joined together, the plurality of panels including a bottom panel forming a bottom of the outer shell, and extending upward from the bottom along the two ends and along the two sides. In one configuration, the plurality of panels further includes a top panel connected to the bottom panel and at least partially forming a top of the outer shell and the two sides of the outer shell, and two end panels connected to the top panel and the bottom panel at the two opposed ends of the outer shell, where the two end panels each form a portion of the respective end of the outer shell. In another configuration, each of the plurality of panels is formed of at least one fabric layer, and the bottom panel has a greater number of fabric layers than the other panels.

According to a still further aspect the outer shell is elongated along the second direction, such that the third strap is a longitudinally extending strap, and the first and second straps are laterally extending straps. In one configuration, the plurality of straps further includes a fourth strap connected to the inner surface of the outer shell at two securing points on opposite sides of the opening and extending across the opening in the first direction, the fourth strap being spaced from the first strap and the second strap, such that the fourth strap is a laterally extending strap and crosses the third strap.

Further aspects of the disclosure relate to a shell assembly configured for holding one or more weighted articles, the shell assembly including an outer shell having an inner surface defining a cavity configured for receiving the one or more weighted articles therein, and an outer surface opposite the inner surface, where the outer shell is elongated along a longitudinal direction and has an opening providing access to the cavity, and a plurality of adjustable straps configured for securing the one or more weighted articles within the cavity to limit movement of the one or more weighted articles. The plurality of adjustable straps includes a longitudinal strap connected to the inner surface of the outer shell at a first securing point and a second securing point on opposite longitudinal sides of the opening and extending across the opening in the longitudinal direction, and a plurality of lateral straps each connected to the inner surface of the outer shell at a first securing point and a second securing point on opposite lateral sides of the opening and extending across the opening in a lateral direction perpendicular to the longitudinal direction, such that each of the lateral straps crosses the longitudinal strap. The lateral straps are spaced from each other along the longitudinal direction. Each of the adjustable straps is adjustable with respect to the outer shell to increase or decrease an effective length of the respective adjustable strap between the respective first and second securing points, to increase or decrease a distance between the respective first and second securing points and thereby constrict or expand the outer shell around the one or more weighted articles.

According to one aspect, the plurality of lateral straps are evenly spaced from each other along the longitudinal direction.

According to another aspect, the plurality of lateral straps include a first lateral strap, a second lateral strap, and a third lateral strap.

According to a further aspect, the longitudinal strap has a plurality of slots spaced along a length of the longitudinal strap, and each of the plurality of lateral straps extends through one of the slots of the longitudinal strap.

According to yet another aspect, each of the plurality of adjustable straps has a buckle connected to the inner surface of the outer shell at one of the first and second securing points, and each of the adjustable straps is adjustably threaded through the respective buckle to enable adjustment of the adjustable strap with respect to the outer shell. In one configuration, each of the buckles is removably connected to the outer shell.

According to a still further aspect, the outer shell has a bottom configured to contact a ground surface during use, and the bottom of the outer shell is seamless.

According to an additional aspect, the outer shell has a bottom configured to contact a ground surface during use, a top opposite the bottom, two opposed ends spaced from each other along the longitudinal direction, and two opposed sides spaced from each other along the lateral direction and extending between the two ends. The outer shell includes a plurality of panels joined together, the plurality of panels including a bottom panel forming a bottom of the outer shell, and extending upward from the bottom along the two ends and along the two sides.

Other features and advantages of the disclosure will be apparent from the following description taken in conjunction with the attached drawings.

BRIEF DESCRIPTION OF THE DRAWINGS

The disclosure will now be described with reference to the drawings wherein.

DETAILED DESCRIPTION OF THE DISCLOSURE

Figure 1:
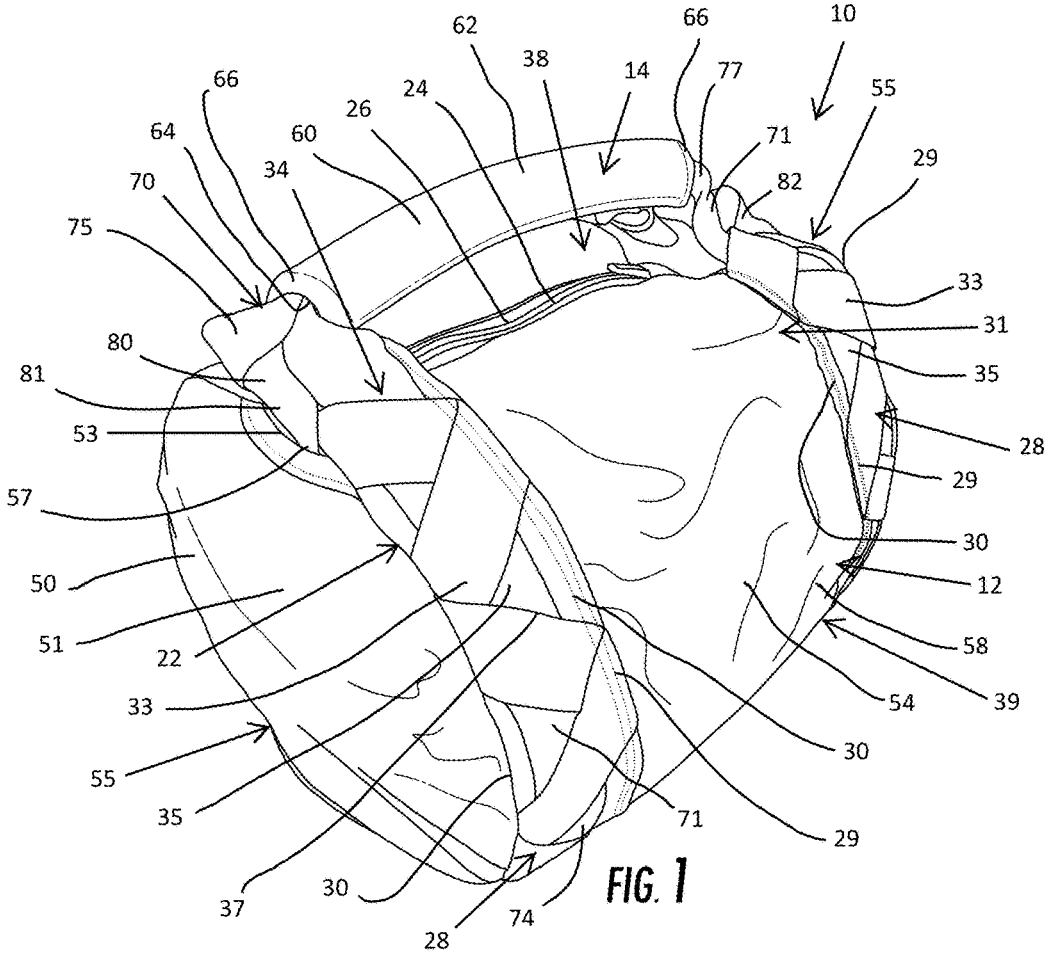
FIG. 1 is a front perspective view of one embodiment of a weighted bag according to aspects disclosed herein.
Figure 2:
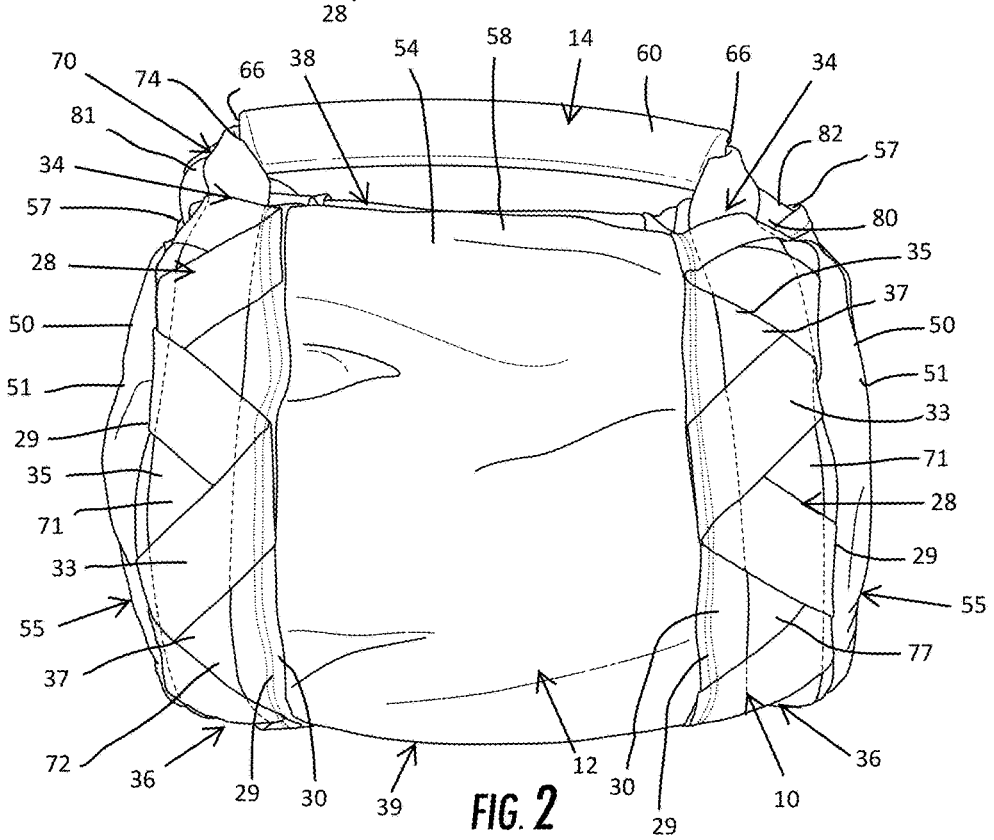
FIG. 2 is a front elevation view of the weighted bag of FIG. 1.
Figure 3:
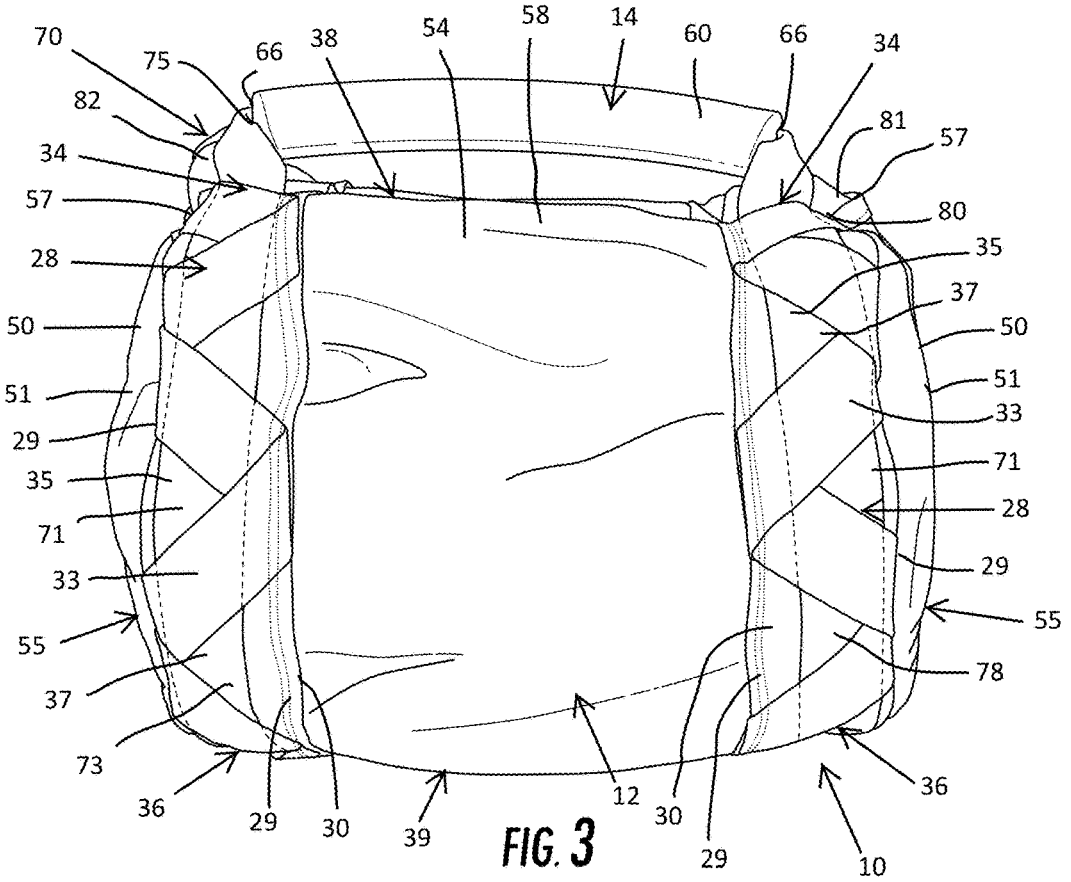
FIG. 3 is a rear elevation view of the weighted bag of FIG. 1.
Figure 4:
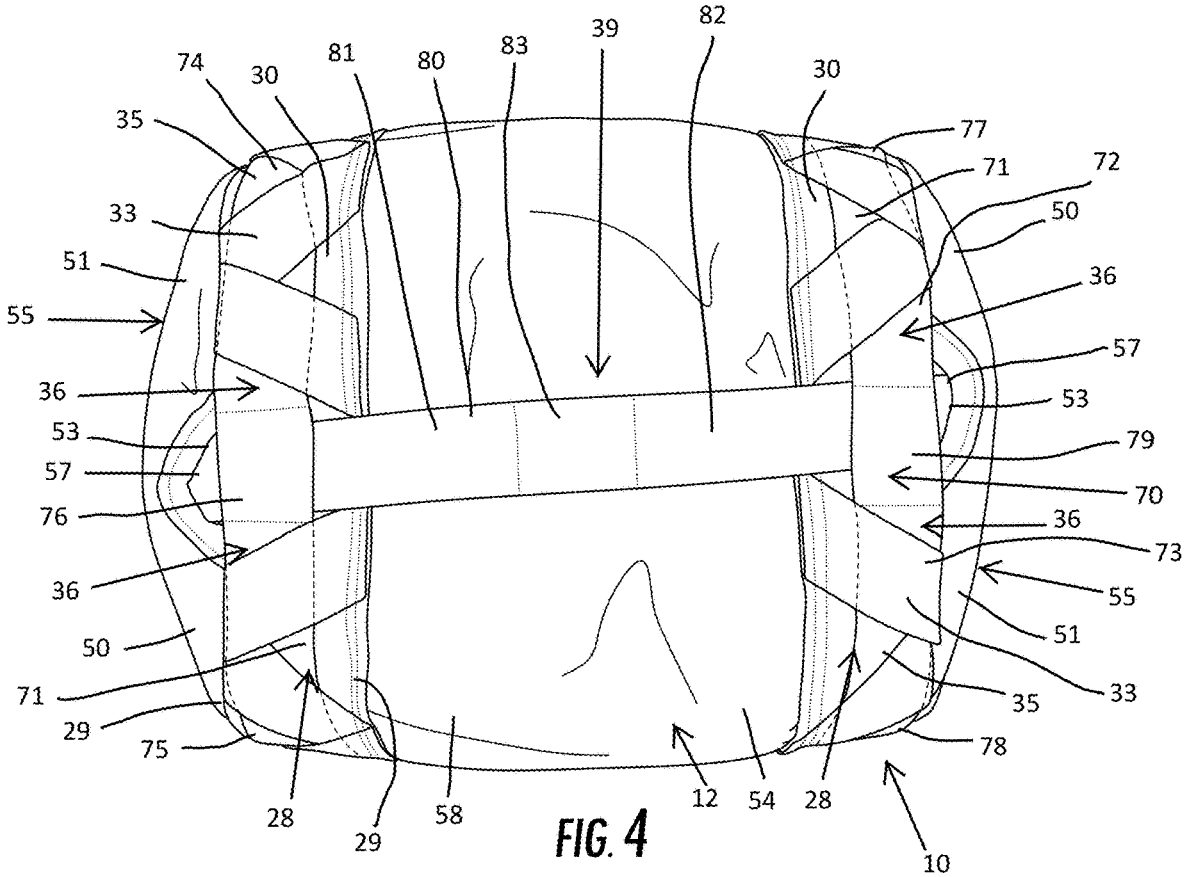
FIG. 4 is a bottom elevation view of the weighted bag of FIG. 1.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1-8, a weighted bag with a handle for weightlifting is shown generally at reference number 10. The weighted bag 10 includes an outer shell 12 and handle assembly 14. The handle assembly 14 is coupled to the outer shell 12 by two or more points along the weighted bag 10, such as by a strap assembly 70 as described herein. The weighted bag 10 as shown in FIGS. 1-8 is configured for weightlifting and similar exercises, and can be lifted, carried, thrown, dropped, and otherwise used to enhance strength, agility and the like.

The outer shell 12, shown in FIGS. 1-8, comprises one or more panels 20 that are connected by one or more seams 22, an opening 24 with a shell closure member 26. Each of the panels 20 has an inner surface 31 defining an inner cavity 21 configured to hold a filler material 16 and an outer surface 32 opposite the inner surface 31. The shell 12 has a top 38 and a bottom 39, such that the opening 24 is positioned on the top 38, and the bag 10 is configured to rest on the bottom 39. It is understood that the top 38 and the bottom 39 are relative terms that depend on the orientation of the bag 10.

It is to be understood the inner surface 31 and outer surface 32 of the panels 20 may be defined by one or more surfacing layers that may be of substantially equal or variable materials. Generally, these are two or greater ply configuration coupled together. In the configuration shown, the panels are shown as singular pieces with the understanding that they may represent multiple plies of material. In one embodiment, the panels 20 are formed from a two ply construction, with the outer and inner plies comprising different grades of ballistic nylon fabric (the outside being of 1000 denier and the inside being of 500 denier). Of course, other configurations are contemplated.

Figure 5:
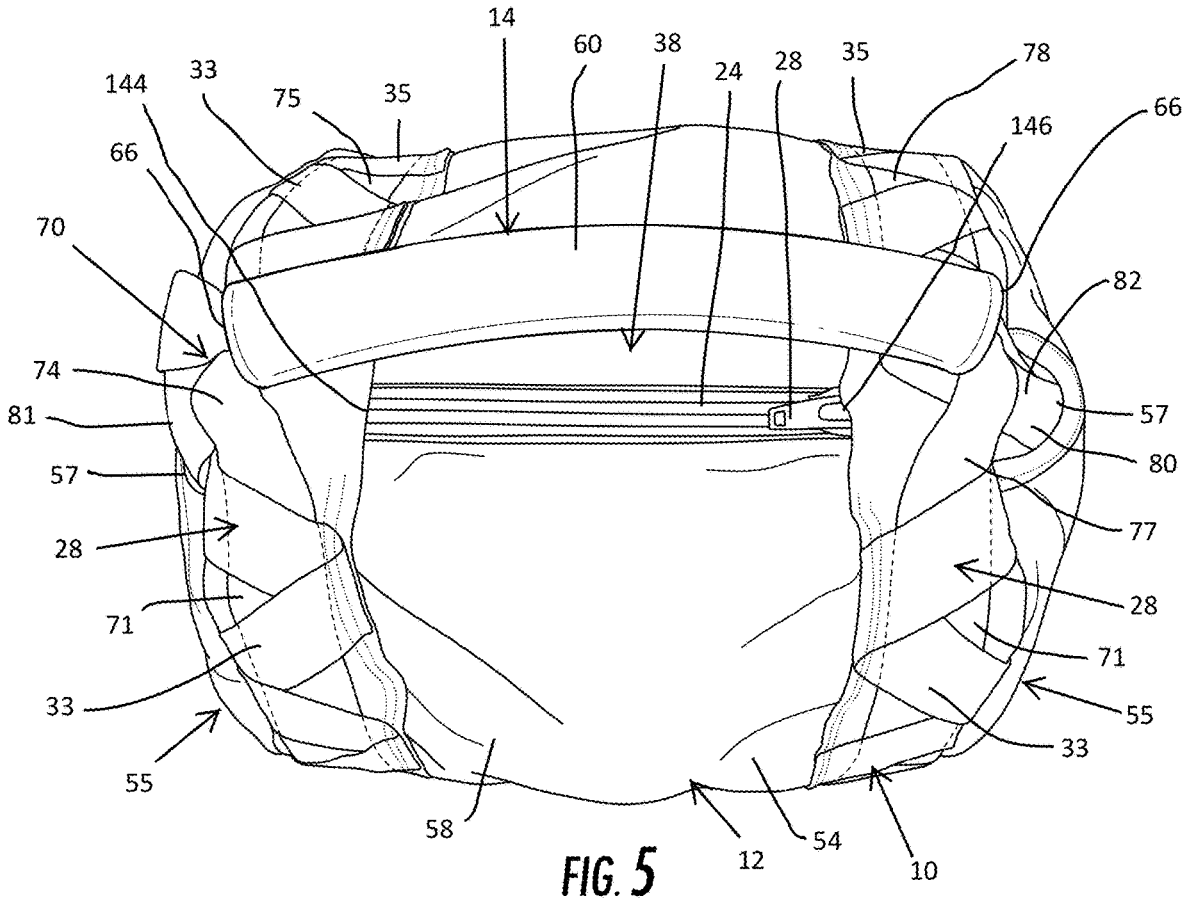
FIG. 5 is a bottom elevation view of the weighted bag of FIG. 1.
Figure 6:
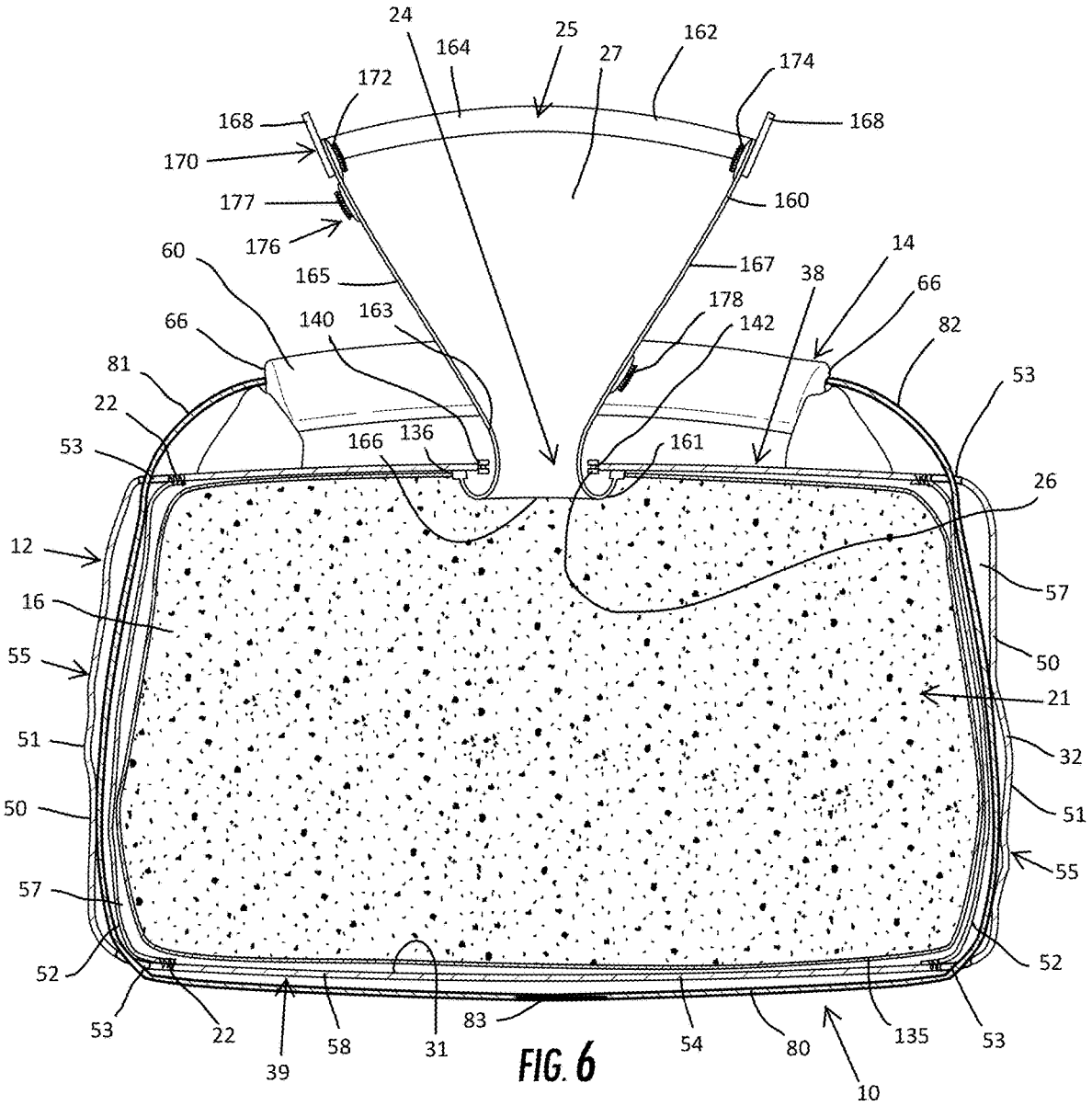
FIG. 6 is a cross-section view of the weighted bag of FIG. 1 taken along a central plane, with a filling mechanism in the form of a funnel extended from the weighted bag and a filling material filling the weighted bag.
Figure 7:
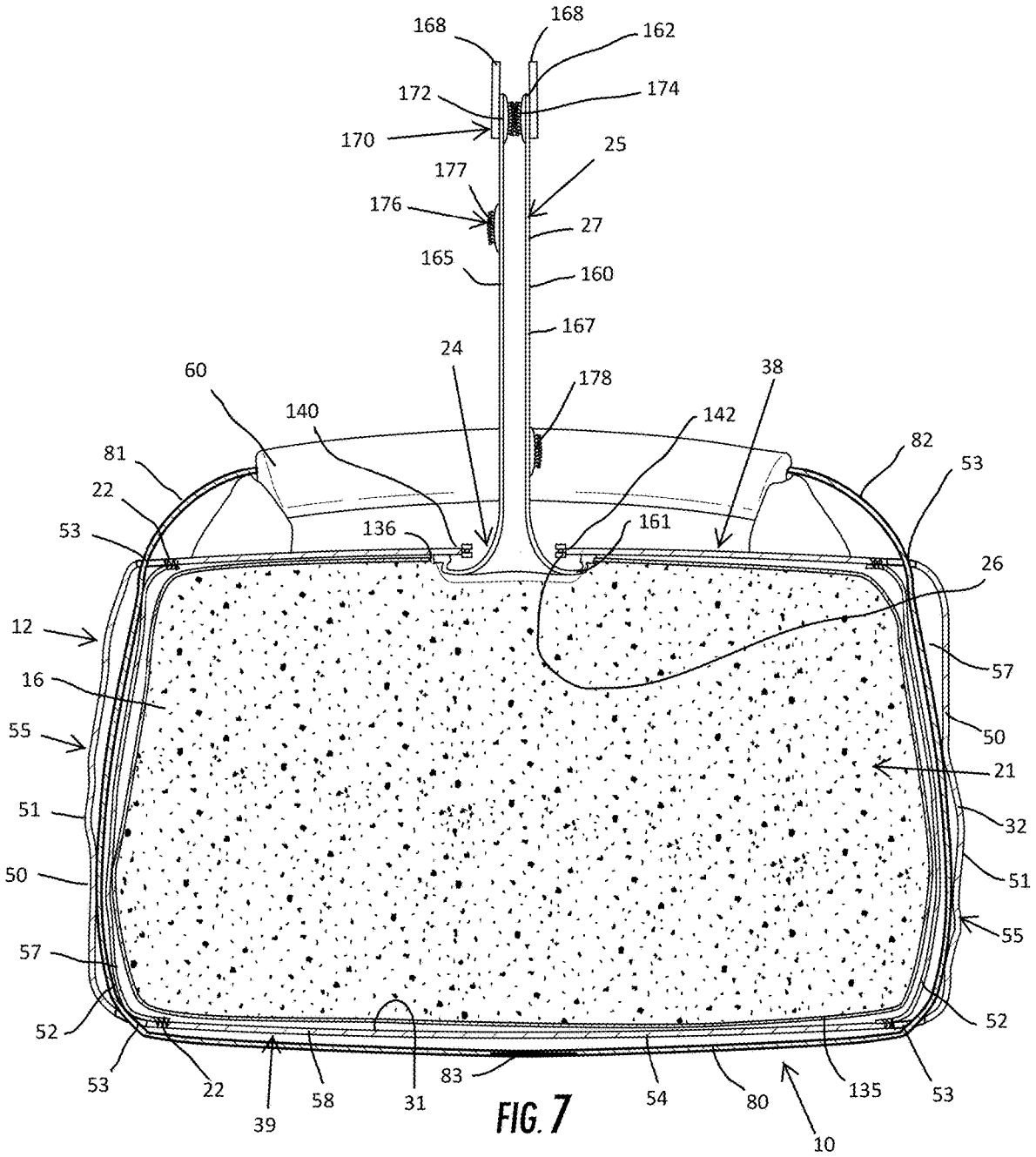
FIG. 7 is a cross-section view of the weighted bag of FIG. 6, with the funnel in a partially-collapsed configuration.
Figure 8:
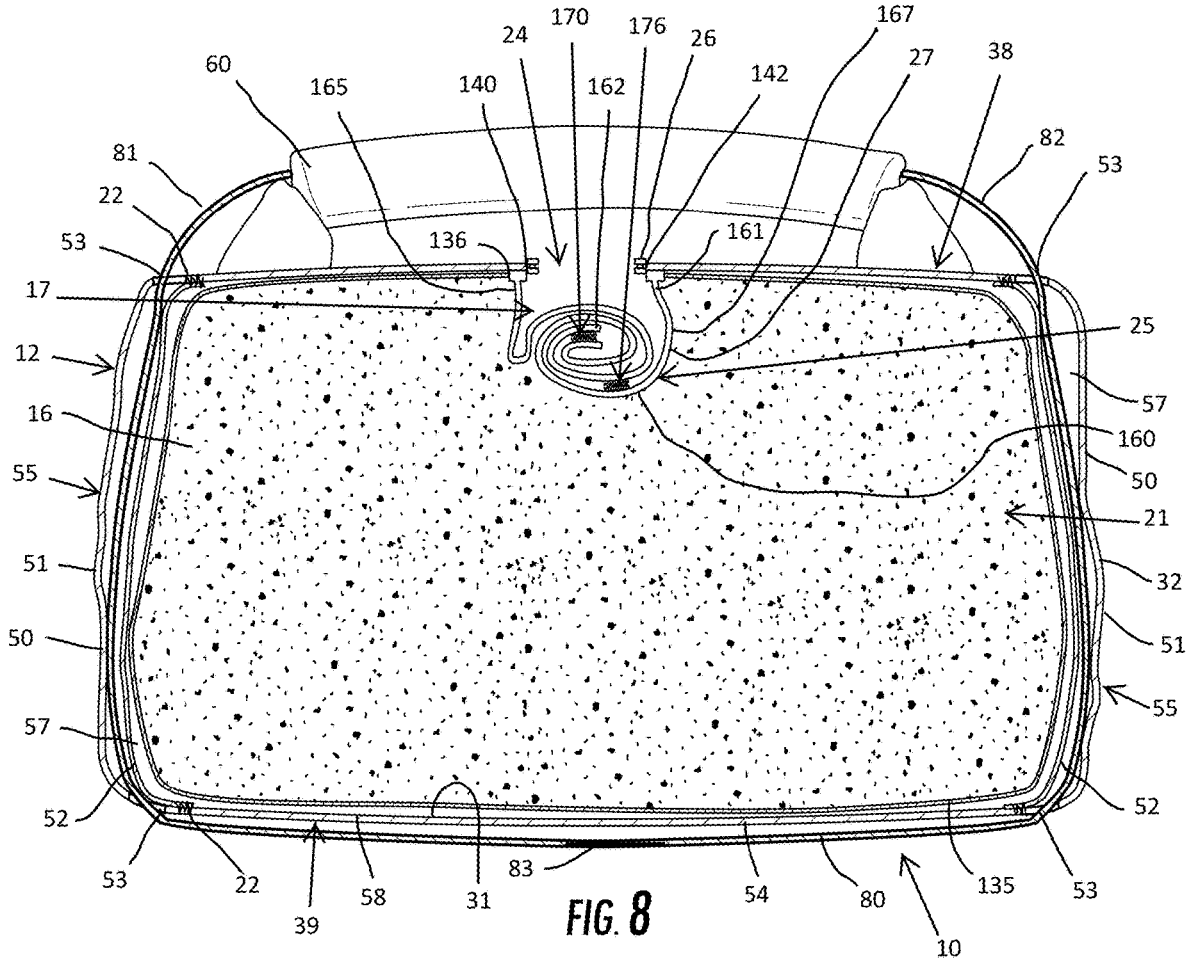
FIG. 8 is a cross-section view of the weighted bag of FIG. 6, with the funnel in a fully collapsed configuration.

With reference to the example embodiment of the outer shell 12 in FIGS. 1-8, the panels 20 include at least two opposed end panels 50 and central body panel 58. Each end panel 50 has an outer panel 51, an inner panel 52, and slot 57 defined between the inner and outer panels 51, 52. The outer panel 51 is coupled to the inner panel 52 by any number of different structures, but not limited to, cross-stitching, heat sealing, adhesive, among others. Each slot 57 in this embodiment, as shown in FIGS. 6-8, extends between the outer and inner panels 51, 52 and has upper and lower openings 53 to permit passage into and out of the slot 57, and the slot 57 extends continuously between the openings 53. In one embodiment, as shown in FIGS. 1-5, the outer and inner panels 51, 52 are connected together around the exteriors of the panels 51, 52, and in other embodiments, the panels 51, 52 may have inner walls, seams, adhesives, heat sealing, or other structures that define a slot 57 that is narrower than the widths of the panels 51, 52. In the embodiment of FIGS. 1-8, the end panels 50 are substantially parallel with each other, and the central body panel 58 extends between the end panels 50. The shell 12 in the embodiment of FIGS. 1-8 is entirely or substantially defined by the end panels 50 and the central body panel 58. In this embodiment, the shell 12 defines a cylindrical configuration, having a circular cylindrical portion or central body portion 54 formed by the central body panel 58 and circular flat or bulged ends 55 formed by the end panels 50. In other embodiments, the shell 12 may have a different shape, such as an oval cylinder, a cube, a rectangular cylinder, a triangular cylinder, etc. It is understood that the cylindrical portion 54 may simply be referred to as a "central body portion" when describing a shell 12 having a cylindrical shape or any other shape. Likewise, the relative sizes and shapes of the end panels 50 and the central body panel 58 may be different in other embodiments, and the cylindrical portion 54 and/or the ends 55 may be formed of a greater of smaller number of panels in other embodiments. In general, the cylindrical portion 54 and the ends 55 may each be formed by one or more panels 22.

In the embodiment of FIGS. 1-8, the bag 10 has an opening 24 and a filling mechanism 25 that is accessible through the opening 24 for filling the bag 10. The opening 24 in the embodiment of FIGS. 1-8 is placed along the central body panel 58 in such a manner that it allows entry to the inner cavity 21 of the bag 10. The opening 24 shown in FIGS. 1 and 5 is oriented along the length of central body panel 58 at the top of the bag 10, but the opening 24 may be oriented and/or located differently in other embodiments. The opening 24 includes a closure member 26 (also called a shell closure member) configured for releasably closing the opening 24. When engaged, the shell closure member 26 resists the movement of filler material 16 into or out of the opening 24. In the configuration shown, the opening 24 and the shell closure member 26 are positioned directly below the natural position of the handle 60, which can reduce the stresses that are placed in the region surrounding the opening.

As shown in FIGS. 1 and 5-8, the opening 24 is defined by first side edge 140, second side edge 142, first end 144, and second end 146 which collectively define the perimeter of the opening. The first side edge 140 and second side edge 142 are opposite and substantially parallel to each other and separated by the width of the opening 24. Further, the first end 144 and second end 146 are opposite to each other and separated by the length of the opening 24. The first side edge 140 and second side edge 142 are connected at their respective ends by first end 144 and second end 146. The first and second ends 144, 146 may be formed as V-shaped or U-shaped structures in one embodiment or may be straight linear sides that are substantially parallel to each other and perpendicular to the side edges 140, 142 in another embodiment. Generally, the opening 24 has an elongated rectangular configuration in the embodiment of FIGS. 1-8, and the opening 24 may have a differently-shaped configuration in other embodiments.

The shell closure member 26 is substantially planar to the opening 24 and coupled in such a way to edges of opening 24 that closure of the shell closure member 26 substantially closes the opening 24. The shell closure member 26, in the configuration of FIGS. 1-8, includes a zipper. In this configuration, the dimensions of the opening 24 are similar to the size of the shell closure member 26. In other words, the lengths of the edges of the shell closure member 26 are substantially parallel and comparable to the first side edge 140 and second side edge 142 of the opening 24. In contemplated configurations, the shell closure member 26 is secured in a manner that ensures close coupling along the entire edges 140, 142 of the opening 24. In other embodiments, the shell closure member 26 may have other configurations, such as a hook and loop fastener, snaps, buttons, flaps, and other fastening and/or closing structures or combinations of such structures may be utilized. It is understood that the configuration of the shell closure member 26 may depend at least partially on the configuration of the opening 24. For example, a shell closure member 26 in the form of a zipper may not be usable or optimal with some opening 24 configurations, and another type of closure member 26 may be used.

In the embodiment of FIGS. 1-8, the filling mechanism 25 includes a funnel structure 27 having a flexible encircling wall 160 forming a funnel shape, a grasping handle or grasping member 168, a filling mechanism closure member 170, and securing member 176. With particular reference to FIGS. 6-8, the flexible encircling wall 160 has a proximal end 161, a distal end 162, a lower exit 164, and an upper inlet 166. The proximal end 161 and distal end 162 are on opposite ends of the funnel 27, and the proximal end 161 is a fixed end connected to the shell 12, while the distal end 162 is a free end that can be extended out of the shell 12 through the opening 24 or retracted into the shell 12.

The proximal end 161 is connected to the inner surface 130 of the outer shell 12, as shown in FIGS. 6-8, and the connection between the proximal end 161 and the shell 12 forms a lower perimeter of the funnel 27. In the configuration of FIGS. 6-8, the proximal end 161 of the funnel 27 is secured to the inner surface of the shell 12 around the entire opening 24, along a connection line spaced from the opening 24. This configuration resists leakage of the filler material 16 through the connection between the proximal end 161 and the shell 12 and also provides a pocket 17 inside the opening 24 where the funnel 27 can be placed after collapsing, e.g., by folding or rolling, as described herein. The distal end 162, when fully extended and expanded, forms an upper perimeter of the funnel, and it is understood that the upper perimeter may be larger than the lower perimeter in one embodiment. Further, the funnel 27 may have a neck or narrowest portion 163 that is located between the proximal and distal ends 161, 162 and has a perimeter and a maximum width that are smaller than the perimeters and maximum widths at the proximal and distal ends 161, 162. In the embodiment shown in FIGS. 6-8, the neck 163 is located closer to the proximal end 161 than the distal end 162 and is configured to be generally located within the opening 24 when the funnel 27 is fully extended and expanded. It is to be understood the actual circumference or width at some locations are subject to change in shape, size and/or width during operation, articulation and folding of the funnel 27, and that the relative circumferences and widths described herein are the maximum such dimensions when the funnel 27 is fully extended and expanded. The wall 160 in FIGS. 6-8, including the lower exit 164 and the upper inlet 166, may be substantially oval or rectangular in shape in one embodiment, but these components are subject to variable changes in length and width in contemplated configurations and desired sizes of the weighted bag 10. It is to be understood the openings (exit 164 and inlet 166) are substantially large enough to allow entry of physical materials, such as sand or polymer beads, with minimal interference or resistance from the filling mechanisms 25.

The funnel 27 may have one or more grasping handles 168 at or near the distal end 162 to assist in pulling the funnel 27 through the opening 24 and/or opening the funnel closure 170 as described herein. The funnel 27 in FIGS. 6-8 has two grasping handles 168 on opposite sides of the inlet 166, with each grasping handle 168 in the form of a thin strap connected to the exterior of the wall 160 of the funnel 27. The grasping handles 168 are oriented to extend outwardly from the distal end 162 when the funnel 27 is in an open and extended position. Placement of the grasping handle 168 on the funnel is variable and subject to change in contemplated configurations of the funnel 27. The grasping handle 168 may be connected to the wall 160 by stitching, adhesive, or heat sealing, among other techniques, or a combination of such techniques.

The funnel 27 also has a funnel closure 170 configured to close the inlet 166 to resist egress of the particulate material 16. In the embodiment of FIGS. 6-8, the funnel closure 170 includes a first engaging portion 172 and second engaging portion 174 positioned on opposite sides 165, 167 of the wall 160 at the inlet 166 proximate the distal end 162 and configured to engage each other to releasably close the inlet 166. The first engaging portion 172 and second engaging portion 174 include elongated strips of complementary hook and loop materials that releasably connect to each other when engaged. The engaging portions 172, 174, when engaged, seal the sides 165, 167 to each other to close the upper inlet 166 and resist the entry or exit of material through the upper inlet 166. In the embodiment of FIGS. 6-8, the strips forming the first and second engaging portions 172, 174 extend equal distances along the entirety of both sides of the inlet 166 to completely close the inlet 166 when engaged. In other embodiments, other releasable connecting or fastening structures can be used as the funnel closure 170, such as snaps, buttons, zippers, and the like, as well as complementary structures when appropriate, or combinations of different structures.

The funnel 27 also includes a funnel securing structure 176 configured to secure and further resist ingress or egress of material through the funnel 27. The funnel securing structure 176 in FIGS. 6-8 includes a first securing member 177 and a second securing member 178 that are configured to engage each other to releasably close the inlet 166. The funnel securing structure 176 in FIGS. 6-8 is lower on the flexible encircling wall 160 than the funnel closure 170. The securing members 177, 178 in this embodiment are connected to the outer surface of the flexible encircling wall 160 on opposite sides 165, 167 of the wall 160 at different distances from the distal end 162. The first securing member 177 is connected to the first side 165 closer to the distal end 162, and the second securing member 178 is connected to the second side 167 farther from the distal end 162. In this configuration, the wall 160 is configured to be rolled or folded by rolling or folding the first side 165 over the second side 167 as shown in FIG. 8 to achieve engagement of the securing members 177, 178 to releasably retain the funnel 27 in the rolled or folded position. The securing members 177, 178 include elongated strips of complementary hook and loop materials that releasably connect to each other when engaged. The size and positioning of the securing members 177, 178 may be different in other embodiments. Additionally, the securing structure 176 may have a different configuration in other embodiments, such as any configuration of the funnel closure 170 discussed herein.

The inner cavity 21 of the outer shell 12 has filler material 16 within it when the device is prepared for use. Filler material 16 is designed to be a heavy but loose and flowable material including, but not limited to, sand, polymer beads, or other such particulate materials. In the embodiment of FIGS. 1-8, the bag 10 has an inner bag 135 connected around the opening 24 to contain the filler material 16, with seams (not shown) that define the shape of the inner bag 135 and/or connect pieces forming the inner bag 135. The inner bag 135 has an open end 136 that is connected to the shell 12 around the opening 24 such that the inner bag 135 is in communication with the exit 164 of the funnel 27. In this configuration, filler 16 fed into the inner cavity 21 through the filling mechanism 25 enters the inner bag 135 and is held by the inner bag 135. The inner bag 135 and the shell 12 may be designed differently in materials, connections (e.g., seams 22), and structure. For example, the materials, connections, and structure of the shell 12 may be configured for strength, durability, abrasion resistance, and comfort in handling, while the materials, connections, and structure of the inner bag 135 may be configured primarily for strength and resisting leakage.

The bag 10 can be filled by opening the shell closure member 26 to open the opening 24 and extending the filling mechanism 25 through the opening 24. The funnel 27 in FIGS. 6-8 can be fully extended by pulling the funnel 27 through the opening, disconnecting the securing structure 176, and then fully extending the funnel 27. When fully extended, the funnel 27 can be opened by disconnecting the closure 170 to open the inlet 166, which may be done with the assistance of the grasping handles 168. It is noted that the grasping handles may also be used to hold the upper inlet 166 open during filling. Once open, the filler material 16 can be filled into the cavity 21 (and the inner bag 135 if present) by entering through the upper inlet 166, travelling through the funnel 27, and exiting into the bag 10 through the lower exit 164.

After the desired amount of filler material 16 has been fed into the inner cavity 21 of the weighted bag 10, the closure 170 of the filling mechanism 25 is manipulated to close the inlet 166. In the embodiment of FIGS. 6-8, the first and second engaging portions 172, 174 are engaged with each other to close the inlet 166 of the funnel 27. The filling mechanism 25 can also then be collapsed into the opening 24, using the securing structure 176 to further secure the collapsed filling mechanism 25. In the embodiment of FIGS. 6-8, the funnel 27 is collapsed by rolling or folding the top of the flexible encircling wall 160 at such amounts and to such a degree to cause the securing members 177, 178 to engage with each other and secure the funnel 27 in a collapsed position. The filling mechanism 25 can then be pushed through opening 24 and into the cavity 21 of the shell 12, and the shell closure member 26 is then manipulated to close the opening 24. In this collapsed configuration, the funnel 27 is received within a pocket 17 defined below the opening 24 between the proximal end 161 of the funnel 27 and the inner surface 31 of the shell 12. The resultant configuration of the filling mechanism 25 is sealed against ingress and egress of material in multiple ways, including by the shell closure member 26, the filling mechanism closure 170, and the folding or rolling of the filling mechanism 25 (secured by the securing structure 176), which creates a tortuous path for the filling material 16 to escape.

The handle assembly 14 of the bag 10 in FIGS. 1-8 includes a handle 60 and a strap assembly 70 including one or more straps connecting the handle 60 to the shell 12 to permit the bag 10 to be lifted by grasping the handle 60. In one embodiment where the shell 12 has a cylindrical shape, such as shown in FIGS. 1-8, the strap assembly 70 includes at least one circumferential strap 71 that extends partially or completely around the circumference of the cylindrical portion 54 of the shell 12. The strap assembly 70 in FIGS. 1-8 includes first and second circumferential or peripheral straps 71 extending around at least a portion of the periphery of the shell 12, and a central or transverse strap 80 extending around at least a portion of the periphery of the shell 12 transverse to the circumferential straps 71. The circumferential straps 71 as shown in FIGS. 1-5 extend parallel to each other around the cylindrical portion 54 of the shell 12, with the two circumferential straps 71 each located proximate one of the ends 55, and the central strap 80 extends around the cylindrical portion 54 and the circular ends 55 of the shell 12 perpendicular or transverse to both circumferential straps 71. It is noted that the term "circumferential" is used herein with respect to a circular cylindrical structure as shown in FIGS. 1-8, but that the term "peripheral" may be used to describe these straps for use with a structure that is not necessarily circular. The terms "circumferential" and "peripheral" as used herein are not intended to imply that the relevant strap necessarily extends around the entire circumference or periphery of the bag 10, but only specify the direction in which the strap extends, i.e., around the circumference or periphery.

In the embodiment of FIGS. 1-5, the first and second circumferential straps 71 extend from opposite ends 66 of the handle 60 circumferentially around the periphery of the cylindrical portion 54, around the bottom 39 of the shell 12, and back toward the top 38 of the shell 12 to engage the handle 60. The first circumferential strap 71 in this embodiment includes a first strap portion 74 that engages the handle 60 at one end 66 and extends in a first circumferential direction around a portion of the cylindrical portion 54 of the shell 12 and a second strap portion 75 that engages the handle 60 at one end 66 and extends in a second, opposite circumferential direction around a portion of the cylindrical portion 54 of the shell 12. The strap portions 74, 75 of the first circumferential strap 71 are joined together at a joint 76 on the bottom 39 of the shell 12 to form a single strap 71. In other embodiments, the strap portions 74, 75 may be parts of a single, integral or continuous strap 71, or may not connect together, e.g., such as by connecting to the shell 12. The second circumferential strap 71 in FIGS. 1-5 is similarly configured, including a first strap portion 77 that engages the handle 60 at one end 66 and extends in a first circumferential direction around a portion of the cylindrical portion 54 of the shell 12 and a second strap portion 78 that engages the handle 60 at one end 66 and extends in a second, opposite circumferential direction around a portion of the cylindrical portion 54 of the shell 12. The strap portions 77, 78 of the second circumferential strap 71 are joined together at a joint 79 on the bottom 39 of the shell 12 to form a single strap 71. In other embodiments, the strap portions 77, 78 may be parts of a single, integral or continuous strap 71, or may not connect together, e.g., such as by connecting to the shell 12. The joints 76, 79 are formed by a combination of stitching and adhesives in one embodiment, but may be formed by additional connecting structures and techniques described herein, or combinations thereof.

In the embodiment of FIGS. 1-5, the first strap portions 74, 77 of the first and second circumferential straps 71 are formed as an integral or continuous strap 72 that extends from the joint 76 into and through the handle 60 and to the other joint 79, and the second strap portions 75, 78 of the first and second circumferential straps 71 are similarly formed as an integral or continuous strap 73. In this embodiment, the first and second circumferential straps are all formed as part of a continuous strap, connected by the joints 76, 79. It is understood that a "continuous" strap as used herein refers to a strap that functions or operates as a single piece (which may have joints or other junctures within), while an "integral" strap as used herein refers to a strap that is formed of a single, integral piece without joints, seams, etc. These straps 72, 73 each extend circumferentially around the same side of the cylindrical portion 54 proximate opposite ends 55 in this embodiment, but it is understood that in another embodiment the straps 72, 73 may cross each other within the handle 60 and extend on opposite sides. The strap portions 74, 75, 77, 78 in this embodiment engage the handle 60 at least by extending through the handle 60, and may be fixedly connected to the handle 60, or the handle 60 may be able to slide with respect to the strap portions 74, 75, 77, 78. In other embodiments, the strap portions 74, 75, 76, 77 may be separate pieces that are separately engaged with the handle 60, or each circumferential strap 71 may itself be formed as a single piece engaged with the handle 60. In a further embodiment, both of the circumferential straps 71 may be formed by a single-piece strap that extends twice through the handle 60 and around both ends of the cylindrical portion 54 of the shell 12. It is understood that the engagement between the strap portions 74, 75, 77, 78 and the handle 60 and the shell 12 is sufficient that the shell 12 can be lifted by exerting an upward force on the handle 60.

In the embodiment of FIGS. 1-5, the circumferential straps 71 are connected to or engaged with the shell 12 in a slidable configuration by retaining structures 28 in the form of loop assemblies or belt loop assemblies, rather than being fixedly connected to the shell 12. It is understood that the retaining structures 28 may be referred to as loop assemblies 28 in discussing the embodiment of FIGS. 1-5 herein, but that other retaining structures may be used to achieve similar functionality. In another embodiment, one or both of the circumferential straps 71 may be provided in the same or a similar configuration while being fixedly connected to the shell 12, such as by stitching, adhesive, heat sealing, etc. The loop assemblies 28 in FIGS. 1-5 are positioned around the cylindrical portion 54 of the shell 12 at or proximate to the opposed ends 55, and may be referred to as a first end loop assembly 28 and a second end loop assembly 28. In the embodiment of FIGS. 1-5, the first end loop assembly 28 secures the first circumferential strap 71 to the shell 12, and the second end loop assembly 28 secures the second circumferential strap 71 to the shell 12. The loop assemblies 28 in this configuration extend in both circumferential directions around the cylindrical portion 54 of the shell 12, from the top 38 to the bottom 39 of the shell 12.

The shell 12 in FIGS. 1-5 also has circumferential supports 30 that are fixedly connected to the shell 12 (e.g., to the central body panel 58) circumferentially around the cylindrical portion 54 proximate the ends 55 and extend beneath the loop assemblies 28. The circumferential supports 30 in the embodiment of FIGS. 1-5 are connected to the shell 12 around the entire circumference of the shell 12 and across the entire width of each support 30, except for the locations where the circumferential supports 30 cross the opening 24 and the closure 26, where the circumferential supports 30 are connected only around the outer edge (the junctures with the end panels 50). The circumferential supports 30 may be made from woven nylon or other durable fabric material and may be connected to the shell 12 by stitching and adhesives in one embodiment, but may be differently configured in other embodiments.

The loop assemblies 28 in the embodiment of FIGS. 1-5 each include a plurality of cross supports 33 that define a channel 35 beneath the cross supports 33, such that the cross supports 33 extend across the channel 35. The cross supports 33 in FIGS. 1-5 are arranged in an alternating or oscillating pattern, where each cross support 33 is oriented at an oblique angle to the circumferential direction, the longitudinal direction (i.e., between the ends 55), the channels 35, the circumferential straps 71, and the seams 22 around the end panels 50 (e.g., a "zig-zag" pattern). In this configuration, adjacent cross supports 33 have triangular gaps 37 between them to expose portions of the circumferential straps 71 beneath. In one configuration, the end of each cross support 33 overlaps with the end(s) of the adjacent cross support(s) 33 as shown in FIGS. 1-5, and these overlapping portions of the cross supports 33 are stitched together at the points of connection between the cross supports 33 and the shell 12. These points of connection may be formed by continuous circumferential seams 29 that are spaced from each other, parallel to each other, and located on opposite sides of the respective channel 35, as shown in FIGS. 1-5. In one embodiment, the cross supports 33 form angles of 55-60° or 50-65° with the edges of the circumferential supports and/or the circumferential direction, and adjacent cross supports 33 are oriented at angles of 60-70° with each other, although other angular orientations may be used in other embodiments.

Each channel 35 in the embodiment of FIGS. 1-5 is defined by a single strip of material that is folded over itself to form an overlapping, alternating pattern and stitched at and around the folds to the shell 12 to form the cross supports 33. In another embodiment, the cross supports 33 defining each channel 35 may be separate pieces that are connected together. The cross supports 33 in the embodiment of FIGS. 1-5 are connected directly to the circumferential supports 30, but this configuration may vary. In this configuration, the circumferential straps 71 are slidably restrained between the loop assemblies 28 and the circumferential supports 30, and the circumferential supports 30 provide strength, durability, and abrasion resistance at these areas. The channels 35 are defined between the undersides of the cross supports 33 and the confronting surface of the shell 12, which may include the circumferential supports 30 as in the embodiment of FIGS. 1-5, or the outer surface 32 of the shell 12 or other structures in other configurations. Additionally, in one embodiment, the cross supports 33 are connected to the circumferential supports 30, and both such structures are connected to the shell 12, by two parallel, spaced circumferential seams 29. In the embodiment of FIGS. 1-8, one of such circumferential seams 29 also forms the connection between the outer and inner end panels 51, 52 and the center body panel 58. In another embodiment, where a circumferential support 30 or other support layer is not present, the cross supports 33 may be directly connected to the shell 12 along such circumferential seams 29.

The channels 35 of each of the loop assemblies 28 in FIGS. 1-5 include an entrance region 34 at or near the top 38 of the bag 10, and an exit region 36 at or near the bottom 39 of the bag 10. In this configuration, the circumferential straps 71 extend through the channels 35, such that each of the strap portions 74, 75, 77, 78 extends into the entrance region 34 of one of the channels 35, through the respective channel 35, and out the exit region 36 of the channel 35. The joints 76, 79 of the circumferential straps 71 are located in the spaces between the exit regions 36 of the two channels 35 of the respective loop assembly 28. In another embodiment, the retaining structures 28 may not be in the form of loop assemblies with cross supports 33, and may instead use solid or porous panels to create the channels 35, similar to the slots 57, or may use a different structure for retaining the circumferential straps 71. It is understood that the retaining structures or loop assemblies 28 and associated structures such as the circumferential supports 30 are not illustrated in FIGS. 6-8 for simplification purposes.

The strapping assembly 70 also includes a central strap or transverse strap 80 that extends in a peripheral direction from the handle 60 around both ends 55 of the shell 12. The central strap 80 includes first and second central strap portions 81, 82 that are engaged with the handle 60 and extend from the ends 66 of the handle 60 around opposite ends 55 of the shell 12, and the strap portions 81, 82 of the central strap 80 are joined together at a joint 83 on the bottom 39 of the shell 12 to form a single strap 80. In the embodiment of FIGS. 1-8, the central strap 80 is formed as a single piece, extending through the handle 60 to form the strap portions 81, 82 on opposite sides of the handle 60 and having two ends that meet at the joint 83. In another embodiment, the central strap portions 81, 82 may be separate pieces that are separately engaged with the handle 60. The joint 83 is formed by a combination of stitching and adhesives in one embodiment, but may be formed by additional connecting structures and techniques described herein, or combinations thereof. In another embodiment, the central strap portions 81, 82 may not connect to each other, and may instead be connected to the shell 12 on the ends 55 or on the bottom 39. It is understood that the engagement between the strap portions 81, 82 and the handle 60 and the shell 12 is sufficient that the shell 12 can be lifted by exerting an upward force on the handle 60.

The portions 81, 82 of the central strap 80 in FIGS. 1-8 extend around the ends 55 of the shell 12 by extending through the slots 57 in the ends 55. As shown in FIGS. 6-8, the central strap portions 81, 82 extend between the outer and inner panels 51, 52 and through the upper and lower openings 53 to pass into and out of the slot 57. The central strap portions 81, 82 further extend beneath the circumferential straps 71 and across the bottom 39 of the shell 12 in this embodiment. The central strap 80 is slidably received within the slots 57 and is not fixedly connected to the shell 12 in the embodiment of FIGS. 1-8, but one or both of the central strap portions 81, 82 may be fixedly connected to the shell 12, e.g., within the slot 57 or on the bottom 39 of the shell 12. In another embodiment, the strap portions 81, 82 may extend around the ends 55 of the shell 12 by extending on the outsides of the outer panels 51. The inner panels 52 and/or the slots 57 may be absent, or the slots 57 may be created by an external structure, in such a configuration.

The strap assembly 70 in the embodiment of FIGS. 1-8 assists with distribution of forces around the shell 12, allowing the bag 10 to be handled roughly and even thrown into the air (e.g., 15 feet or more) and landing on the ground, while containing heavy filler material 16 (e.g., 50-100 pounds). The positions and orientations of the straps 71, 80 distribute the forces of lifting and throwing by the handle 60 evenly around the shell 12 and avoid concentration of stresses that can result at seams, bonds, or other fixed connections. Additionally, the ability of the straps 71, 80 to slide and move with respect to the shell 12 allows more even exertion of forces on the straps 71, 80 and allows each strap 71, 80 to compensate for forces exerted unevenly on other straps 71, 80. The configuration of the strap assembly 70 further improves durability of the straps 71, 80 themselves and of the bag 10 as a whole, among other benefits.

The handle 60 in the embodiment of FIGS. 1-8 is formed as an elongated tubular body 62 having a circular cross section and a central bore or passage 64 extending between opposing ends 66 along the direction of elongation. The body 62 is also slightly curved or arcuate in this configuration, rising in the middle with respect to the ends 66. In this embodiment, the handle 60 is oriented to extend longitudinally with respect to the shell 12, i.e., between the ends 55 and parallel to the central axis of the cylindrical portion 54. The outer surface of the body 62 of the handle 60 forms a grasping surface configured to be grasped by the user, and a coating, sleeve, or other structure applied to the body 62 to enhance gripping. The handle 60 may also have a coating, sleeve, or other structure applied to the inside of the central passage 64 to either increase or decrease grip or friction with respect to the straps 72, 73, 80 that extend through the central passage 64. In one embodiment, the handle 60 and/or the body 62 thereof may be made from a flexible and resilient material, such as a PVC hose material or the like. In the embodiment of FIGS. 1-8, the handle 60 is positioned above the outer shell 12 and the opening 24. In other embodiments, the handle 60 may have a different structure or material construction, including different shapes including, but are not limited to, ovals, squares, rectangles, or other shapes. In another embodiment, the handle 60 may not have a central passage 64, such as in an embodiment where the straps 72, 73, 80 are not continuous or where the handle 60 has other structures for engaging continuous straps 72, 73, 80. In a further embodiment, the handle 60 may have structures for fixedly connecting to the straps 71, 80.

One embodiment of a method for assembly of a weighted bag 10 as shown in FIGS. 1-8 may be performed using stitching, adhesives, heat sealing or pressing, or various other connection techniques to form seams and other connections between the various components. The loop assemblies 28 in this embodiment are constructed by folding four strips of material to form the cross supports 33 and fixedly connecting the cross supports 33 (e.g., by stitching, adhesives, heat sealing, etc.) along the edges of the circumferential supports 30 to create the alternating configuration of the cross supports 33. The cross supports 33 are not connected along the middle of the circumferential supports 30 to define the channels 35 between the cross supports 33 and the circumferential supports 30. The circumferential straps 71 and the central strap 80 are connected to the handle 60, which is accomplished in the embodiment of FIGS. 1-8 by pulling and/or pushing the single-piece straps 72, 73, 80 through the central passage 64 of the handle 60, such that the straps 72, 73, 80 extend from both ends 66 of the handle. The straps 72, 73, 80 may be connected together at one or more points within the handle 60 in one embodiment.

The funnel 27 is assembled by creating the encircling wall 160, e.g., from a single piece of fabric wrapped and connected to itself to form a funnel structure. The engaging portions 172, 174 and the securing members 177, 178 are connected to the wall 160 in appropriate locations, in the form of complementary strips of hook and loop material, in the embodiment of FIGS. 1-8. The grasping handles 168 may also be connected to the wall 160 at or proximate the inlet 166, and in one embodiment, the grasping handles 168 are connected prior to the engaging portions 172, 174 such that the engaging portions 172, 174 overlay the grasping portions 168.

The central body panel 58 is prepared by cutting the opening 24 through the central body panel 58 and the shell closure member 26 is connected to the opening 24. The shell closure member 26 may be provided with a shroud or other cover to protect the shell closure member 26 and increase comfort if the shell closure member 26 is contacted by the user during use, including a moveable cover or a static cover, e.g., to cover rigid surfaces such as zipper teeth. The circumferential supports 30 and the loop assemblies 28 are then positioned over and connected to the outer surface 32 of the central body panel 58 along opposite edges of the central body panel 58. The inner bag 135 is connected to the central body panel 58 by connecting the open end 136 around the opening 24 on the inner surface 31. The inner bag 135 may be formed before connecting to the central body panel 58, such as by connecting several panels of material together or using seams to form a single piece of material in the correct shape for the inner bag 135. The funnel 27 is also connected to the central body panel 58. by connecting the proximal end 161 of the wall 160 around the opening 24 on the inner surface 31. In one embodiment, the funnel 27 and the inner bag 135 may be connected together to the central body panel 58.

The shell 12 is then completed by connecting the end panels 50 to the central body panel 58 around the seams 22 shaped to form the cylindrical portion 54 with circular ends 55. In one embodiment, the inner panels 52 and the outer panels 51 are connected to the central body panel 58 with the same seam 22 or connection, and in another embodiment, the inner panels 52 are connected before the outer panels 51. The inner panels 52 are connected around their entire perimeters in this configuration, and the outer panels 51 are connected around the majority of the perimeters, but are not connected in strategic areas to form the slots 57. It is understand that a cover or lining may be applied around the openings 53 of each slot 57 for durability and abrasion resistance. The handle assembly 14 is then coupled to the shell 12 by extending the circumferential strap portions 74, 75, 77, 78 through the channels 35 and joining them at the joints 76, 79 to form the circumferential straps 71, and extending the central strap portions 81, 82 through the slots 57, and then joining them at the joint 83 to form the central strap 80. The bag 10 of FIGS. 1-8 is substantially complete after these steps have been accomplished.

Figure 9:
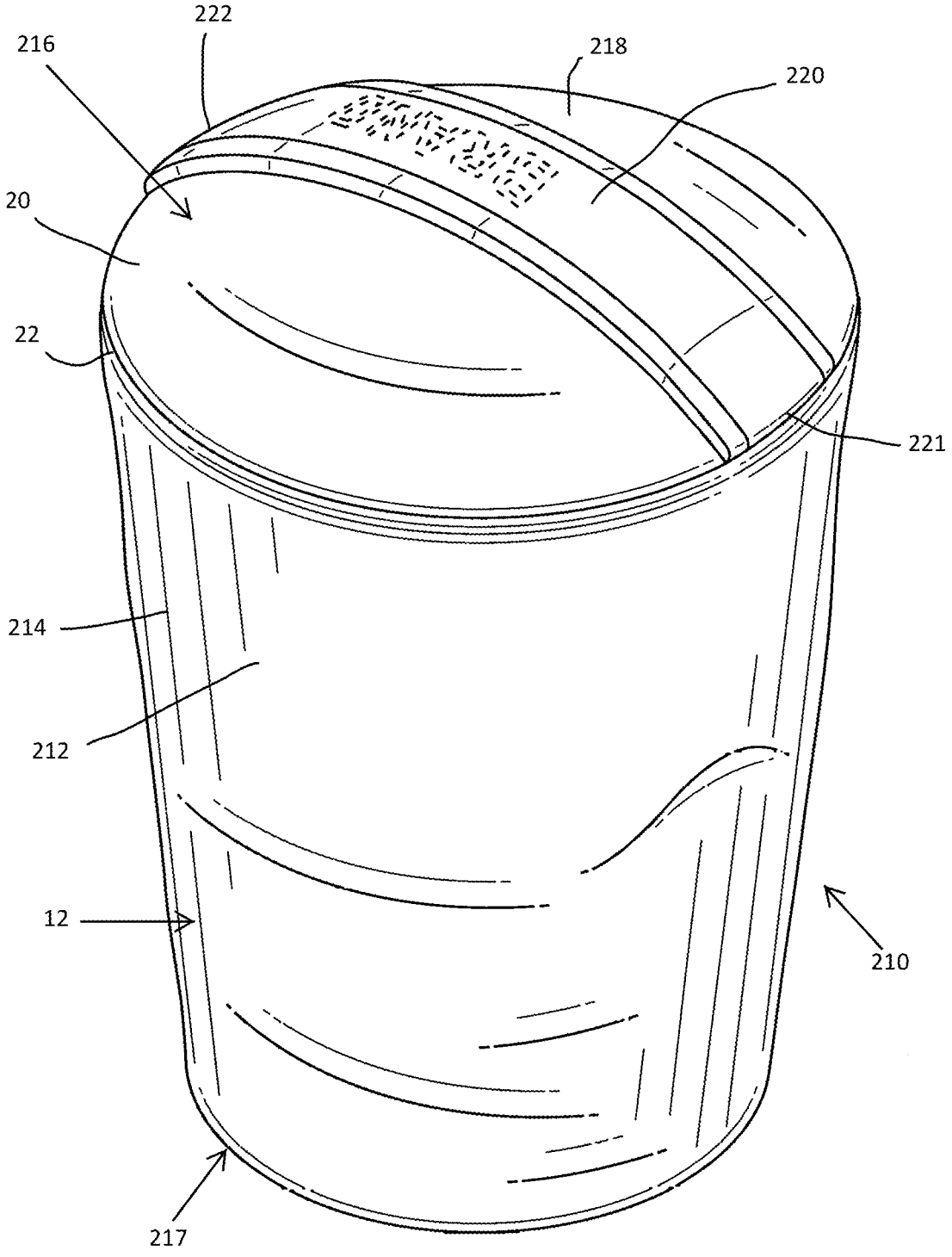
FIG. 9 is a front perspective view of another embodiment of a weighted bag according to aspects disclosed herein.
Figure 10:
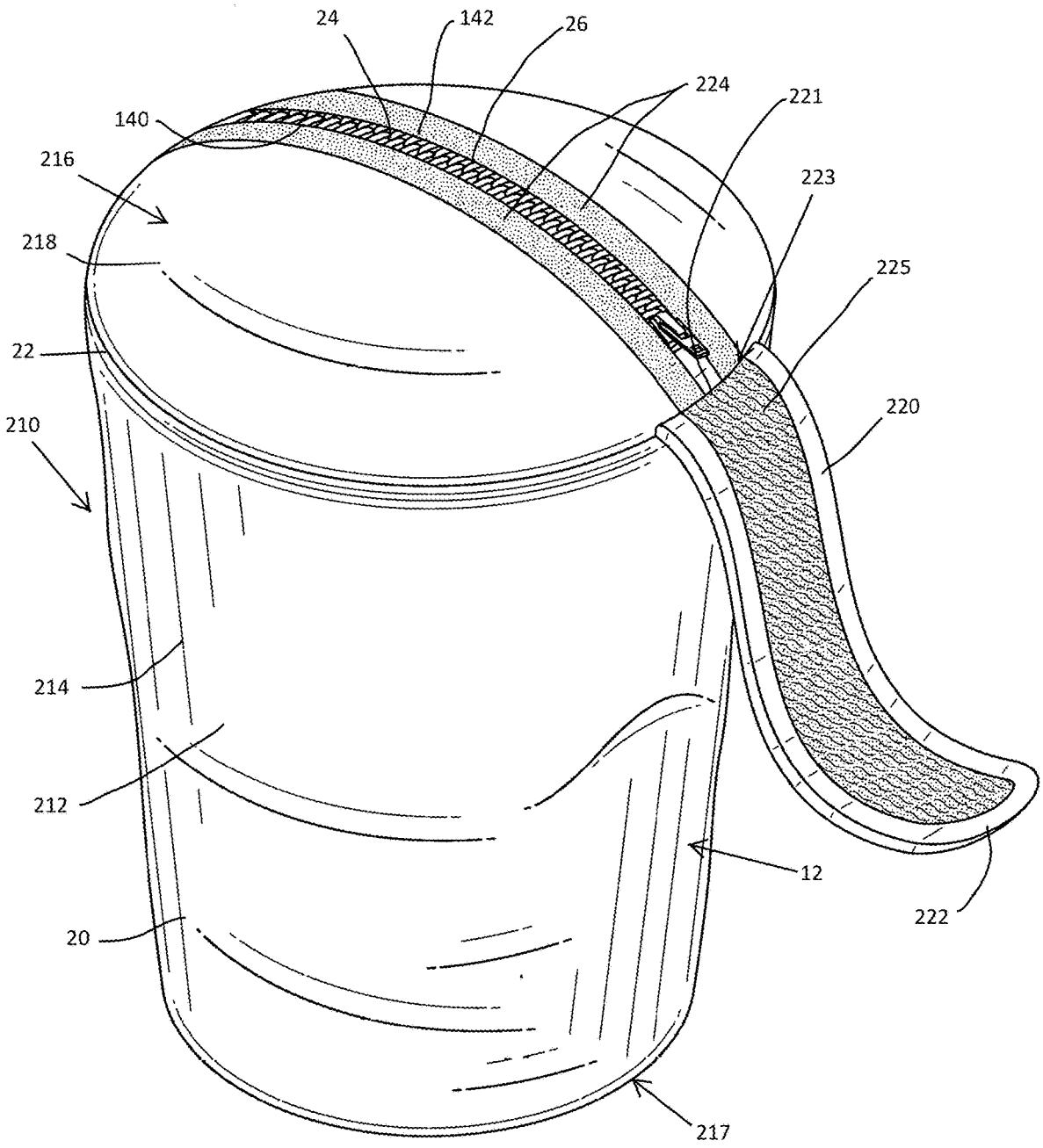
FIG. 10 is a front perspective view of the weighted bag of FIG. 9, with a releasable cover of the bag moved to expose an opening of the bag.
Figure 10A:
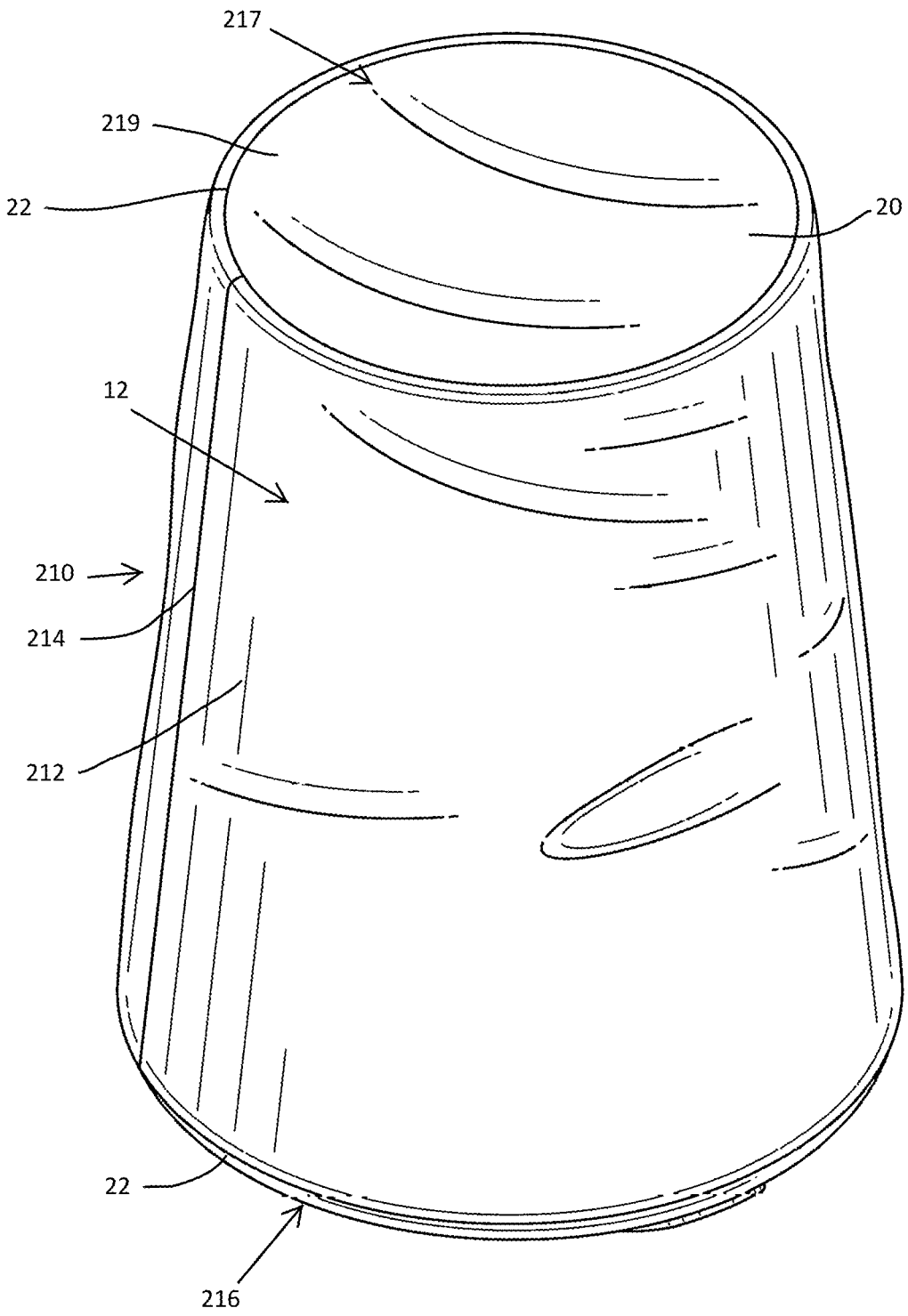
FIG. 10A is a bottom front perspective view of the weighted bag of FIG. 9.
Figure 11:
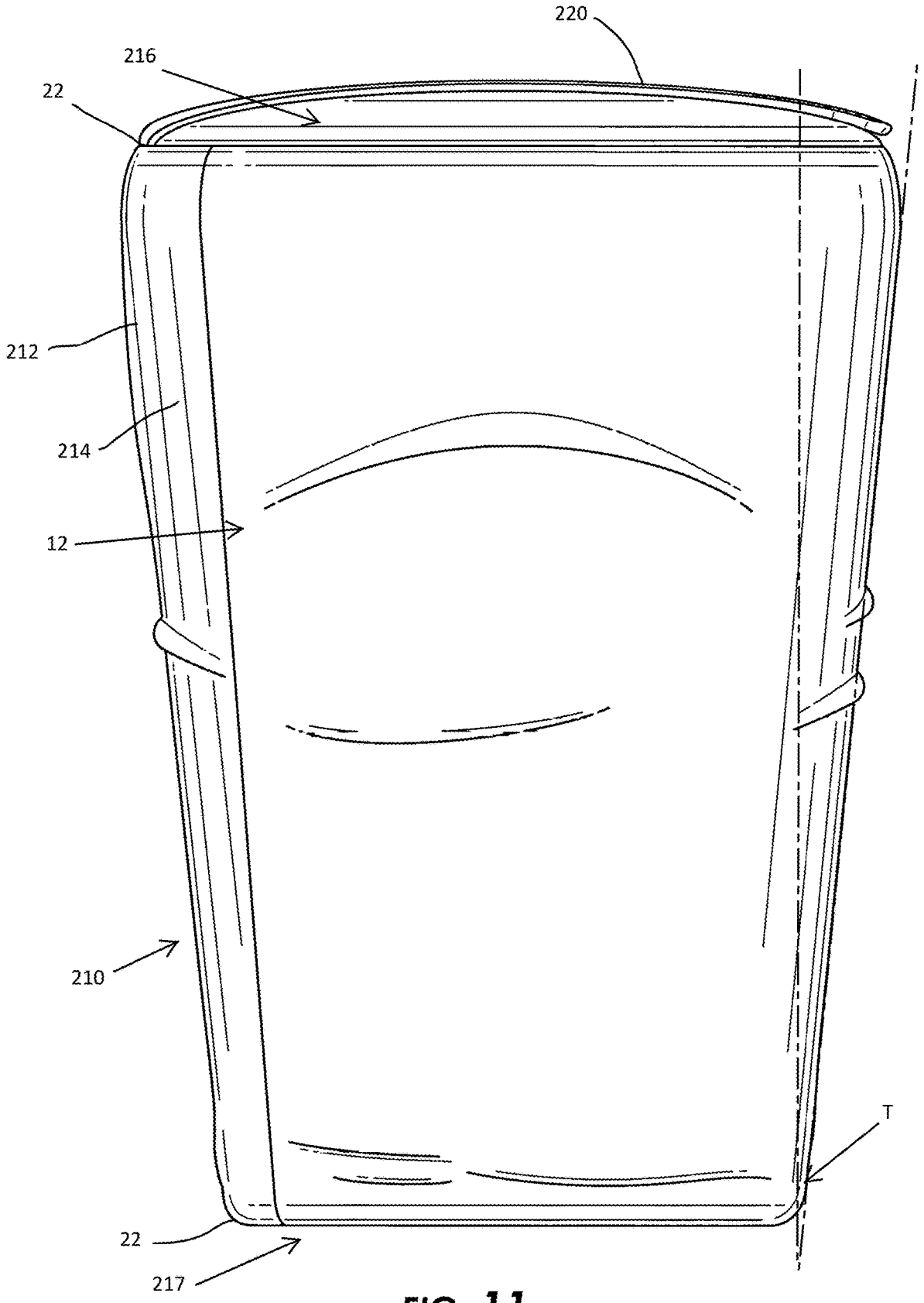
FIG. 11 is a front elevation view of the weighted bag of FIG. 9.
Figure 12:
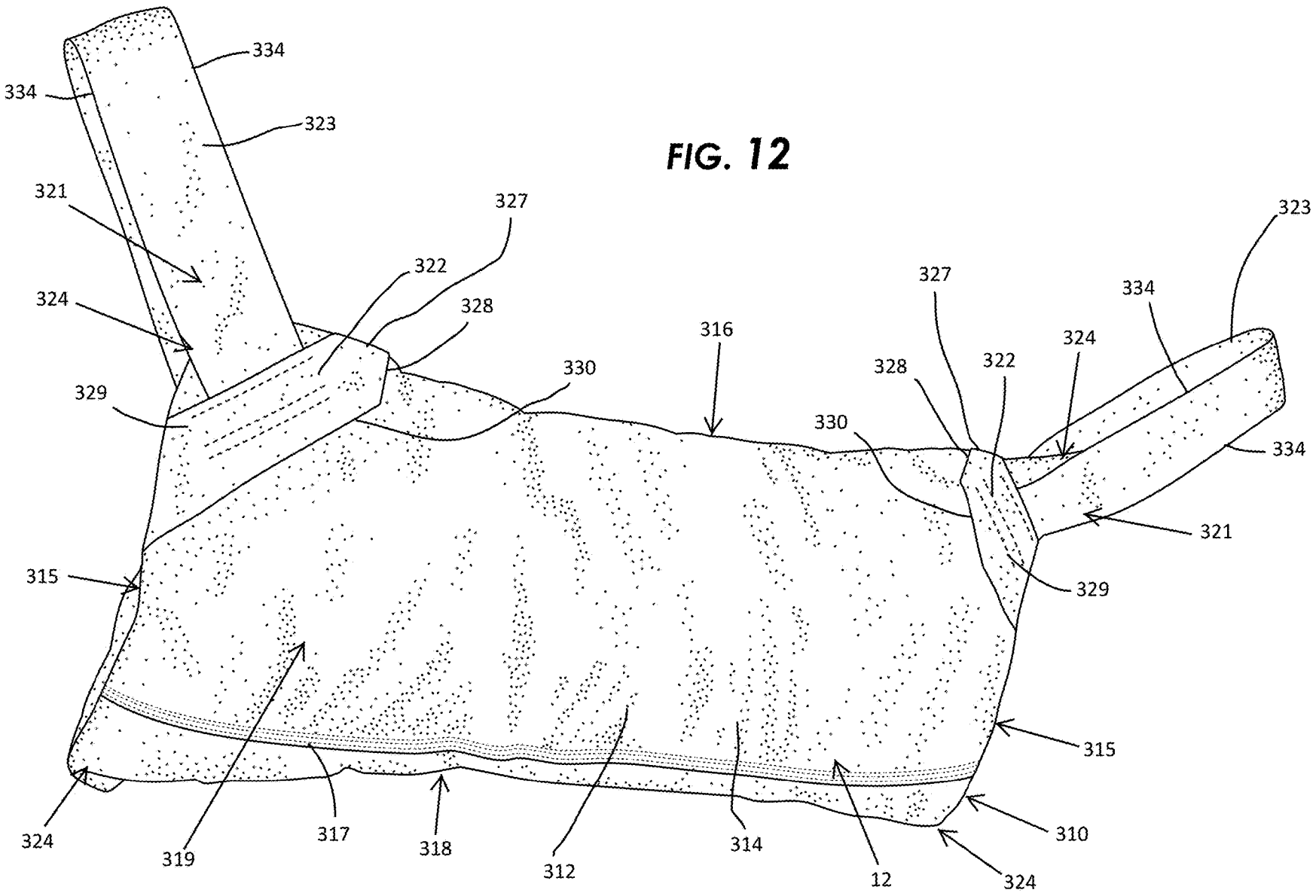
FIG. 12 is a rear perspective view of another embodiment of a weighted bag according to aspects disclosed herein.

FIGS. 9-11 illustrate another embodiment of a weighted bag 210 that includes many components and features in common with the bag 10 illustrated in FIGS. 1-8 and described herein. Such common features and components are referenced in FIGS. 9-11 with the same reference numbers used herein with respect to FIGS. 1-8, and such common features and components may not be re-described herein in detail with respect to the embodiment of FIGS. 9-11. While not illustrated in the drawings, the bag 210 of FIGS. 9-11 includes a filling mechanism 25 that is the same or similar to the filling mechanism 25 described herein and shown in FIGS. 6-8, in one embodiment. The filling mechanism 25 in this embodiment includes a funnel 27 having all the structural elements described herein with respect to the funnel 27 of FIGS. 6-8 and functioning in the same manner, but may include additional or alternate features as described herein in other embodiments. For example, the bag 210 in FIGS. 9-11 has a funnel 27 having a flexible encircling wall 160 with a proximal end 161 connected to the inner surface 31 of the shell 12 around the opening 24 and a distal end 162 that can be pulled through the opening 24 to extend the funnel 27 for filling. The wall 160 of the funnel 27 in this embodiment defines an inlet 166 proximate the distal end 162 and an exit 164 into the shell 12, and the funnel 27 also has a funnel closure 170 includes a first engaging portion 172 and second engaging portion 174 positioned on opposite sides 165, 167 of the wall 160 at the inlet 166 and securing members 176 as shown in FIGS. 6-8 and described herein. The bag 210 in FIGS. 9-11 also has an inner bag 135, as shown in FIGS. 6-8 and described herein, which is also not illustrated in FIGS. 9-11. It is understood that the inner bag 135 in the embodiment of FIGS. 9-11 is shaped to be consistent with the shape of the shell 12 of the bag 210.

The shell 12 of the bag 210 in FIGS. 9-11 has a frusto-conical or tapered shape, and may be formed by multiple panels 20 connected by seams 22 as described herein. In this embodiment, the shell 12 defines a tapered configuration, having a central body portion 212 formed by a central body panel 214 and circular flat or bulged ends 216, 217 formed by end panels 218, 219. The central body portion 212 in FIGS. 9-11 is formed as a tapered portion and has a frusto-conical shape that has a smaller width, perimeter (e.g., circumference), and cross-sectional area (relative to the central axis of the shell 12) at the bottom 38 and a larger width, perimeter, and cross-sectional area at the top 39, and the central body panel 214 is formed to create this shape. The central body portion 212 has a continuous linear taper between the ends 216, 217 when viewed from the side or in cross-section in the embodiment of FIGS. 9-11. The contour and taper of the central body portion 212 may be different in other embodiments, for example, a concavely curved taper creating a funnel shape, or a convexly curved taper, or a non-continuous linear taper. Additionally, in another embodiment, the central body portion 212 may not be tapered the entire distance between the ends 216, 217, i.e., the tapered portion may be a smaller portion of the central body portion 212. In such a configuration, the central body portion 212 may have a non-tapered portion or a reverse-tapered portion adjacent the tapered portion.

The ends 216, 217 of the shell 12 in the embodiment of FIGS. 9-11 are circular in shape, and the end panels 218, 219 forming the ends 216 are circular panels that may be bulged or flat. The top end 216 and the top end panel 218 have larger widths, perimeters (e.g., circumferences) and surface areas than the bottom end 217 and the bottom end panel 219, which complements the taper of the central body portion 212. In one embodiment, the top end 216 may have a width of 12-20 in., or 14-18 in., the bottom end 217 may have a width of 6-14 in., or 8-12 in., and the height of the central body portion 212 may be 19-25 in., or 20-24.5 in. In another embodiment, the bag 210 may be larger or smaller, but the ends 216, 217 may have similar proportions, i.e., the ratio of the width of the top end 216 to the width of the bottom end 217 is 1.25:1-2:1 or 1.5:1-1.75:1. In such embodiments, the ratio of the area of the top end 216 to the area of the bottom end 217 is 1.5:1-4:1 or 2.25:1-3:1 In a shell 12 where the central body portion 212 has a continuous linear taper, the taper angle T of the central body portion 212 in such a configuration is 6-10°, or 7-9°, with respect to the vertical direction and/or central axis of the shell 12. It is understood that the central axis is an axis that passes through the center of volume of the shell 12 when fully expanded and passes through the geometric center of the top and bottom ends 216, 217, which may be an axis of symmetry in a symmetrical structure. The bag 210 in FIGS. 9-11 is configured for lifting by the user holding the bag 210 against his/her chest and wrapping his/her arms around the central body portion 212, and the tapering of the central body portion 212 produces a shape that is advantageous for such usage, by aiding the user in holding the bag 210 without downward slippage due to the weight of the bag 210.

The bag 210 has an opening 24 on the top 38 of the shell 12, which is formed by an opening along the centerline of the top end panel 218 in the embodiment of FIGS. 9-11. The opening 24 is provided with a closure mechanism 26 in the form of a zipper in this embodiment. It is understood that the opening 24 and the closure mechanism 26 may have any structure discussed herein with respect to the opening 24 and the closure mechanism 26 of FIGS. 1-8. The opening 24 and the closure mechanism 26 in this embodiment function in the same way as in the bag 10 of FIGS. 1-8, whereby the closure mechanism 26 opens to allow the funnel 27 to be extended for filling the bag 210, and the closure mechanism 26 can be closed after collapsing the funnel 27 to seal the opening 24. The closure mechanism 26 in FIGS. 9-11 has a moveable cover 220 that can be moved to cover the opening 24 as shown in FIG. 9, or to uncover the opening 24 as shown in FIG. 10. The cover 220 in FIGS. 9-11 is in the form of a flap that is anchored at a proximal end 221 and has a free distal end 222 that can be folded to cover or uncover the opening 24 as desired. Additionally, the bag 210 in this embodiment has a releasable connecting structure 223 configured for retaining the cover 220 to the top 38 of the shell 12 to cover the opening 24, including complementary engaging members 224, 225 in the form of strips of hook and loop material. The releasable connecting structure 223 illustrated in FIG. 10 includes engaging members 224 in the form of two strips of hook and loop material connected to the top end panel 218 along opposite sides of the opening 24 and another one or more engaging members 225 in the form of a complementary strip of hook and loop material connected to the underside of the cover 220.

The bag 210 may be made using the same materials and techniques described herein with respect to the embodiment of FIGS. 1-8. In particular, the shell 12, the inner bag 135, and the filling mechanism 25 can be assembled in a similar manner as the same components in FIGS. 1-8. Assembly of the bag 210 in FIGS. 9-11 further includes connecting the engaging members 224 to the top end panel 218 around the opening 24 and connecting the engaging member 225 to the underside of the cover 220, and then connecting the cover 220 to the shell 12, using any of the connection structures and techniques described herein, including stitching, adhesives, and heat sealing, among others.

FIGS. 12-18 illustrate another embodiment of a weighted bag 310 that includes many components and features in common with the bag 10 illustrated in FIGS. 1-8 and the bag 210 illustrated in FIGS. 9-11 and described herein. Such common features and components are referenced in FIGS. 12-18 with the same reference numbers used herein with respect to FIGS. 1-11, and such common features and components may not be re-described herein in detail with respect to the embodiment of FIGS. 12-18. While not illustrated in the drawings, the bag 310 of FIGS. 12-18 includes a filling mechanism 25 that is the same or similar to the filling mechanism 25 described herein and shown in FIGS. 6-8, in one embodiment. The filling mechanism 25 in this embodiment includes a funnel 27 having all the structural elements described herein with respect to the funnel 27 of FIGS. 6-8 and functioning in the same manner, but may include additional or alternate features as described herein in other embodiments. For example, the bag 310 in FIGS. 12-18 has a funnel 27 having a flexible encircling wall 160 with a proximal end 161 connected to the inner surface 31 of the shell 12 around the opening 24 and a distal end 162 that can be pulled through the opening 24 to extend the funnel 27 for filling. The wall 160 of the funnel 27 in this embodiment defines an inlet 166 proximate the distal end 162 and an exit 164 into the shell 12, and the funnel 27 also has a funnel closure 170 includes a first engaging portion 172 and second engaging portion 174 positioned on opposite sides 165, 167 of the wall 160 at the inlet 166 and securing members 176 as shown in FIGS. 6-8 and described herein. The bag 310 in FIGS. 12-18 also has an inner bag 135, as shown in FIGS. 6-8 and described herein, which is also not illustrated in FIGS. 12-18. It is understood that the inner bag 135 in the embodiment of FIGS. 12-18 is shaped to be consistent with the shape of the shell 12 of the bag 210.

The shell 12 of the bag 310 in FIGS. 12-18 has a rectangular shape from the front and the rear and an oval shape (when filled) from the sides. In this embodiment, the shell 12 defines a rectangular configuration that is elongated between two opposed ends 315. The shell 12 has a central body portion 312 formed by a single panel 314 that is wrapped around a top 316 and a bottom 318 of the central body portion 312 and is connected to itself along end seams 313 at opposed ends 315 and along a lateral seam 317 extending between the ends 315 on the rear side 319 of the shell 12. The rear seam 317 extends across the rear side parallel to the lateral centerline L of the shell 12 (see FIG. 13) and below the lateral centerline L, i.e., between the lateral centerline L and the bottom 318. The shell 12 of the bag 310 in FIGS. 12-18 is elongated between the ends 315 to form the rectangular shape having four corners 324. When the bag 310 is filled with the filling material 16, the corners 324 retain semi-pointed shapes, while the top 316 and bottom 318 become rounded to create the oval shape of the filled shell 12. In this configuration, the top 316 and bottom 318 may develop a slight outward curvature toward the corners 324 and a more flattened shape near the lateral centerline of the bag 310. The shell 12 may have a different shape in other embodiments, and/or the shell 12 may be made from multiple panels in other embodiments.

Figure 13:
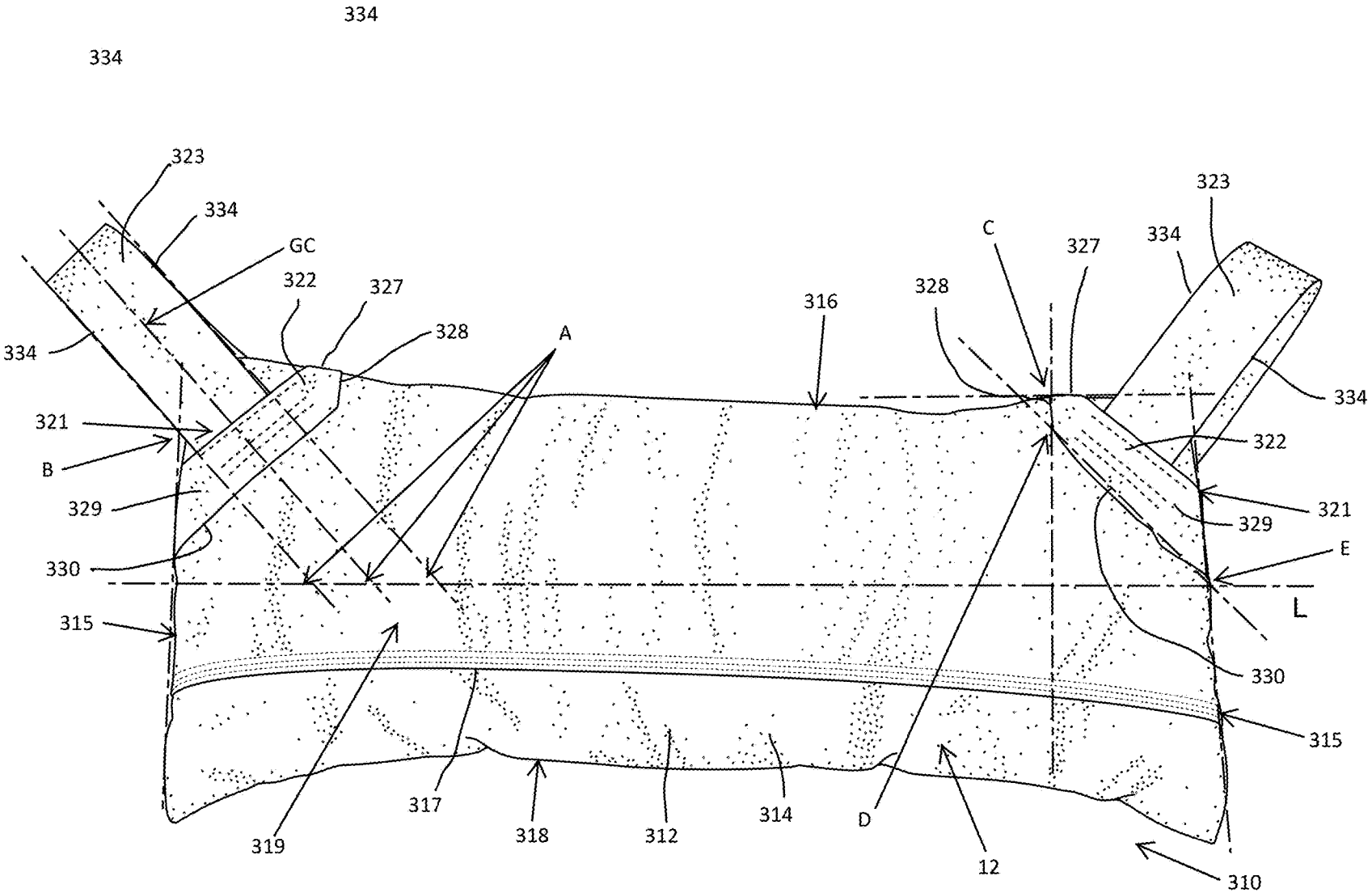
FIG. 13 is a rear elevation view of the weighted bag of FIG. 12.
Figure 14:
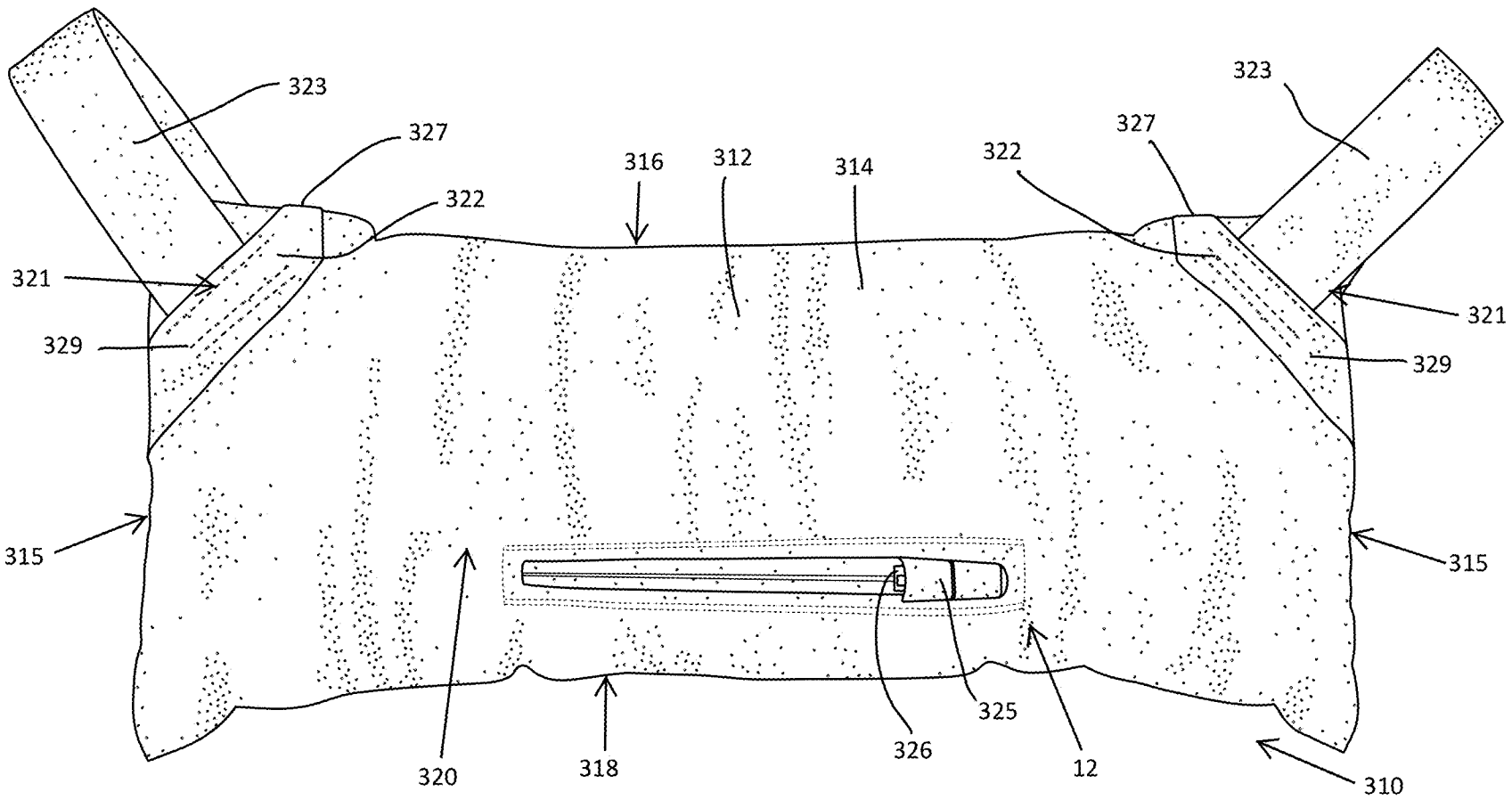
FIG. 14 is a front elevation view of the weighted bag of FIG. 12.
Figure 16:
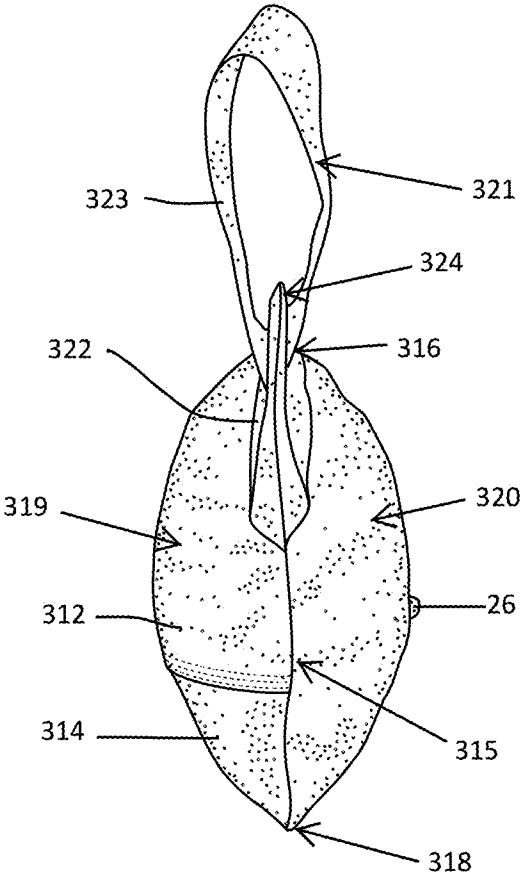
FIG. 16 is a left side elevation view of the weighted bag of FIG. 12.
Figure 15:
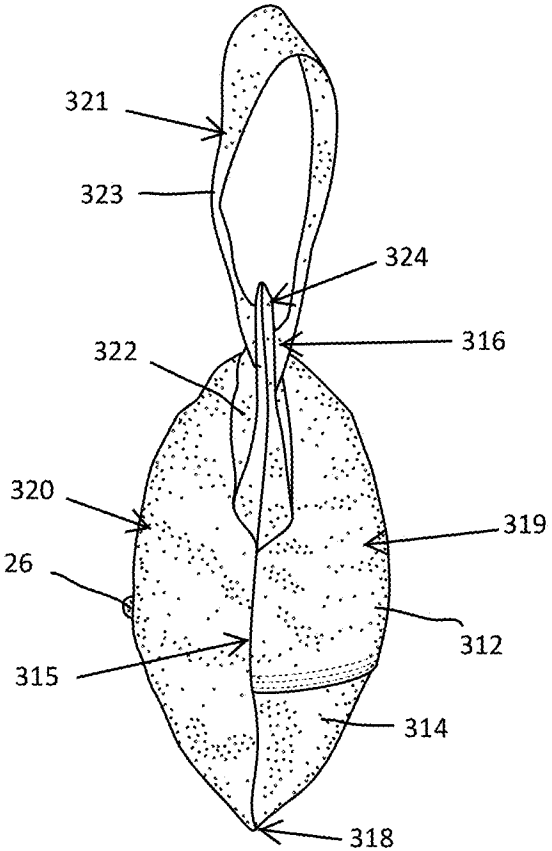
FIG. 15 is a right side elevation view of the weighted bag of FIG. 12.

The bag 310 has an opening 24 on the front 320 of the shell 12, which is formed by an opening through the panel 314 along the centerline of the front 320 in the embodiment of FIGS. 12-18. The opening 24 is provided with a closure mechanism 26 in the form of a zipper in this embodiment. It is understood that the opening 24 and the closure mechanism 26 may have any structure discussed herein with respect to the opening 24 and the closure mechanism 26 of FIGS. 1-8. The opening 24 and the closure mechanism 26 in this embodiment function in the same way as in the bag 10 of FIGS. 1-8, whereby the closure mechanism 26 opens to allow the funnel 27 to be extended for filling the bag 310, and the closure mechanism 26 can be closed after collapsing the funnel 27 to seal the opening 24. The closure mechanism 26 in FIGS. 12-18 has a fixed cover 325 that covers one end of the opening 24 as shown in FIG. 14. The cover 325 is positioned so that the handle 326 of the zipper of the closure mechanism 26 can be positioned beneath the cover 325 when the closure mechanism 26 is in the closed position, in order to avoid the zipper handle 326 from pressing into the user's skin during use, enhancing comfort. The cover 325 in FIG. 14 is in the form of an arch that is anchored at the ends and arches over the end of the opening 24.

In one embodiment, the bag 310 has two handles 321 connected to the shell 12 near the junctures between the top 316 and the ends 315, i.e., the corners 324 along the top 316 of the shell 12 in the rectangular shell 12 shown in FIGS. 12-18. The handles 321 in this embodiment each include a base 322 fixedly connected to the shell 12 and a gripping member 323 extending outward from the base 322. The gripping members 323 are each formed as a loop for the user's hand to extend through in the embodiment of FIGS. 12-18. In this embodiment, each of the gripping members 323 has ends that are connected to the front and rear sides 320, 319 of the shell 12 with the gripping member 323 forming a loop configuration between these connections. In other embodiments, the gripping members 323 may be connected only to the front or rear side 320, 319 of the shell 12 and still have a loop configuration, or the gripping members 323 may have a different configuration (e.g., a tethered handle). Additionally, the gripping members 323 in one embodiment extend outward at oblique angles A with the lateral centerline L of the shell 12 (see FIG. 13) and oblique angles B with the nearest peripheral edges of the shell 12. In one embodiment, the angles A are approximately 45° (40-50°) to the lateral centerline L, and the angles B are approximately 135° (125-145°) with the nearest peripheral edge, i.e., the top 316 or the nearest end 315 of the shell 12 in this embodiment. The angles B are measured with respect to the edges 334 of the gripping members 323 that are nearest the respective peripheral edge of the shell 12. In other embodiments, the gripping members 323 may extend outward at angles A that are 30-60° to the lateral centerline L of the shell 12), and the edges 334 of the gripping members 323 form angles B of approximately 120-150° with the nearest peripheral edge, i.e., the top 316 or the nearest end 315 of the shell 12 in such embodiments. It is understood that the angles A and B described herein are measured with respect to the gripping members 323 when extended to their furthest degree of extension in their most natural direction of extension, as shown in FIG. 13. It is also understood that the angle A measured with respect to the lateral centerline L can be measured with respect to either edge 334 or the geometric centerline GC of the gripping member 323 in an embodiment as in FIG. 13 where the edges 334 and the geometric centerline GC are all parallel to each other, although in some less symmetrical configurations, the geometric centerline GC may be a more appropriate. In other words, the angle A can be measured with respect to at least one of the edges and/or the geometric centerline. It is further understood that the angles A and B are measured when the bag 310 is empty and pressed flat to the ground.

The bases 322 of the handles 321 are connected to the shell 12 proximate the top corners 324, and the bases 322 in FIGS. 12-18 extend on both the front side 320 and the rear side 319 of the shell 12 to permit the gripping members 323 to connect to both sides 319, 320. In the embodiment of FIGS. 12-18, each base 322 is formed of a single strip of material that extends from the nearest end 315 at an angle across the front 320 of the shell 12, over the top 316 of the shell 12, and then at an angle across the rear 319 of the shell 12 back to the end 315. In this configuration, the base 322 is not connected to the corner 324, leaving the corner 324 exposed. The base 322 in this configuration has a crossing portion 327 that extends over the top 316 of the shell 12, and the inner edge 328 of the crossing portion 327 (i.e., farthest edge inward from the nearest end 315) in FIGS. 12-18 extends approximately perpendicular (90°) to the top 316 of the shell 12 when the bag 310 is empty and pressed to the ground. In other words, the angle C between the inner edge 328 of the crossing portion 327 and the top 316 of the shell 12 is 80-100° or 85-95°. The inner edge 328 of the crossing portion 327 may additionally or alternately form the same or similar angles with respect to the lateral centerline L of the shell 12 and/or a line (not shown) extending directly between the top corners 324 on the shell 12. This configuration is shown in greater detail in FIGS. 17-18. The inner edge 328 of the crossing portion 327 is a straight edge in the embodiment of FIGS. 12-18, i.e., the inner edge 328 would be straight and linear if the base 322 were laid flat. Additionally, the base 322 in FIGS. 12-18 has angling portions 329 that angle across the front and rear sides 320, 319 of the shell and juncture with the crossing portion 327, and the inner edge 330 of each angling portion 329 forms a juncture angle D with the crossing portion 327 that is 110-140° or 120-130°. The angle E at the juncture between the inner edge 330 of each angling portion 329 and the nearest end 315 of the shell 12 is 40-70° or 50-60°. It is understood that the angles C, D, and E are measured when the bag 310 is empty and pressed flat to the ground. The crossing portion 327 in the embodiment of FIGS. 12-18 has a narrower width measured between the inner edge 328 and the opposite (outer) edge that is smaller than the widths of the angling portions 329.

Figure 17:
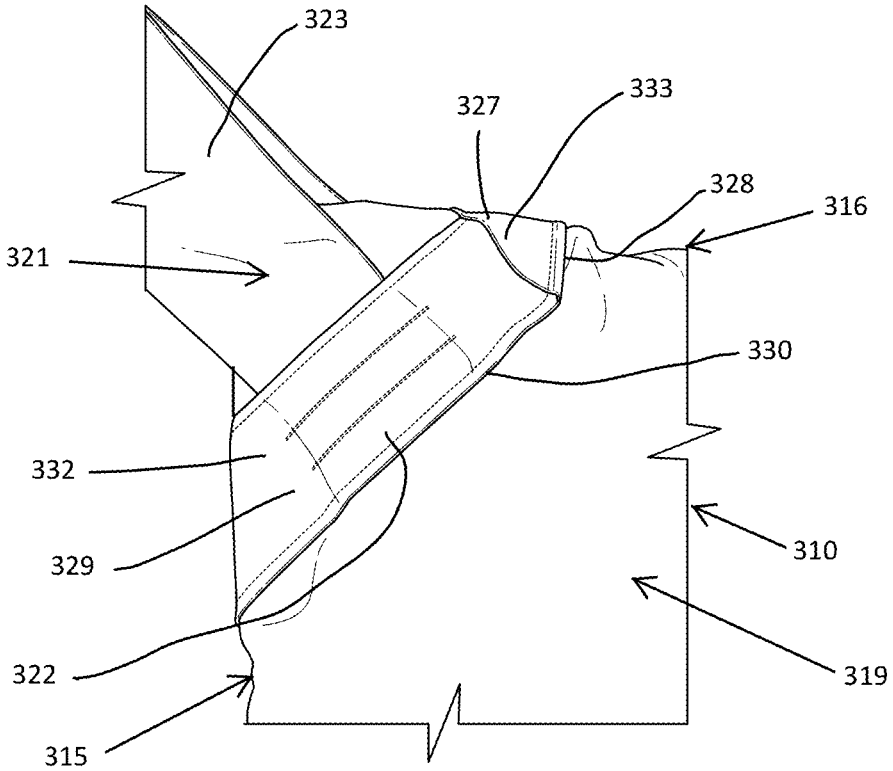
FIG. 17 is a magnified view of a portion of the weighted bag of FIG. 13.
Figure 18:
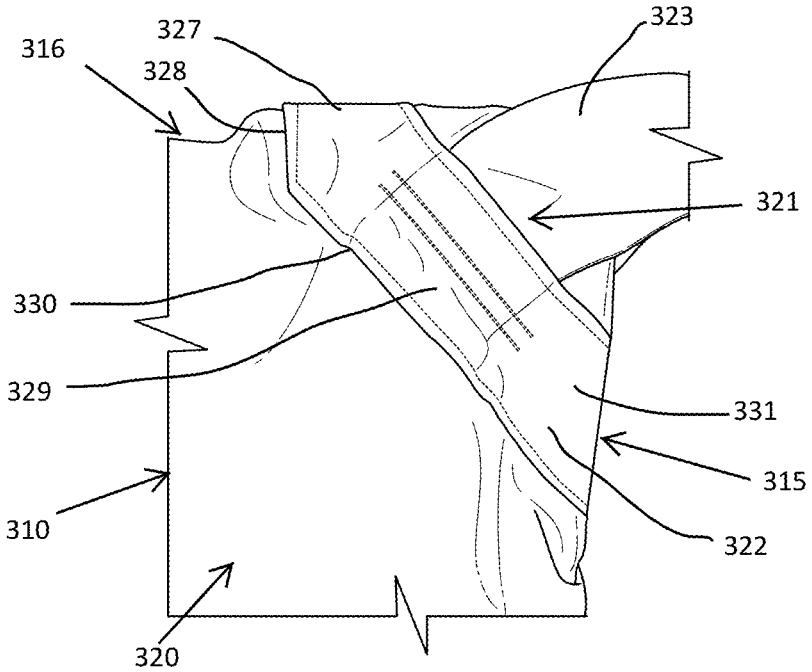
FIG. 18 is a magnified view of a portion of the weighted bag of FIG. 14.
Figure 19:
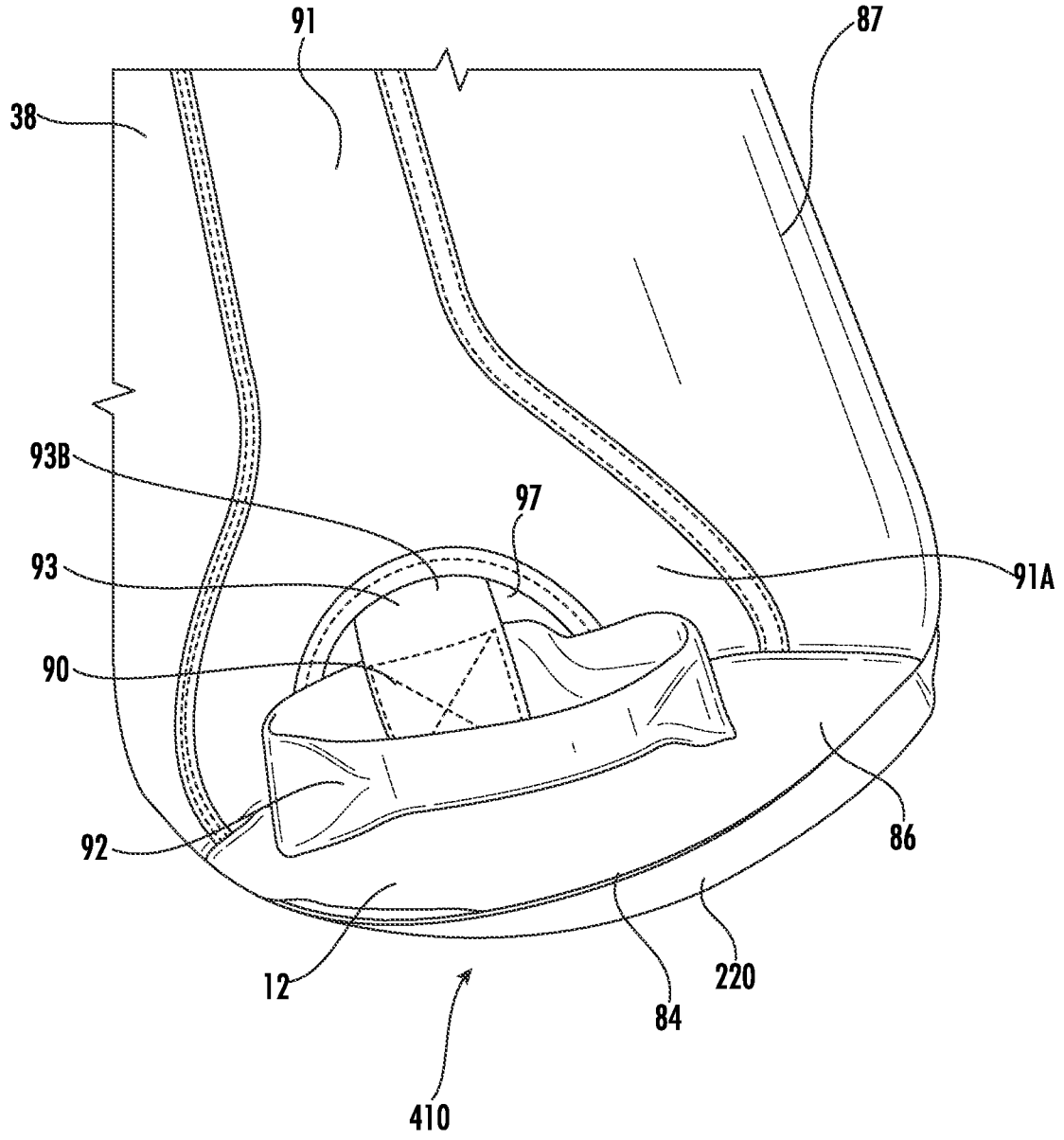
FIG. 19 is a photograph showing another embodiment of a weighted bag according to aspects disclosed herein from the top and front, with a handle of the bag in a retracted position.

The narrower width and the angles C and D in the embodiment of FIGS. 12-18 are created by folding the base 322 over itself toward the nearest end 315 of the shell 12 and connecting the folded portion 333 to the base 322, as shown in FIG. 17. Each base 322 may be formed of an integral or continuous panel or strap having first and second opposed surfaces 331, 332, in one embodiment. In this configuration, the first surface 331 forms the outer surface of the angling portion 329 on the front side 320 of the shell 12 and the inner surface of the angling portion 329 (contacting the shell 12) on the rear side 319 of the shell 12, and the second surface 332 forms the outer surface of the angling portion 329 on the rear side 319 of the shell 12 and the inner surface of the angling portion 329 (contacting the shell 12) on the front side 320 of the shell 12.

The angles A-E described herein provide a more ergonomic and athletically efficient form for the bag, which is designed to be picked up by a user and thrown over his/her back for carrying so that the top 316 rests on the user's neck and shoulders. The angles A-B of the gripping members 323 provide effective and comfortable angles for lifting and carrying, and the angles C-E of the base 322 provide durability and advantageous distribution of forces and stresses on the shell 12 during lifting and carrying. As one particular example, the angle C between the inner edge 328 of the crossing portion 327 and the top 316 of the shell 12 avoids excessive concentration of stresses at the juncture between the base 322 and the top 316 of the shell 12, which can result in separation of the base 322 from the shell 12 and/or ripping of the shell 12 at that location. It is also noted that the position of the rear seam 317 below the lateral centerline L of the shell 12 avoids stress concentrations at the seam 317 by distancing the seam 317 from the handles 321 and also reduces the chance that the user will carry the bag 310 with the seam 317 in contact with his/her neck or shoulders, which could reduce comfort.

The bag 310 may be made using the same materials and techniques described herein with respect to the embodiment of FIGS. 1-8. In particular, the shell 12, the inner bag 135, and the filling mechanism 25 can be assembled in a similar manner as the same components in FIGS. 1-8. Assembly of the bag 310 in FIGS. 12-18 further includes connecting the gripping members 323 to the bases 322 of the handles 321, and then connecting the handles 321 to the top side 316 of the shell 12, using any of the connection structures and techniques described herein, including stitching, adhesives, and heat sealing, among others.

FIGS. 19-25 illustrate another embodiment of a weighted bag 410 that includes many components and features in common with the bag 10 illustrated in FIGS. 1-8 and described herein. Such common features and components are referenced in FIGS. 19-25 with the same reference numbers used herein with respect to FIGS. 1-8, and such common features and components may not be re-described herein in detail with respect to the embodiment of FIGS. 19-25. For example, the bag 410 of FIGS. 19-25 includes a filling mechanism 25 that is the same or similar to the filling mechanism 25 described herein and shown in FIGS. 6-8, in one embodiment. The filling mechanism 25 in this embodiment includes a funnel 27 having all the structural elements described herein with respect to the funnel 27 of FIGS. 6-8 and functioning in the same manner, but may include additional or alternate features as described herein in other embodiments. The bag 410 in FIGS. 19-25 also has an inner bag 135, as shown in FIGS. 6-8 and described herein, which is also not illustrated in FIGS. 19-25. It is understood that the inner bag 135 in the embodiment of FIGS. 19-25 is shaped to be consistent with the shape of the shell 12 of the bag 410.

Figure 22:
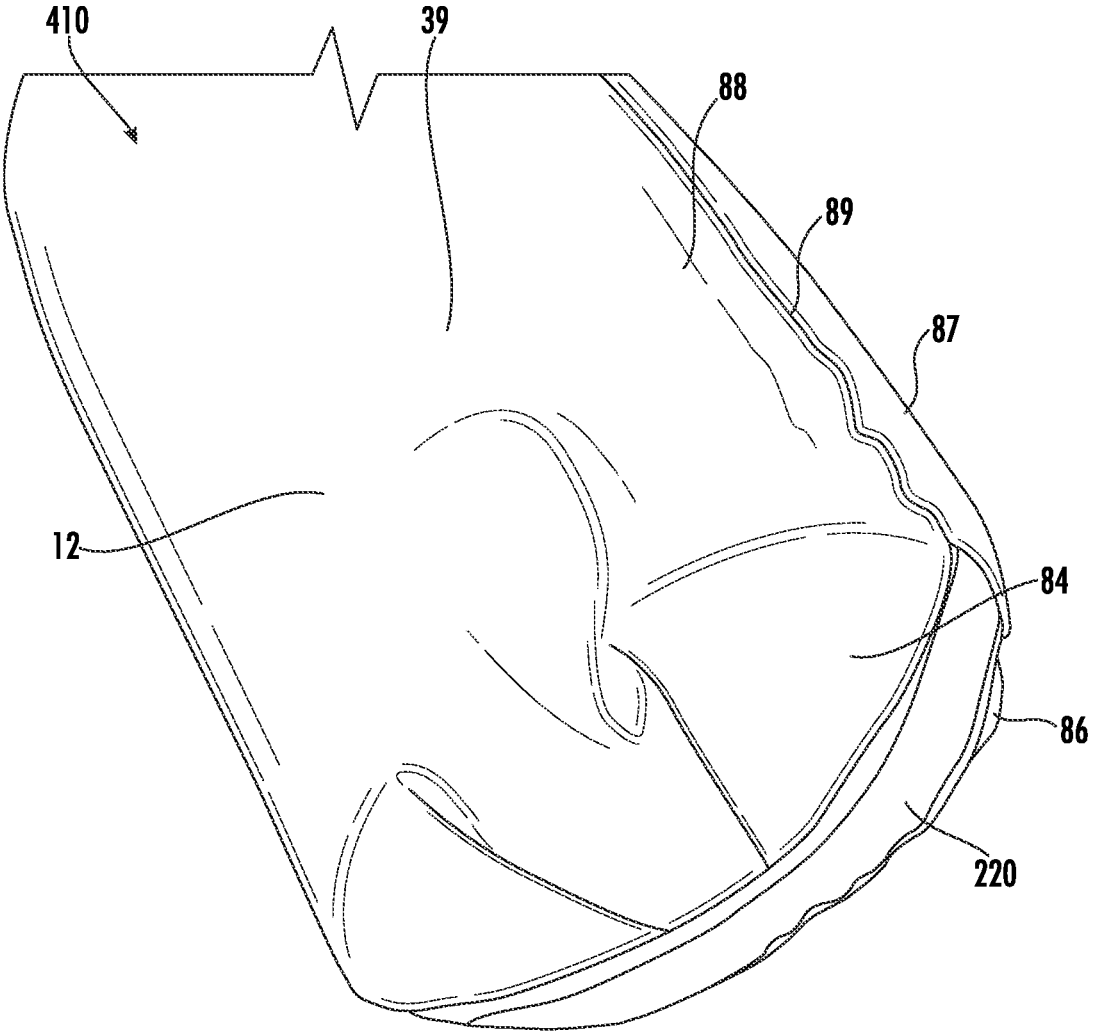
FIG. 22 is a photograph showing the weighted bag of FIG. 19 from the bottom and front.
Figure 23:
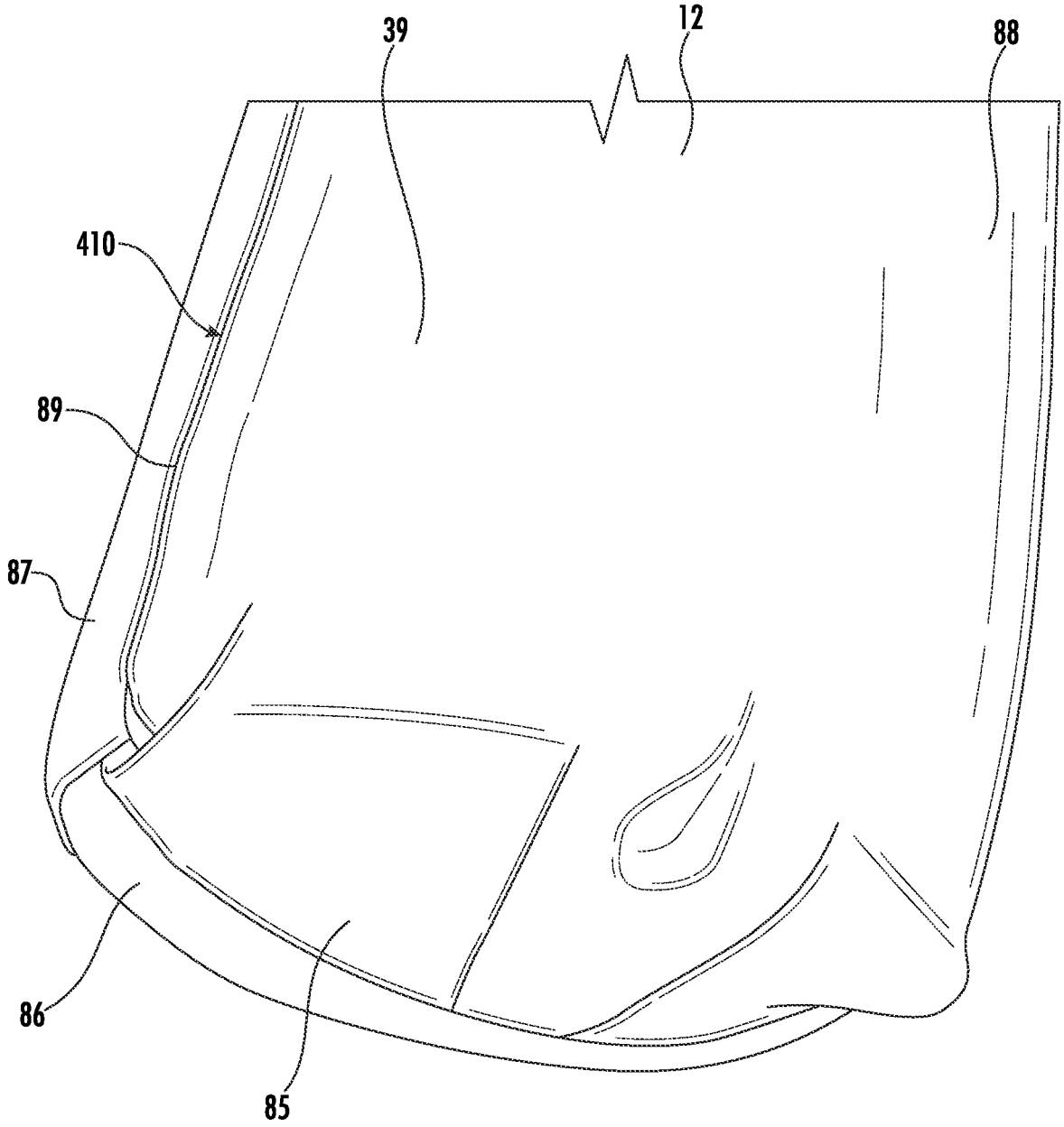
FIG. 23 is a photograph showing the weighted bag of FIG. 19 from the bottom and rear.
Figure 24:
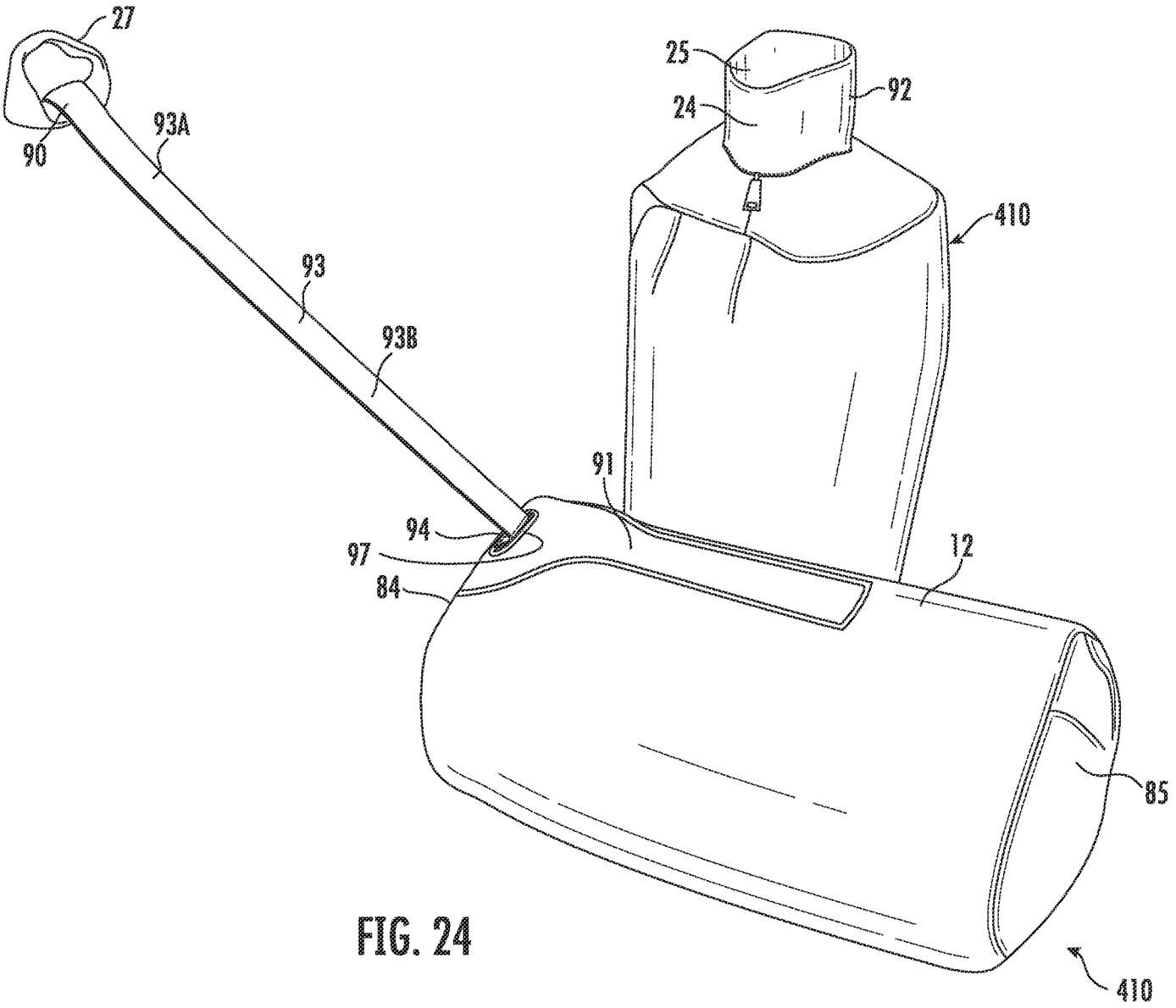
FIG. 24 is a photograph showing the weighted bag of FIG. 19 from the side, with the handle in an extended position and a second weighted bag with a funnel extended out of an opening of the second bag.

The bag 410 of FIGS. 19-25 also has an opening 24 on one end 84 of the shell 12 and a moveable cover 220 that are configured similarly to the opening 24 shown and described herein with respect to the bags 10, 210 of FIGS. 1-11 and the cover 220 of the bag 210 illustrated in FIGS. 9-11 and described herein. Such common features and components are referenced in FIGS. 19-25 with the same reference numbers used herein with respect to FIGS. 1-11, and such common features and components may not be re-described herein in detail with respect to the embodiment of FIGS. 19-25. The bag 410 in FIGS. 19-25 has an opening 24 formed approximately along the centerline of one of the ends 84, 85, which is provided with a closure mechanism 26 in the form of a zipper, as similarly discussed herein with respect to FIGS. 1-11. FIG. 24 shows a second bag 410A that is similar or identical to the bag 410 and has a funnel 27 extending out of the opening 24 in the bag 410. It is understood that the opening 24 and the closure mechanism 26 may have any structure discussed herein with respect to the opening 24 and the closure mechanism 26 of FIGS. 1-11. The opening 24 and the closure mechanism 26 in this embodiment function in the same way as in the bags 10, 210 of FIGS. 1-11, whereby the closure mechanism 26 opens to allow the funnel 27 to be extended for filling the bag 410, and the closure mechanism 26 can be closed after collapsing the funnel 27 to seal the opening 24. The moveable cover 220 in the embodiment of FIGS. 19-25 can be moved to cover or uncover the opening 24. It is understood that the opening 24 is not shown in FIGS. 19-23 and 25 and is covered by the moveable cover 220 in FIGS. 19-21, and it is also understood that the cover 220 may uncover the opening 24 similar to the manner shown in FIG. 10.

The bag 410 of FIGS. 19-25 is configured for carrying by a user and is also configured for dragging by a user along the ground or other surface upon which the bag 410 sits (e.g., grass, rubber, concrete). In one embodiment, the bag 410 has an outer shell 12 including one or more panels 20 that are connected by one or more seams 22 to define an inner cavity 21 configured to hold a filler material 16 and an outer surface 32. The shell 12 has a top 38 and a bottom 39 extending between a front end 84 and a rear end 85, such that the bag 410 generally has an elongated cylindrical shape and is configured to rest on the bottom 39. In one embodiment, the bottom 39 of the bag 410 is completely seamless, and in another embodiment, the bottom 39 of the bag 410 is devoid of any horizontal or circumferential seams (i.e., seams that extend perpendicular or transverse to an axis that extends between the ends 84, 85). In a further embodiment, the bag 410 may have no seams (or no horizontal/circumferential seams) on the bottom of the bag 410 at least at the front end 84 and/or on the front portion (e.g., 50%) of the bag 410.

Figure 20:
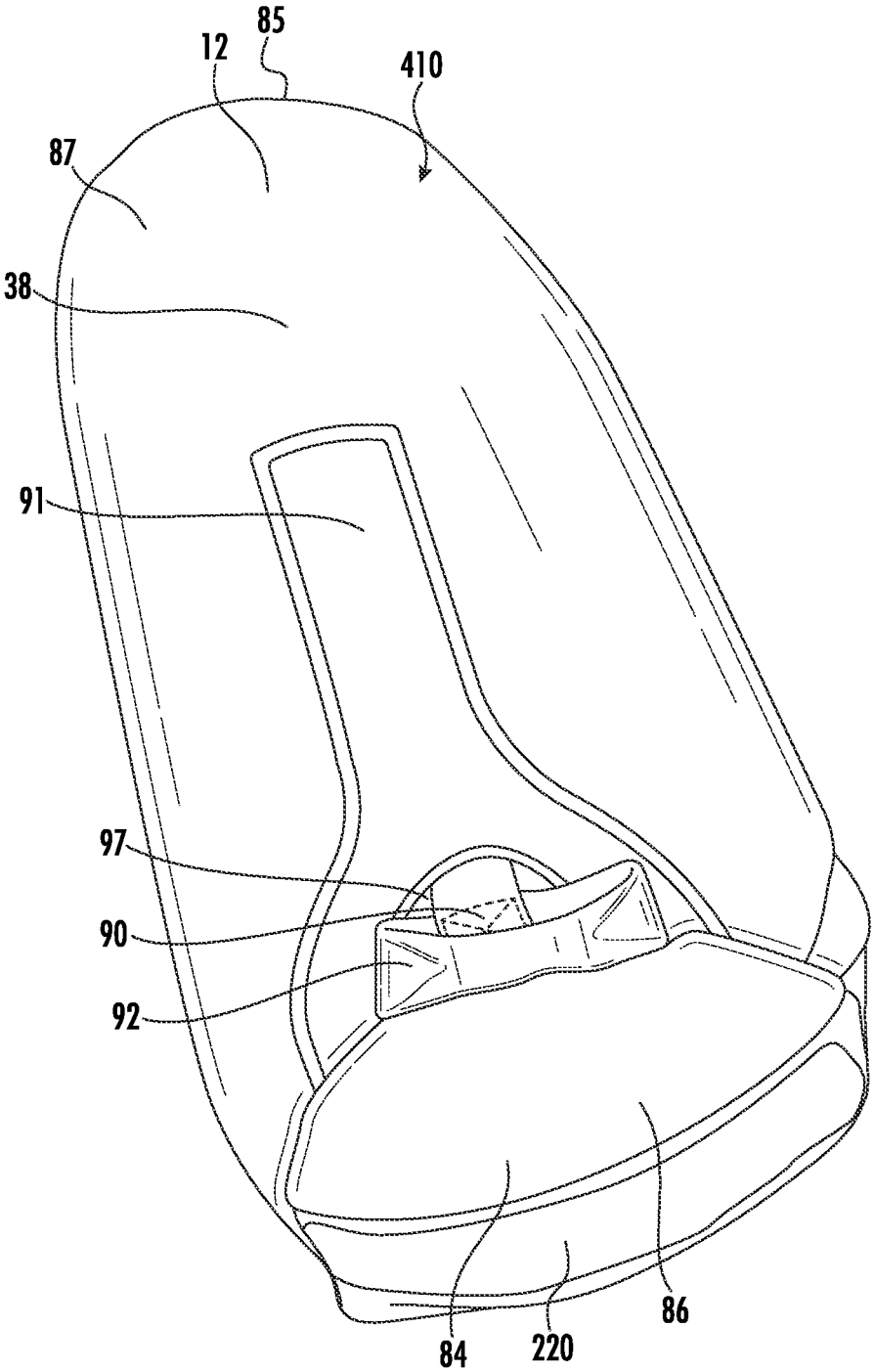
FIG. 20 is a photograph showing the weighted bag of FIG. 19 from the top and front, with the handle in a retracted and stowed position.
Figure 21:
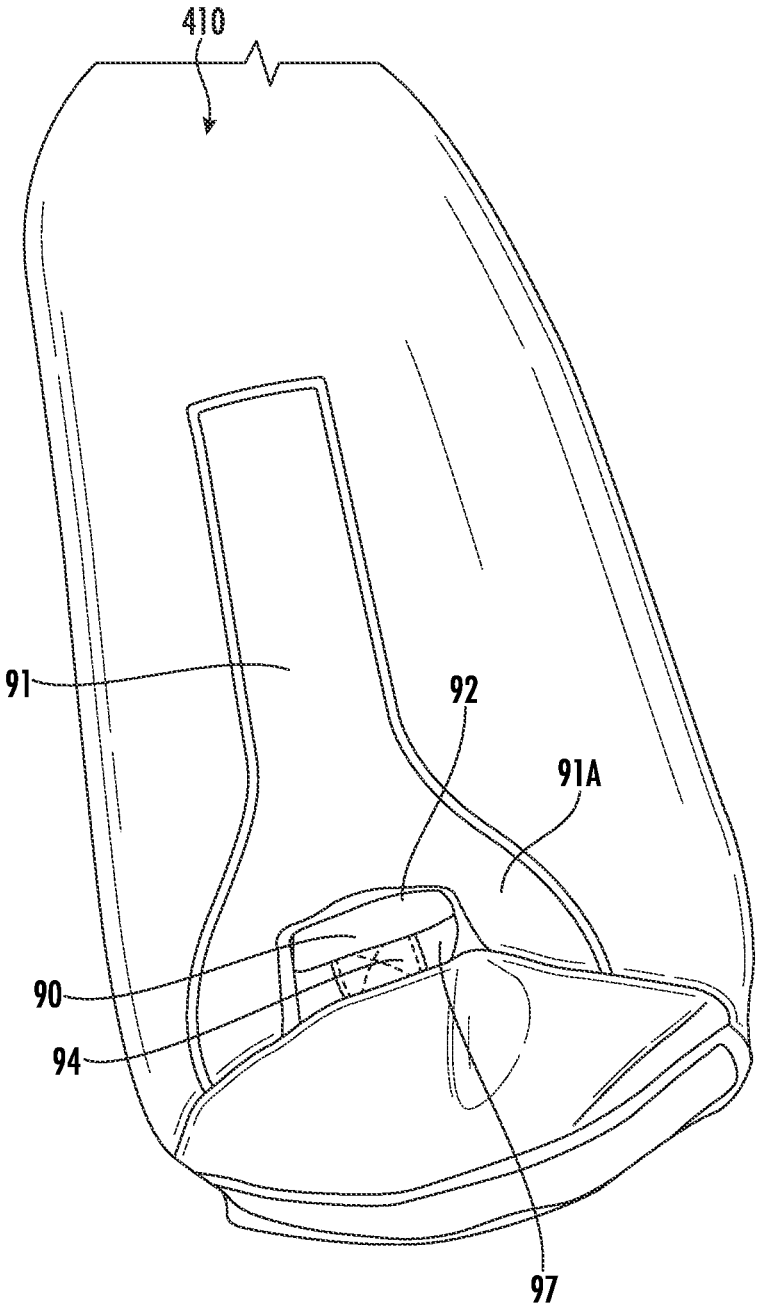
FIG. 21 is a photograph showing a magnified portion of the weighted bag of FIG. 19 from the top and front, with the handle in the retracted position.

With reference to the example embodiment of the outer shell 12 in FIGS. 19-25, the panels 20 include two opposed end panels 86, a top panel 87, and a bottom panel 88. The bottom panel is cup-shaped and forms the entire bottom 39 of the bag 410 and extends upward along the front and rear ends 84, 85 and along the sides of the bag 410, as shown in FIGS. 22 and 23. The top panel 87 is connected to the bottom panel 88 along two axial seams 89 extending along the sides of the bag 410 between the ends 84, 85, and the end panels 86 are connected at the ends 84, 85. In this configuration, the end panels 86 form top portions of the ends 84, 85 of the bag 410, and the bottom panel 88 forms a bottom portion of each of the ends 84, 85. Likewise, the bottom panel 88 forms bottom portions of the sides of the bag 410, and the top panel 87 forms top portions of the sides of the bag 410. In this configuration, there are no horizontal or circumferential seams (and in fact, no seams at all) on the bottom 39 of the bag 410 that contact the ground surface when the bag 410 is filled with the filler material. Seams on the bottom 39 of the bag 410, and horizontal/circumferential seams in particular, may experience increased wear and decreased durability when the bag 410 is dragged repeatedly over the ground. Such seams may increase friction or resistance when dragging the bag 410 as well. The construction of the bag 410 without such seams assists in avoiding these issues.

The shell 12 in the embodiment of FIGS. 19-25 is entirely or substantially defined by the end panels 86, the top panel 87, and the bottom panel 88. In this embodiment, the shell 12 defines a cylindrical configuration, having a circular cylindrical portion or central body portion 54 formed by the top and bottom panels 87, 88 and circular flat or bulged ends 84, 85 formed by the end panels 86 and the bottom panel 88. In other embodiments, the shell 12 may have a different shape, such as an oval cylinder, a cube, a rectangular cylinder, a triangular cylinder, etc. It is understood that the cylindrical portion 54 may simply be referred to as a "central body portion" when describing a shell 12 having a cylindrical shape or any other shape. Likewise, the relative sizes and shapes of the end panels 86, the top panel 87, and the bottom panel 88 may be different in other embodiments, and the cylindrical portion 54 and/or the ends 84, 85 may be formed of a greater of smaller number of panels in other embodiments. In general, the cylindrical portion 54 and the ends 84, 85 may each be formed by one or more panels 22.

It is to be understood the panels 20 may be defined by one or more surfacing layers that may be of substantially equal or variable materials. Generally, these are two or greater ply configuration coupled together. In the configuration shown, the panels are shown as singular pieces with the understanding that they may represent multiple plies of material. In one embodiment, the end panels 86 and the top panel 87 are formed from a two-ply construction, and the bottom panel 88 is formed of a three-ply construction. For example, the end panels 86 and the top panel 87 may be formed of a double layer of nylon (e.g., Cordura) fabric, and the bottom panel 88 may be formed of two inner layers of nylon (e.g., Cordura) fabric, with an outer layer of ballistic nylon. Such fabrics may be 500 denier or 1000 denier. Other configurations are contemplated.

The bag 410 in FIGS. 19-25 has an extendible handle 90 that is configured to extend and retract between an extended position (shown in FIG. 24) and a retracted position (shown in FIGS. 19-21 and 25). In one embodiment, the bag 410 has a storage compartment 91 configured to hold the handle 90 in the retracted position, such that the handle 90 is retracted within the storage compartment 91 and the storage compartment 91 forms a sheath around the handle 90. The handle 90 in the embodiment of FIGS. 19-25 includes a grip 92 configured for grasping or otherwise engaging by the user and a tether 93 connecting the grip 92 to the bag 410. The tether 93 in FIGS. 19-25 has a fixed end connected to the bag 410 (e.g., to the outer shell 12) at a connection point 94, with the grip 92 connected to the other end of the tether 93 opposite the fixed end, such that the tether 93 extends between the bag 410 and the grip 92. The user can drag the bag 410 by grasping the grip 92 and pulling the handle 90.

The tether 93 in the embodiment of FIGS. 19-25 has a flexible portion 93A that extends over a portion of the length of the tether 93 and a reinforced or rigid portion 93B that extends over another portion of the length of the tether 93 and has a stiffness that is greater than that of the flexible portion 93A. It is understood that the tether 93 may have multiple flexible portions 93A and/or rigid portions 93B. In one embodiment, the rigid portion 93B has sufficient rigidity to maintain its shape under normal axial compressive forces. The flexible portion 93A in the embodiment of FIGS. 19-25 extends from the connection point 94 over a portion of the length of the tether 93 to the end of the rigid portion 93B, and the rigid portion 93B extends from the end of the flexible portion 93B to the grip 92. The flexible portion 93A and the rigid portion 93B may have equal or substantially equal lengths (e.g., within 5% of the total length of the tether 93) in one embodiment.

The tether 93 may be formed at least partially of nylon or other flexible, high-strength fabric, and the rigid portion 93B may be formed by connecting one or more reinforcing members 95 to the tether 93. In the embodiment of FIGS. 19-25, the rigid portion 93B of the tether is formed by inserting a rigid reinforcing member 95 (e.g., metal sheet or high strength plastic/composite) into a pocket 96 formed between two layers of the material forming the tether 93. In other embodiments, the flexible portion 93A and/or the rigid portion 93B of the tether 93 may be differently configured.

The storage compartment 91 in the embodiment of FIGS. 19-25 is connected to the top 38 of the bag 410 and has an opening 97 positioned at or near the front end 84 of the bag 410. In this embodiment, the storage compartment 91 extends from the opening 97 axially (toward the rear end 85) along the top of the bag 410. The compartment 91 may be formed by connecting an additional panel of fabric material to the outer shell 12 of the bag 410 or by forming an opening between two layers of fabric material of the outer shell 12, and the boundaries of the compartment 91 may be formed by stitching, adhesive, heat sealing, and/or other connection techniques described herein.

Figure 25:
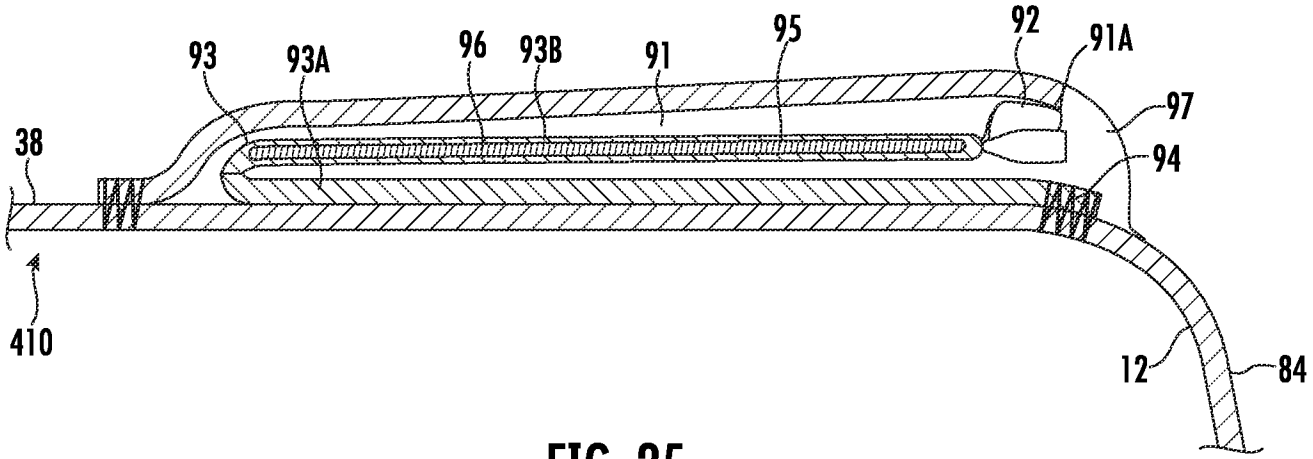
FIG. 25 is a cross-sectional view of a portion of the weighted bag of FIG. 19 with the handle in the retracted and stowed position.

The handle 90 can be retracted into the compartment 91 by exerting axial force on the rigid portion 93B of the tether 93 to push the tether 93 into the compartment 91 through the opening 97. The rigidity of the rigid portion 93B is sufficient to allow the tether 93 to be pushed into the compartment 91, pulling the flexible portion 93A into the compartment 91 as well. FIGS. 19-21 and 25 illustrate the handle 90 in the retracted position, where the tether 93 is substantially or entirely positioned within the compartment 91. The grip 92 is positioned proximate the opening 97 in the retracted position, and the handle 90 can be moved to the extended position by simply pulling on the grip 92 until the handle 90 is fully extended and the tether 93 is taut, as shown in FIG. 24. Additionally, the compartment 91 in FIGS. 19-25 has an enlarged cavity or flared portion 91A near the opening 97, such that the grip 92 can be tucked into the storage compartment 91 to avoid interference during other weightlifting exercises involving the bag 410, such as lifting, carrying, and dropping. When the grip 92 is inserted within the enlarged cavity 91A of the compartment 91, the handle 90 may be considered to be in a retracted and stowed configuration, which is shown in FIGS. 20-21 and 25. A portion of the grip 92 is still exposed and/or accessible within the opening 97 for pulling the handle 90 to the extended position. It is understood that if the connection point 94 is positioned farther within the compartment 91 or farther outside the opening 97, the relative lengths of the flexible and rigid portions 93A, 93B of the tether 93 may need to be altered.

The bag 410 may be made using the same materials and techniques described herein with respect to the embodiment of FIGS. 1-11. In particular, the shell 12, the inner bag 135, and the filling mechanism 25 can be assembled in a similar manner as the same components in FIGS. 1-11. Assembly of the bag 410 in FIGS. 19-25 further includes connecting the reinforcing member(s) 95 to the handle 90, connecting the handle 90 to the bag 410 (e.g., to the outer shell 12), and forming the compartment 91, e.g., by connecting an additional panel 20 to the outer shell 12 or forming a pocket between existing layers of fabric, using any of the connection structures and techniques described herein, including stitching, adhesives, and heat sealing, among others.

Figure 26:
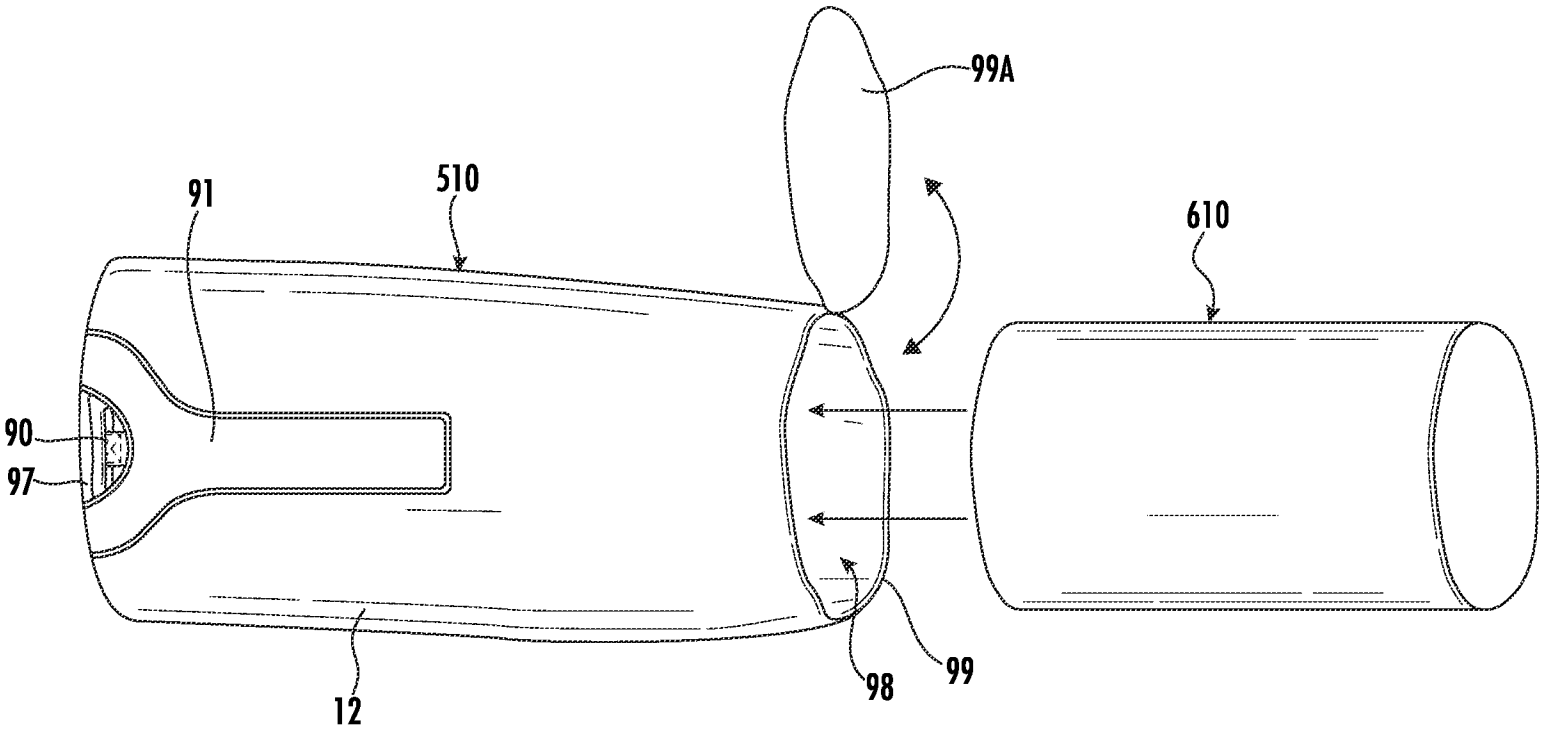
FIG. 26 is a top view of an embodiment of a shell for a weighted bag according to aspects disclosed herein, showing insertion of the weighted bag into the shell.
Figure 27:
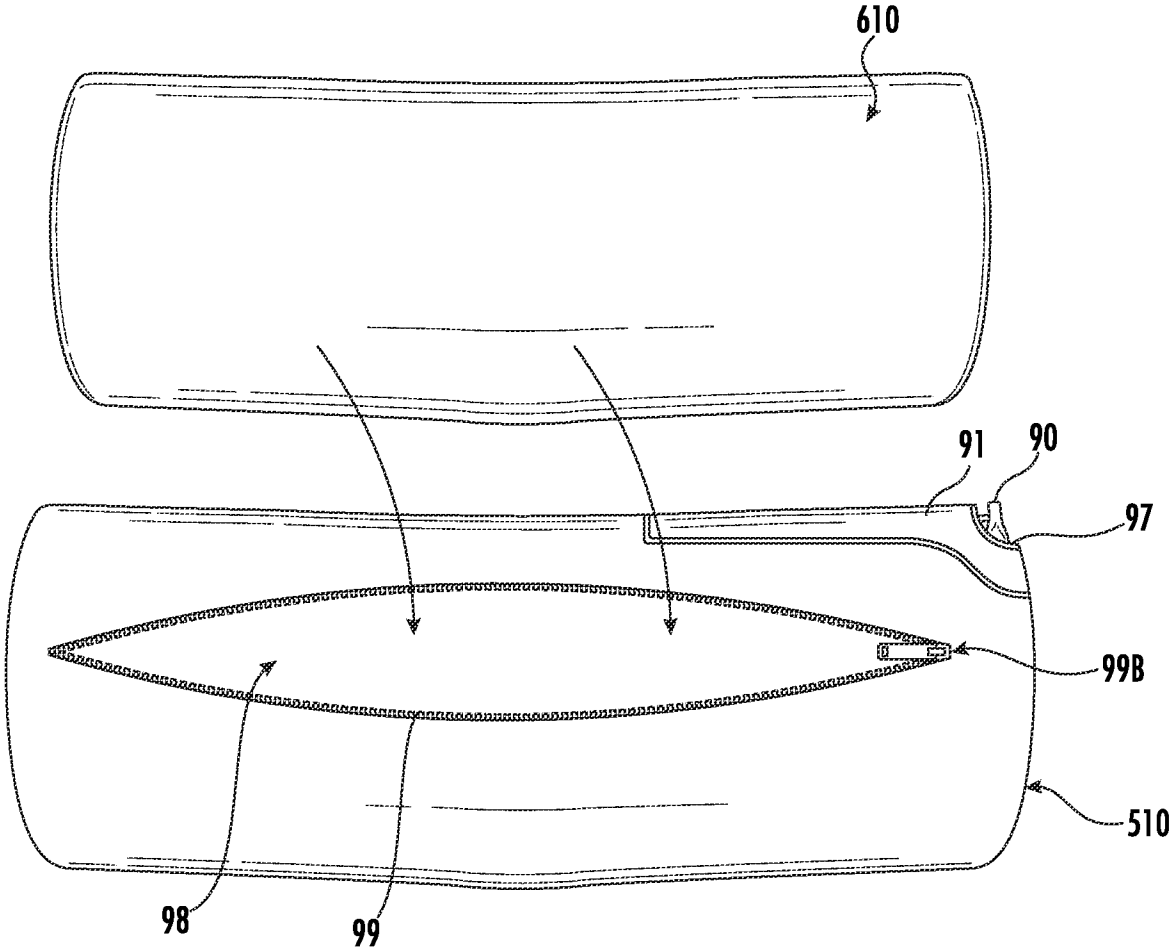
FIG. 27 is a side view of another embodiment of a shell for a weighted bag according to aspects disclosed herein, showing insertion of the weighted bag into the shell.

FIGS. 26 and 27 illustrate embodiments of a shell 510 configured to hold one or more weighted articles, e.g., a sandbag or other weighted bag 610 configured to be filled with a filler material, including any of the weighted bags 10, 210, 310, 410 shown and described herein. The shell 510 in FIGS. 26 and 27 is generally configured similarly to the bag 410 in FIGS. 19-25, without the components designed for filling the bag 410 with the filler material, such as the filling mechanism 25, the opening 24, and the inner bag 135. Accordingly, the shell 510 has an outer shell 12 that is similar or identical to the outer shell 12 of the bag 410 in FIGS. 19-25, including a top panel 87, a bottom panel 88, and two end panels 86. These panels 86, 87, 88 are not illustrated in FIGS. 26 and 27, although it is understood that they may be connected and configured in the same manner shown and described in FIGS. 19-25, or that the outer shell 12 may be configured in any alternate configuration described herein. In this configuration, the shell 510 may have no horizontal or circumferential seams (or no seams at all) on the bottom 39 of the bag 410, as similarly described herein. The shell 510 also has a handle 90 and a compartment 91 that are configured similarly to the handle 90 and compartment 91 shown and described herein with respect to FIGS. 19-25, including any variations thereof.

The shells 510 in FIGS. 26 and 27 each define a cavity 98 configured to receive one or more weighted articles, e.g., a weighted bag 610, therein, with a reclosable opening 99 configured for insertion and removal of the weighted article(s) therethrough. The opening 99 may be provided with a closure, such as a flap 99A as shown in FIG. 26 or a zipper 99B as shown in FIG. 27. The shell 510 in FIG. 26 has a flap 99A at the rear end 85 of the shell 510 that opens in a hinged configuration, and it is understood that the flap 99A may be releasably secured in a closed position by use of a connecting structure such as hook-and-loop, straps, etc. The shell 510 in FIG. 27 has a zipper 99B that extends axially along a side of the shell 510, and it is understood that the shell 510 may further include a cover for the zipper 99B similar to the cover 220 in FIGS. 9-11. The opening 99 may be located and configured differently in other embodiments. For example, the zipper 99B may be located on one of the ends 84, 85 in another embodiment. The shell 510 may be configured so that the opening 99 is not located on the bottom 39 of the shell 510 in certain embodiments. The shells 510 in FIGS. 26-27 allow existing weighted bags 610 and/or other weighed articles to be converted into bags that are configured for dragging as described herein with respect to the bag 410 of FIGS. 19-25.

FIGS. 28-48 illustrate an embodiments of a shell assembly 710 configured to hold one or more weighted articles to form a weighted bag, such as one or more sandbags or other weighted bag(s) 610 configured to be filled with a filler material, including any of the weighted bags 10, 210, 310, 410 shown and described herein. The shell assembly 710 in FIGS. 18-48 may alternately be configured to hold a particulate filler material and may include some components similar to the bag 410 in FIGS. 19-25 for this purpose, such as the filling mechanism 25, the opening 24, and the inner bag 135. The shell assembly 710 has an outer shell 12 that includes some components that are similar to the outer shell 12 of the bag 410 in FIGS. 19-25, including a top panel 87, a bottom panel 88, and two end panels 86. The outer shell 12 may be configured in another configuration in other embodiments, including any other configuration described herein. The shell assembly 710 in FIGS. 28-48 allows existing weighted bags 610 and/or other weighed articles to be used for a variety of purposes for which they may not be specifically designed, such as backpack carrying, shoulder carrying, dragging, and other carrying techniques. The structures enabling these configurations are discussed in greater detail herein.

Figure 28:
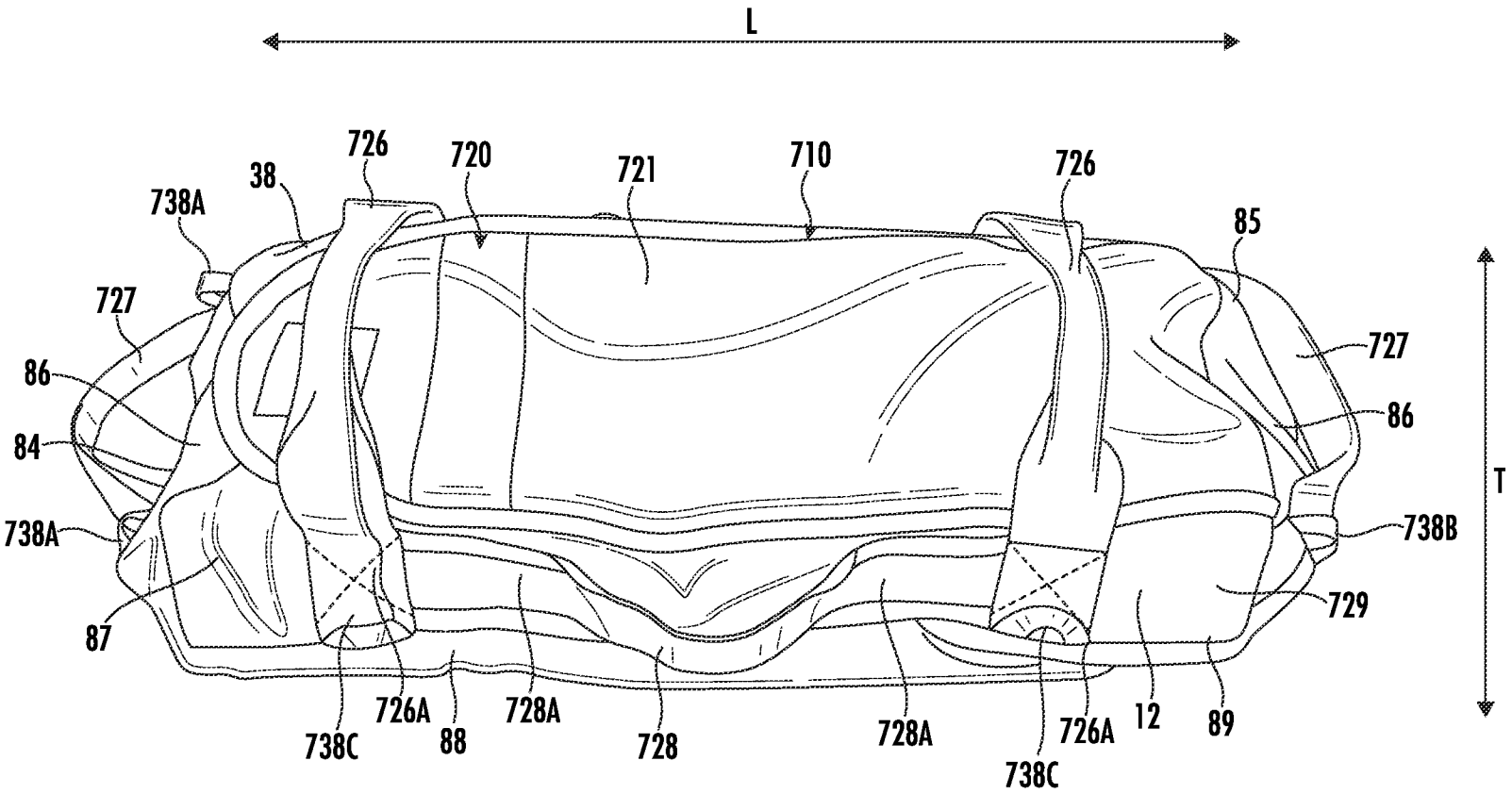
FIG. 28 is a top view photograph of another embodiment of a shell for a weighted bag according to aspects disclosed herein.

In the embodiment shown in FIGS. 28-48, the outer shell 12 is elongated in shape along a longitudinal direction L (See FIG. 28), such that the top 38, the bottom 39, and the sides 729 of the outer shell 12 have greater lengths along the longitudinal direction than the widths of the top 38, the bottom 39, and the ends 84, 85 along the lateral or transverse direction T (See FIG. 28). In other embodiments, the outer shell 12 may have a different shape or configuration, including symmetrical and/or non-elongated shapes or configurations.

Figure 40:
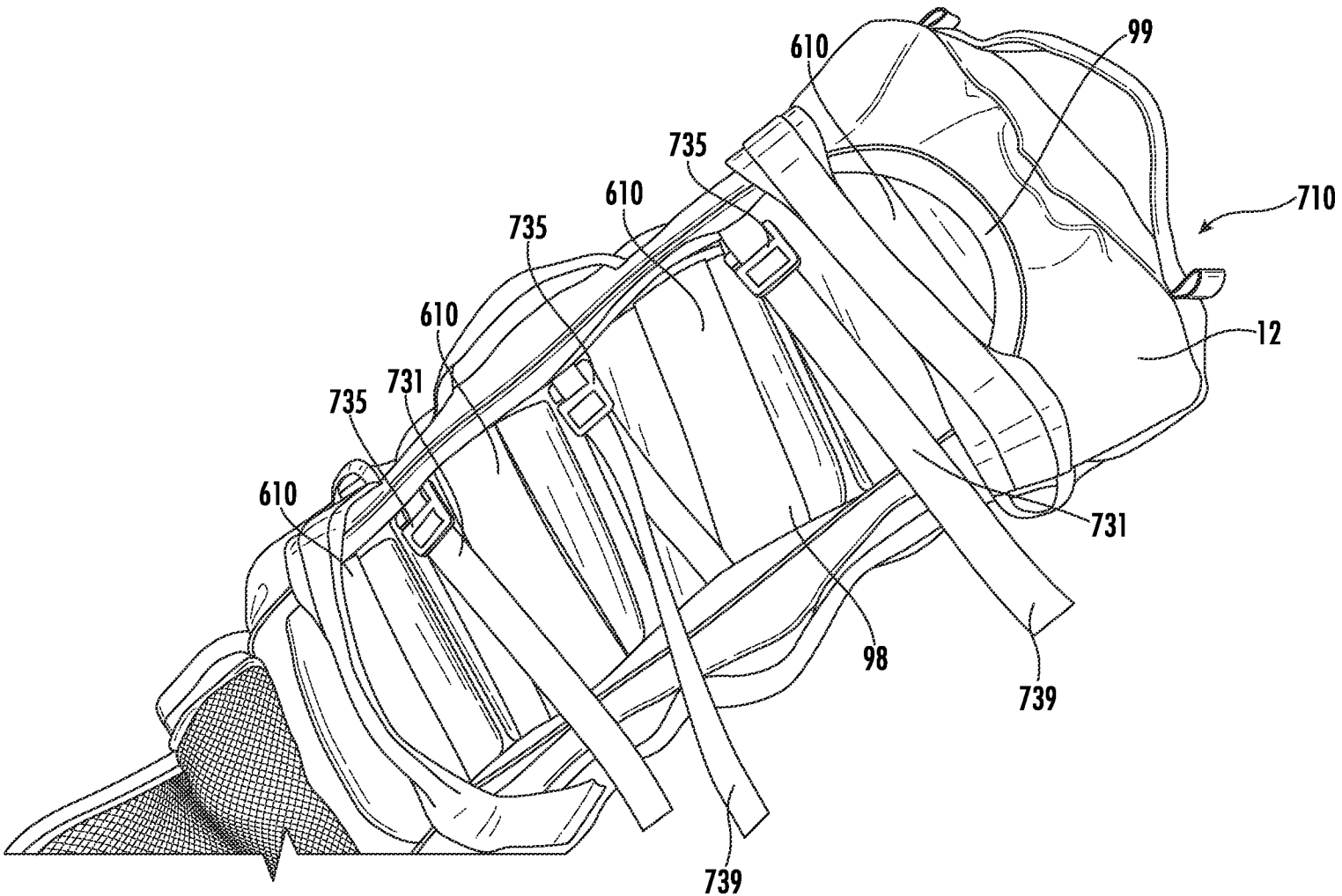
FIG. 40 is a top perspective view photograph of an alternate configuration of the shell of FIG. 28 with the closure in the open position and a plurality of weighted bags received within the shell.
Figure 41:
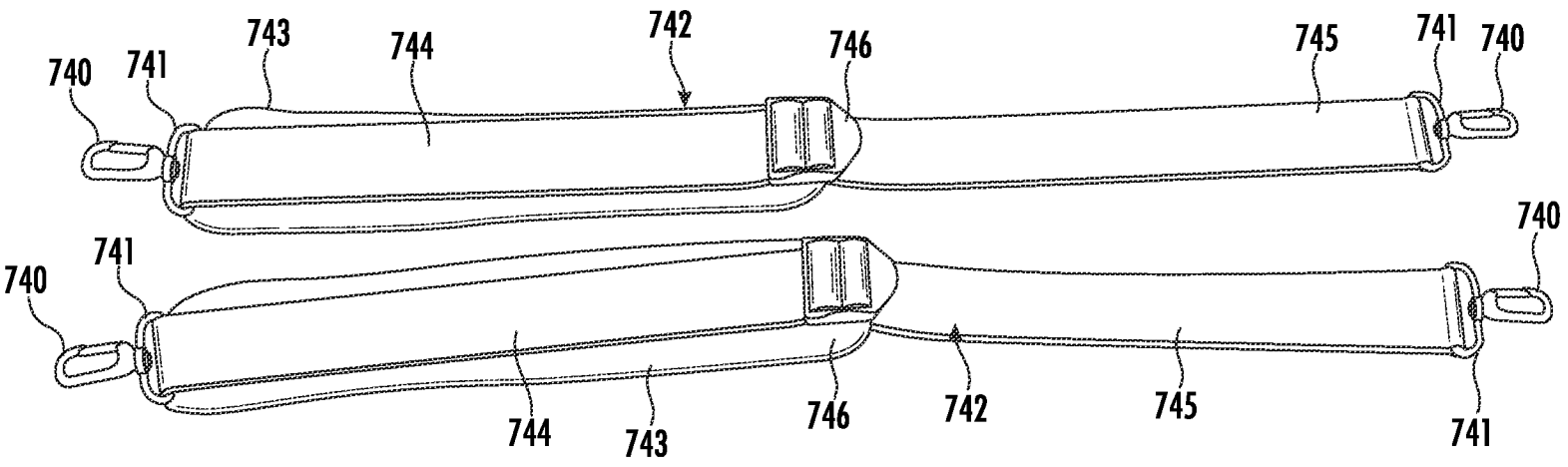
FIG. 41 is a top view photograph of a pair of shoulder straps configured for use with the shell of FIG. 28 according to aspects disclosed herein.
Figure 42:
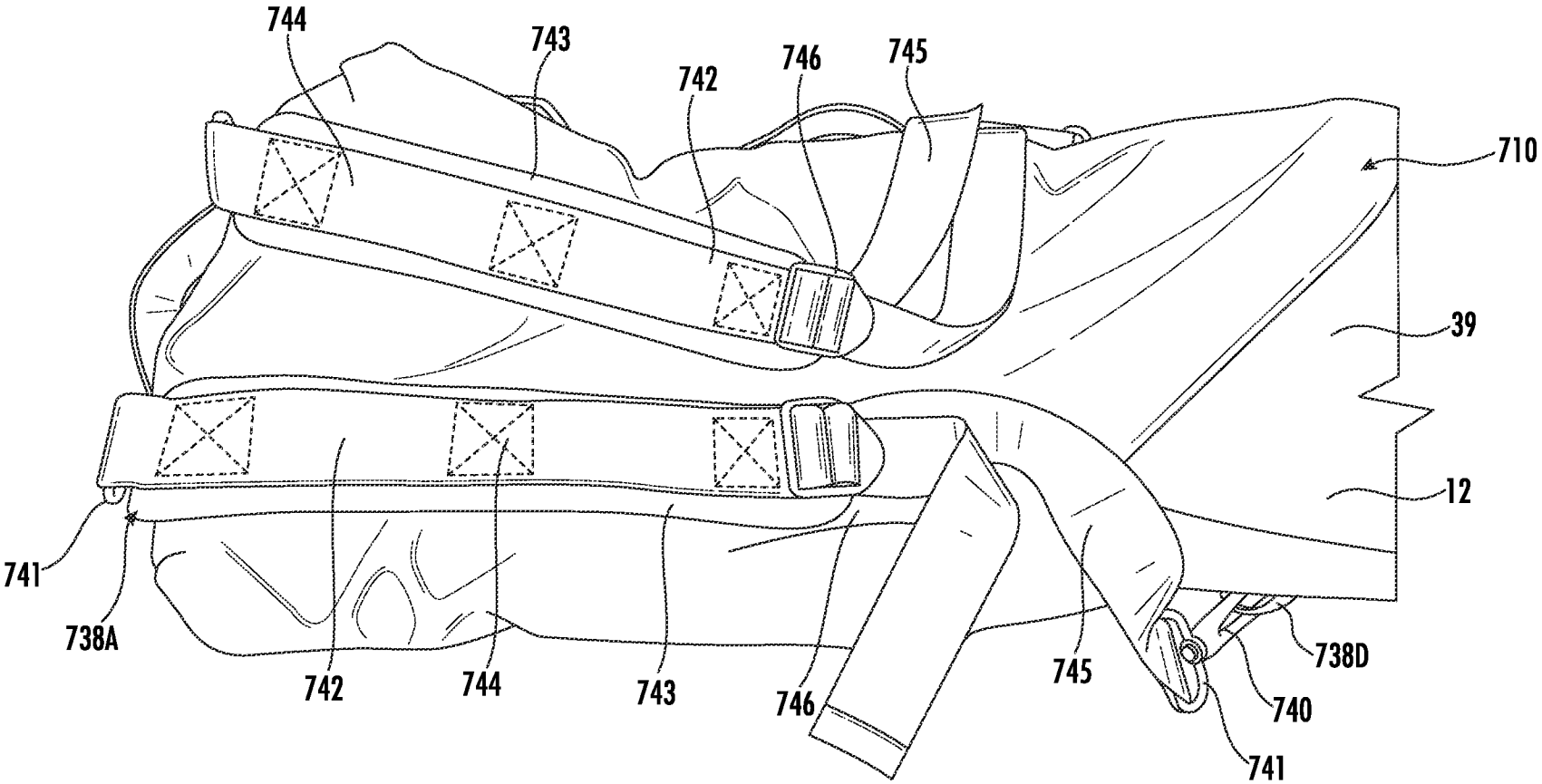
FIG. 42 is a bottom view photograph of the shell of FIG. 28 with the shoulder straps of FIG. 41 connected thereto.
Figure 43:
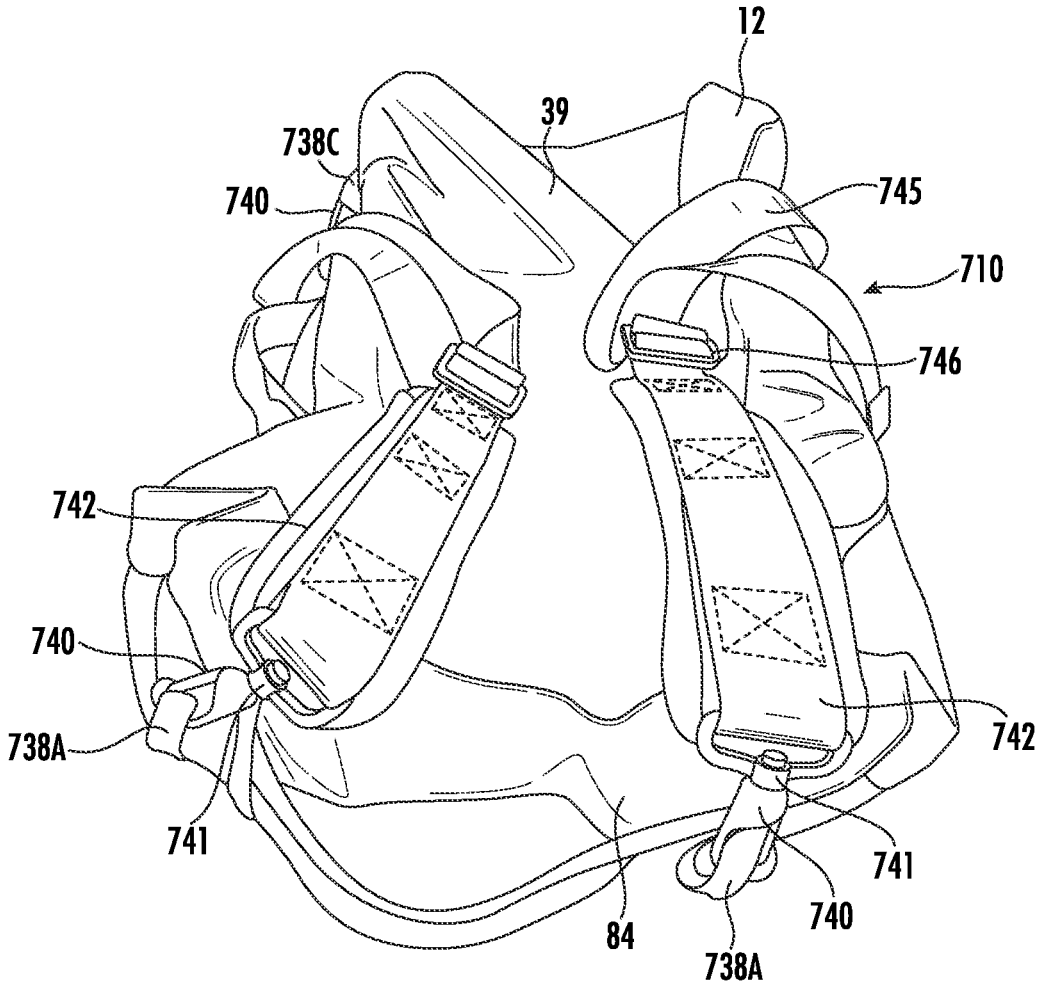
FIG. 43 is a bottom perspective view photograph of the shell of FIG. 28 with the shoulder straps of FIG. 41 connected thereto.

The shell assembly 710 in FIGS. 28-48 has no seams on the bottom 39 of the outer shell 12 that contacts the ground surface in one contemplated usage, with a bottom panel 88 that is cup-shaped and forms the entire bottom 39 of the shell assembly 710 and extends upward along the front and rear ends 84, 85 and along the sides 729 of the shell assembly 710, as shown in FIGS. 28-32. The top panel 87 is connected to the bottom panel 88 along two axial seams 89 extending along the sides of the shell assembly 710 between the ends 84, 85, and the end panels 86 are connected to the top and bottom panels 87, 88 at the ends 84, 85. In this configuration, the end panels 86 form top portions of the ends 84, 85 of the shell assembly 710, and the bottom panel 88 forms a bottom portion of each of the ends 84, 85. Likewise, the bottom panel 88 forms bottom portions of the sides 729 of the shell assembly 710, and the top panel 87 forms top portions of the sides 729 of the shell assembly 710. In another embodiment, the bottom 39 of the shell assembly 710 may at least have no horizontal (i.e., lateral) or circumferential seams that contact the ground surface when the shell assembly 710 is weighted, e.g., at least partially filled with one or more weighted bags 610 and/or the filler material. This construction without seams, or at least without lateral or circumferential seams, on the bottom 39 of the shell assembly 710 may provide benefits similar to those discussed elsewhere herein, e.g., increasing durability and decreasing friction during dragging. This configuration may also provide greater comfort when the shell assembly 710 is worn in a backpack configuration, such as shown in FIGS. 41-43. Additionally, the shell assembly 710 may be configured such that the bottom 39 has a more durable material (e.g., abrasion resistant) construction, such as through a greater number of layers and/or more durable materials. For example, in one embodiment, the end panels 86 and the top panel 87 may be formed of a double layer of nylon (e.g., Cordura) fabric, and the bottom panel 88 may be formed of two inner layers of nylon (e.g., Cordura) fabric, with an outer layer of ballistic nylon. Such fabrics may be 500 denier or 1000 denier.

The shell assembly 710 in FIGS. 28-48 defines a cavity 98 configured to receive one or more weighted articles therein, such as one or more weighted bags 610, with a reclosable opening 99 configured for insertion and removal of the bag(s) 610 therethrough. The opening 99 may be provided with a closure 720 for opening and closing the opening 99, which can be moved or otherwise adjusted between an open position and a closed position. In the embodiment of FIGS. 28-48, the closure 720 includes a flap 721 that is fixedly connected to the top panel 87 of the outer shell 12 at one end of the opening 99, with a zipper 722 that extends around the remainders of the peripheries of the opening 99 and the flap 721 to releasably connect the flap 721 to the outer shell 12 around the opening 99. In this configuration, the flap 721 is connected to the outer shell 12 proximate one end 85 of the shell assembly 710 and opens similar to a hinge configuration. The zipper 722 releasably secures the flap 721 in the closed position, e.g., as shown in FIGS. 28-31, and can be unzipped to release the flap 721 and allow the flap 721 to be moved to the open position, e.g., as shown in FIGS. 33-40. In other embodiments, the flap 721 may be releasably secured in the closed position by use of a different connecting structure such as hook-and-loop, straps, etc. In a further embodiment, a different type of closure 720 may be used, such as a zipper that may or may not be covered by a flap, such as shown in FIGS. 1, 5-10, 14, and/or 27.

Figure 33:
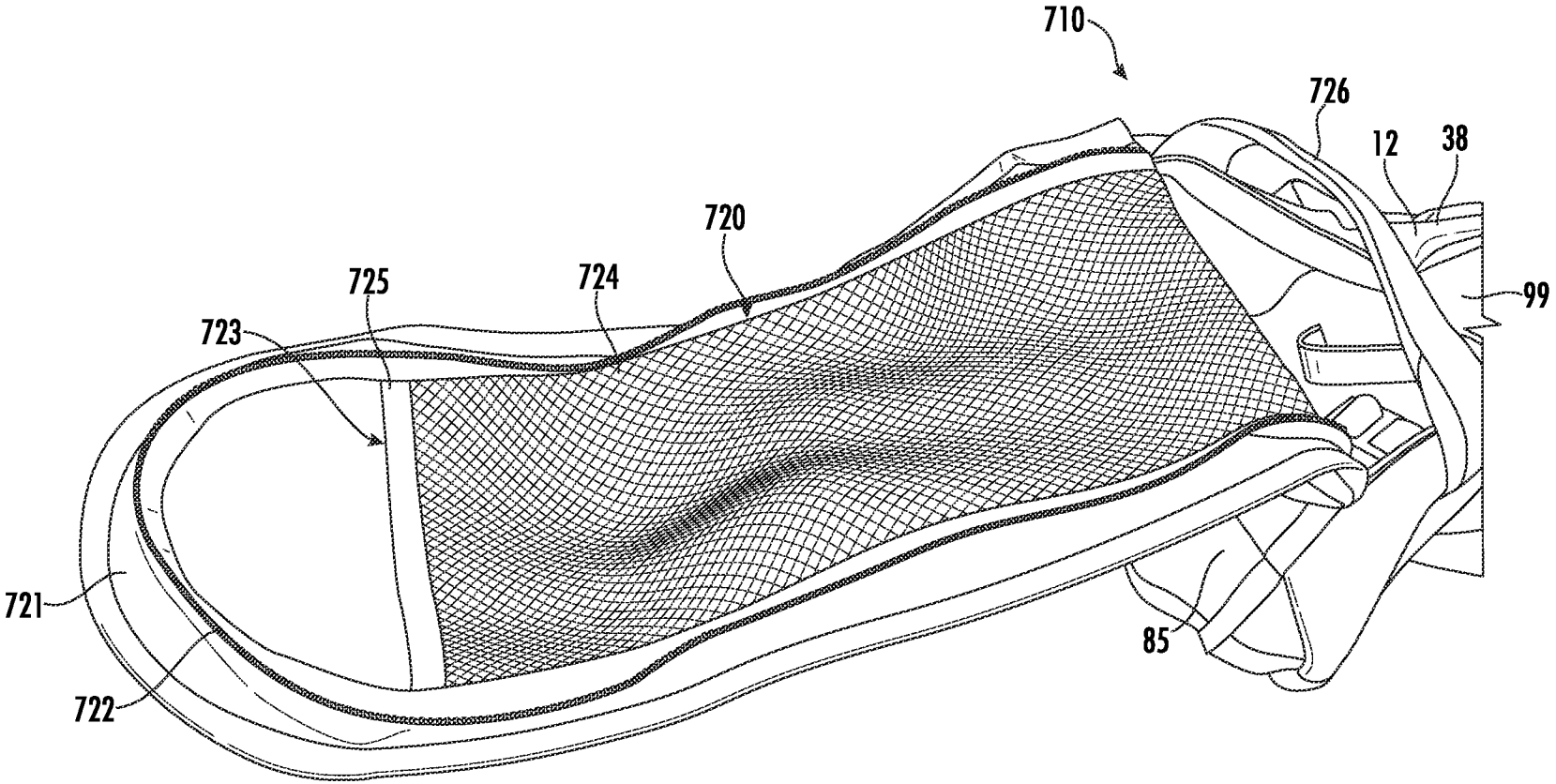
FIG. 33 is a top perspective view photograph of a portion of the shell of FIG. 28 showing a flap closure in an open position.
Figure 34:
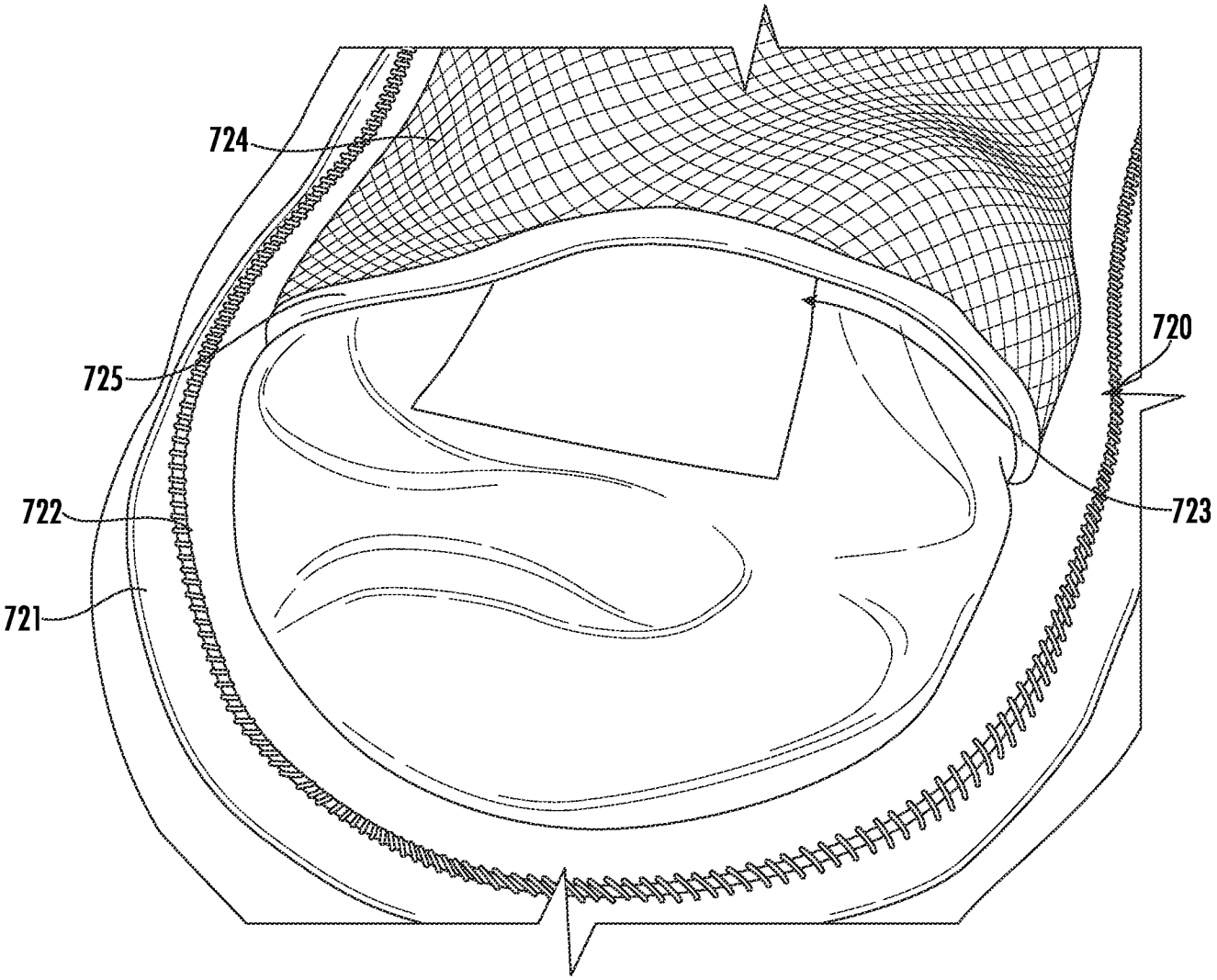
FIG. 34 is a top perspective view photograph of a portion of the flap of FIG. 33.

The flap 721 in the embodiment of FIGS. 28-48 has a pocket 723 on the inner surface, which may be used to hold articles such as components of the shell assembly 710 that are not in use, e.g., removable straps 742, 748, 750, clip 751, and/or other articles. The pocket 723 is best illustrated in FIGS. 33-34 and, in this embodiment, is formed by a piece of netting 724 with an elastic, open, reclosable end 725 that may include hook-and-loop structures or other releasable closure structures.

Figure 29:
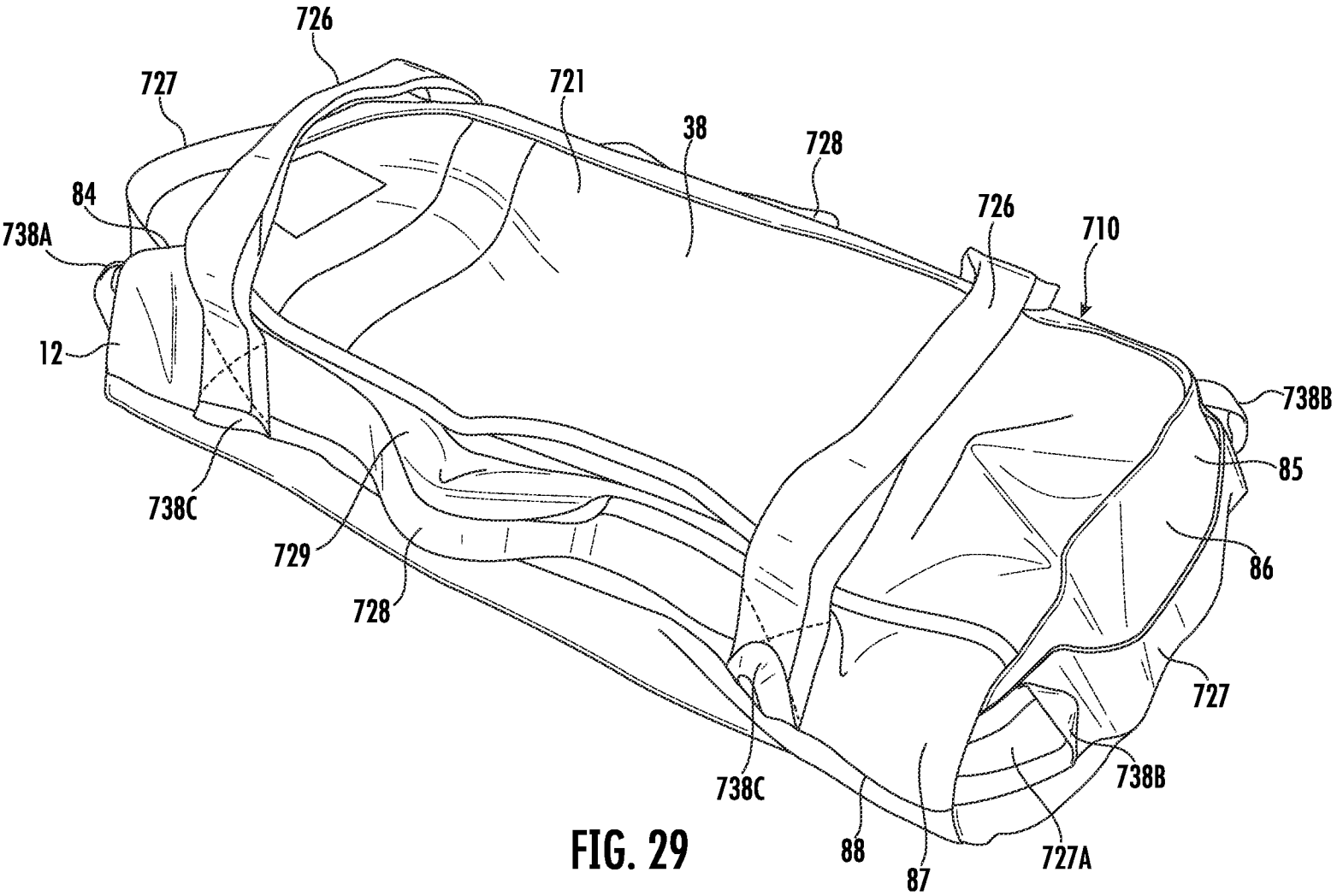
FIG. 29 is a top perspective view photograph of the shell of FIG. 28.
Figure 30:
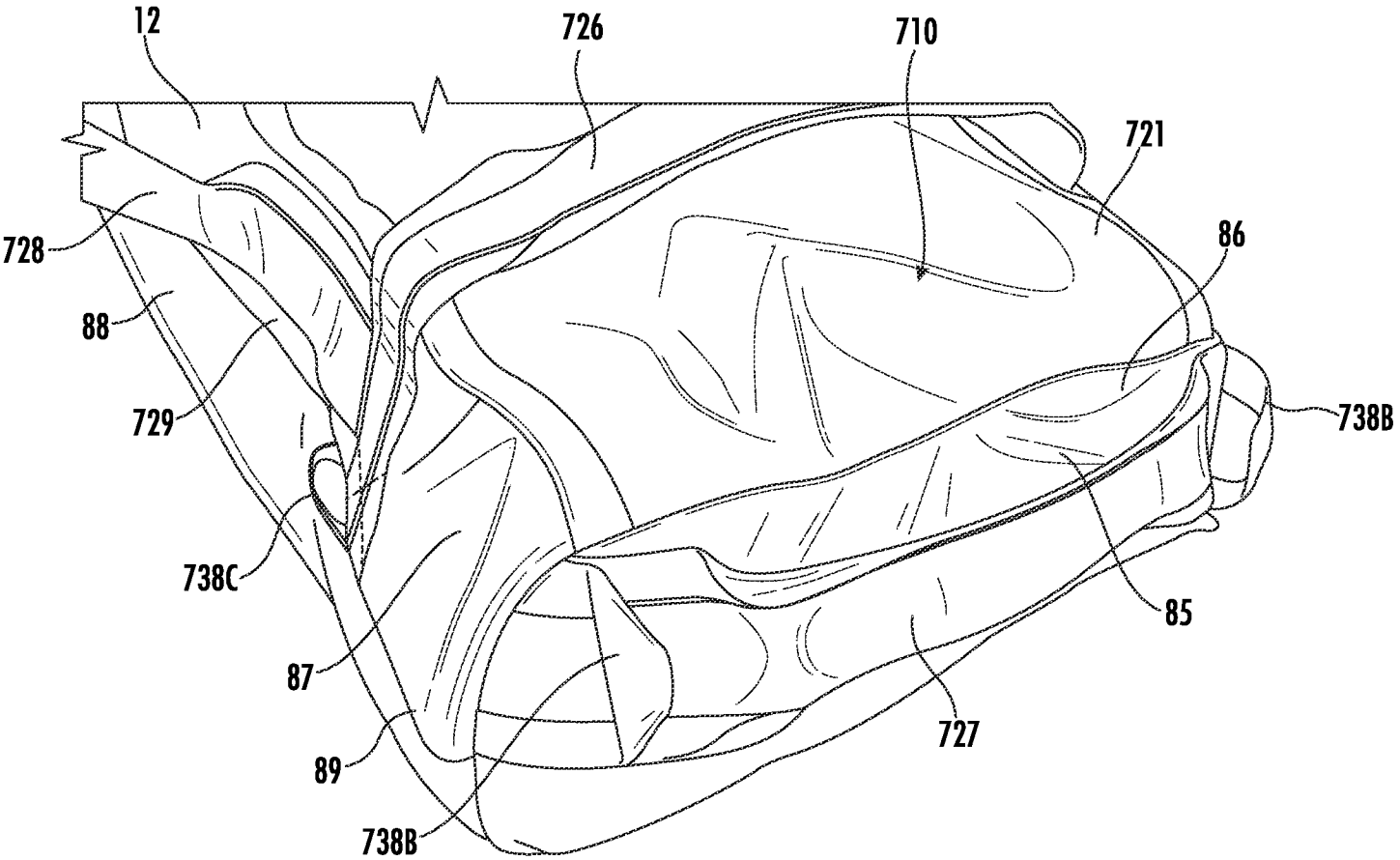
FIG. 30 is a top perspective view photograph of a portion of the shell of FIG. 28.
Figure 31:
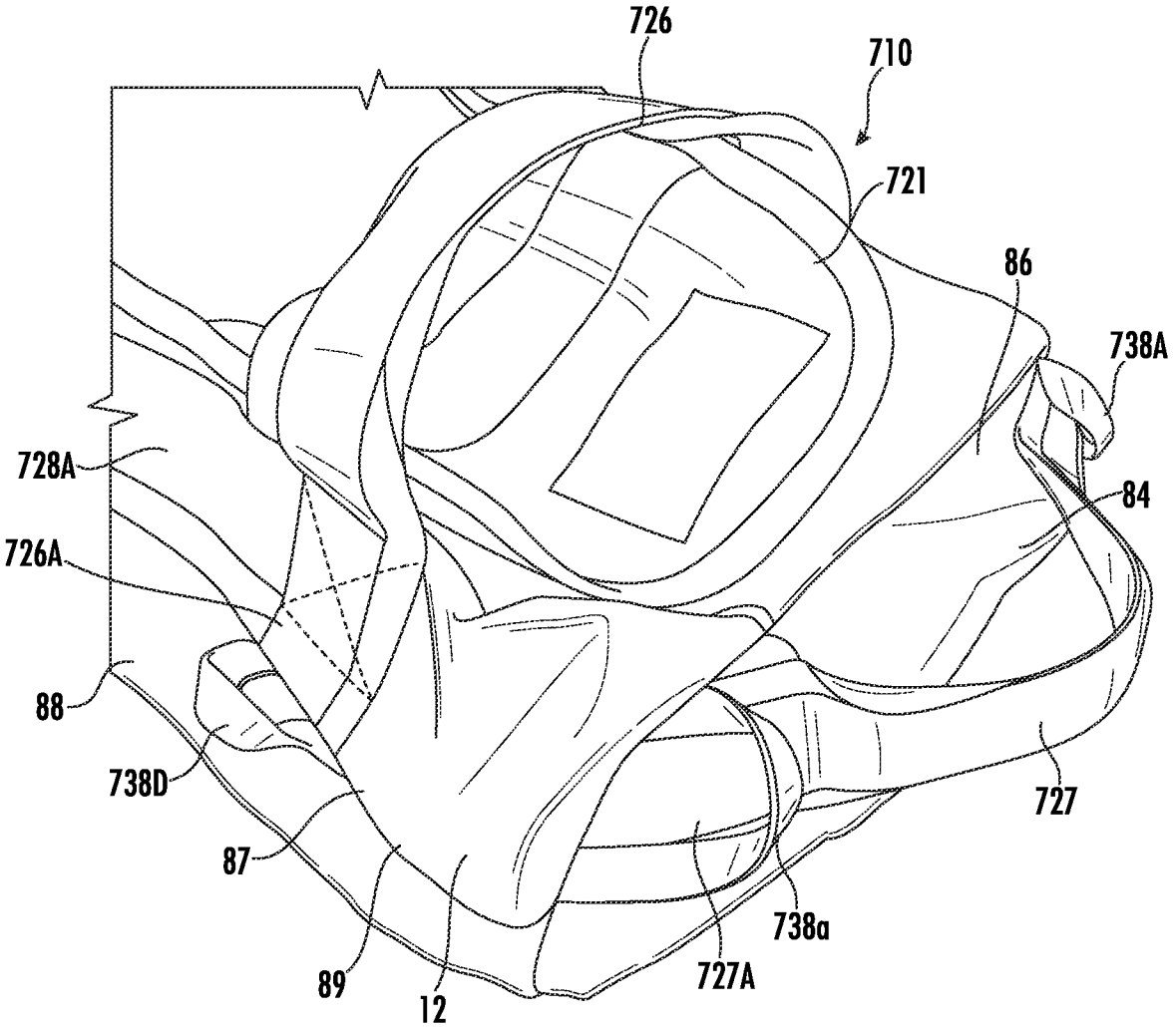
FIG. 31 is a top perspective view photograph of a portion of the shell of FIG. 28.
Figure 32:
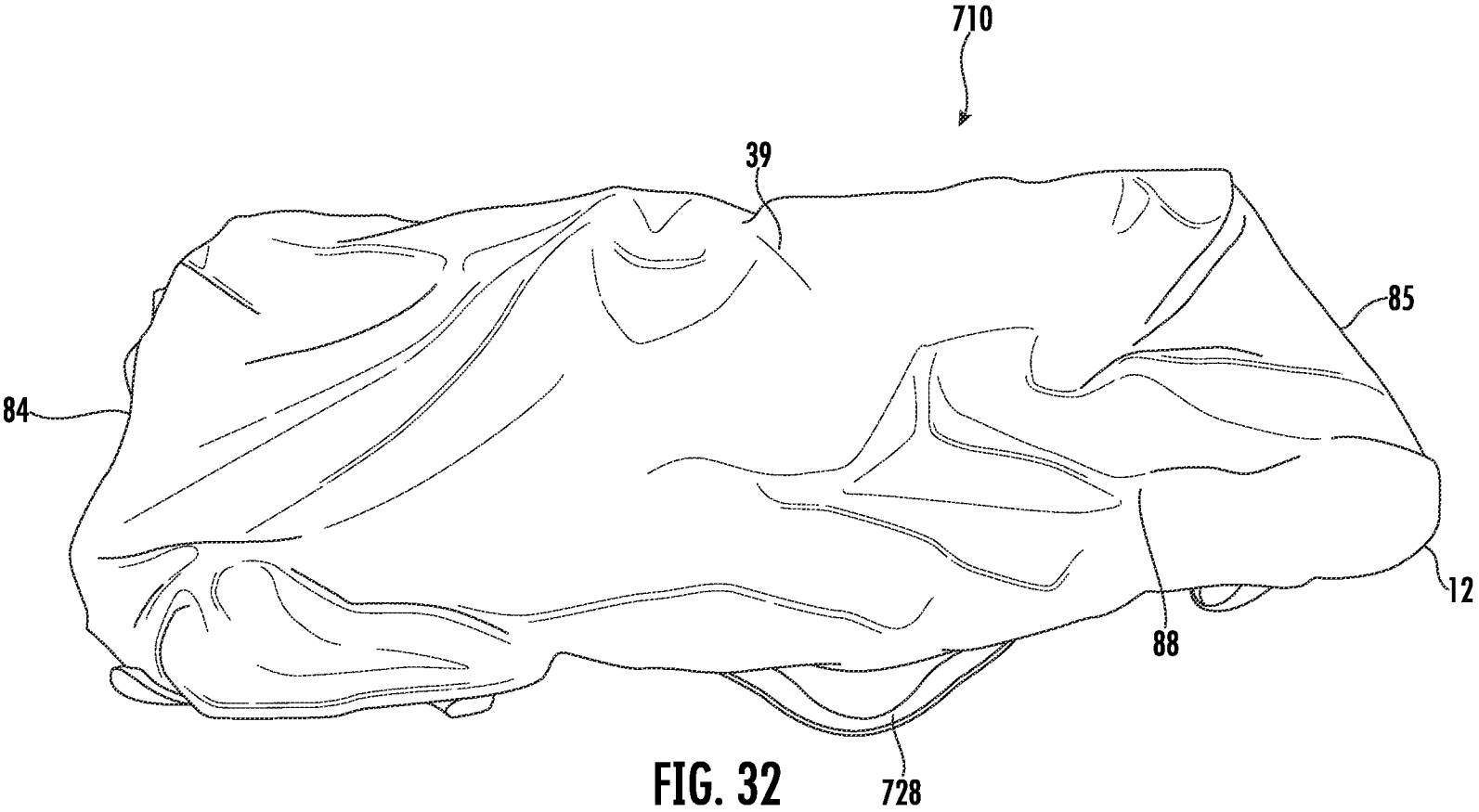
FIG. 32 is a bottom perspective view photograph of the shell of FIG. 28.

The shell assembly 710 in FIGS. 28-48 also includes multiple fixed handles in various positions to permit gripping of the shell assembly 710 in various orientations. For example, the handles include top handles 726 fixedly secured to the top panel 87 of the outer shell 12 along the sides 729 of the shell assembly 710 and positioned to extend laterally across the top 38 of the shell assembly 710, as shown in FIGS. 28-31 and 35-36. The top handles 726 are spaced apart from each other and are located more proximate to the ends 84, 85 of the shell assembly 710 than to the center of the shell assembly 710. It is noted that the top handles 726 both extend across the opening 99. As another example, the handles include end handles 727 fixedly secured to the end panels 86 of the outer shell 12 at the ends 84, 85 of the shell assembly 710 and positioned to extend laterally across the ends 84, 85 of the shell assembly 710, as shown in FIGS. 28-31. As a further example, the handles include side handles 728 fixedly secured to the top panel 87 of the outer shell 12 along the sides 729 of the shell assembly 710 and positioned to extend longitudinally along the sides 729 of the shell assembly 710, as shown in FIGS. 28-29. The side handles 728 include a single handle 728 positioned along each of the two sides 729 of the shell assembly 710, such that the handles 728 are located directly opposite to each other. The mounting structures 728A of the side handles 728 extend between the mounting structures 726A of the top handles 726, and these mounting structures 726A, 728A are connected to each other to further strengthen the connections. All of the handles 726, 727, 728 and their mounting structures 726A, 728A, are fixedly connected to the outer shell 12 by stitching and/or adhesive in the embodiment of FIGS. 28-31. Each of the handles 726, 727, 728 in this embodiment has a portion that is spaced from the outer shell 12 to permit a portion of a user's hand to pass between the handle 726, 727, 728 and the outer shell 12 for gripping the handle 726, 727, 728.

The shell assembly 710 of FIGS. 28-48 has a securing structure for securing the weighted article(s) within the cavity 98 and to limit or resist movement of the weighted article(s) within the cavity 98. This securing structure provides benefits such as maintaining shape and balance of the loaded shell assembly 710 (particularly when the shell assembly 710 is not fully loaded) and relieving strain from the zipper 722 or other closure 720. The securing structure in this embodiment is shown in greater detail in FIGS. 35-40 and includes a plurality of adjustable straps that extend across the cavity 98 and across the opening 99, including a longitudinal strap 730 that extends along the length (i.e., in the longitudinal direction L) of the cavity 98 and three lateral straps 731 that extend laterally across the length of the cavity 98 (i.e., in the lateral or transverse direction T). The lateral straps 731 all cross the longitudinal strap 730 in this embodiment. The shell assembly 710 in FIG. 40 is not shown with the longitudinal strap 730, but it is understood that this shell assembly 710 may be provided with a longitudinal strap 730 as shown in FIGS. 35-39. In another embodiment, the plurality of straps may include at least one adjustable longitudinal strap 730 and at least one adjustable lateral strap 731. In yet another embodiment, the plurality of straps may include at least one adjustable longitudinal strap 730 and a plurality of adjustable lateral straps 731. In a further embodiment, the plurality of straps may include straps having at least two different orientations to each other and/or may be arranged such that at least one of the straps crosses at least one of the other straps.

Figure 35:
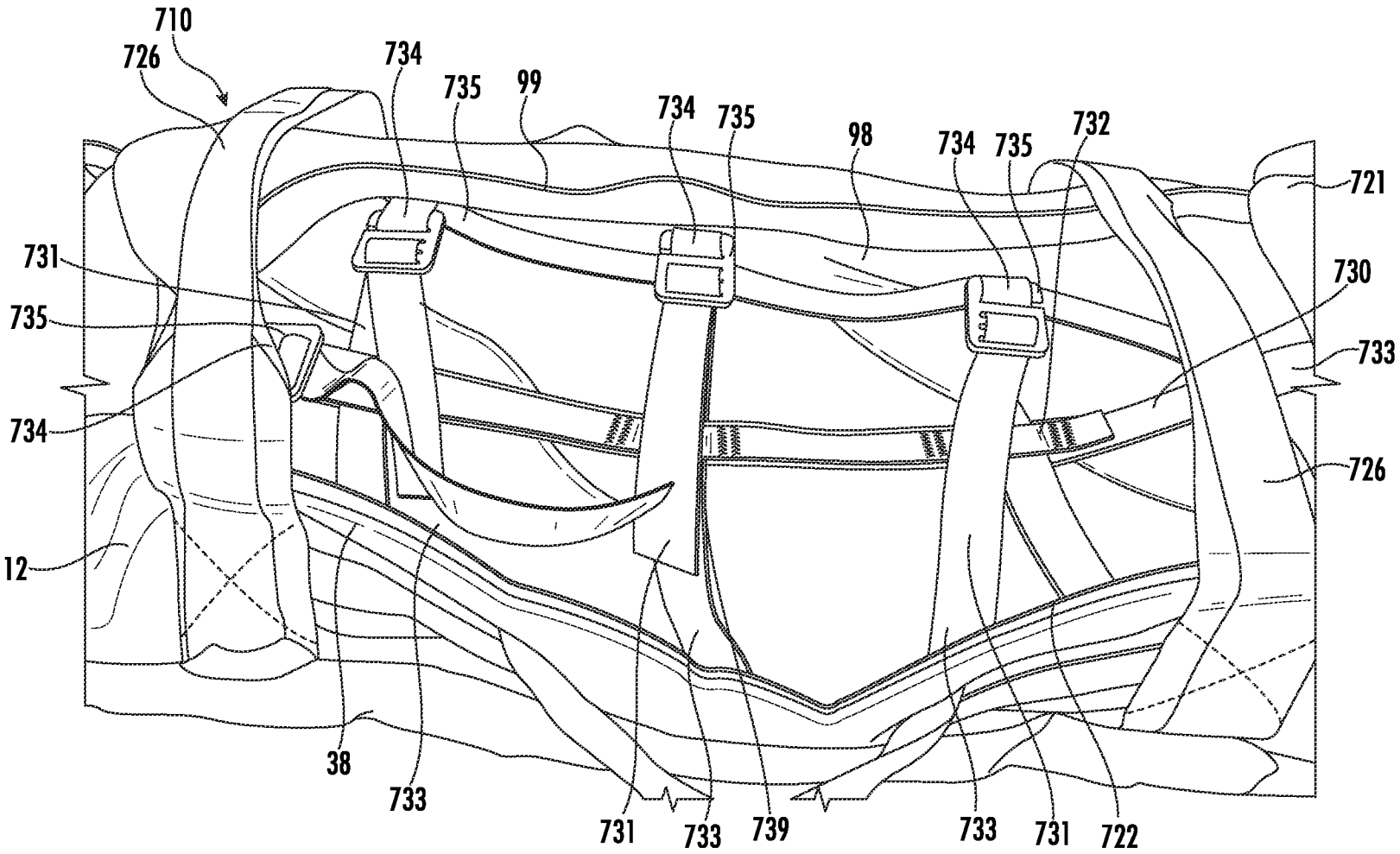
FIG. 35 is a top perspective view photograph of the shell of FIG. 28 with the closure in the open position.
Figure 36:
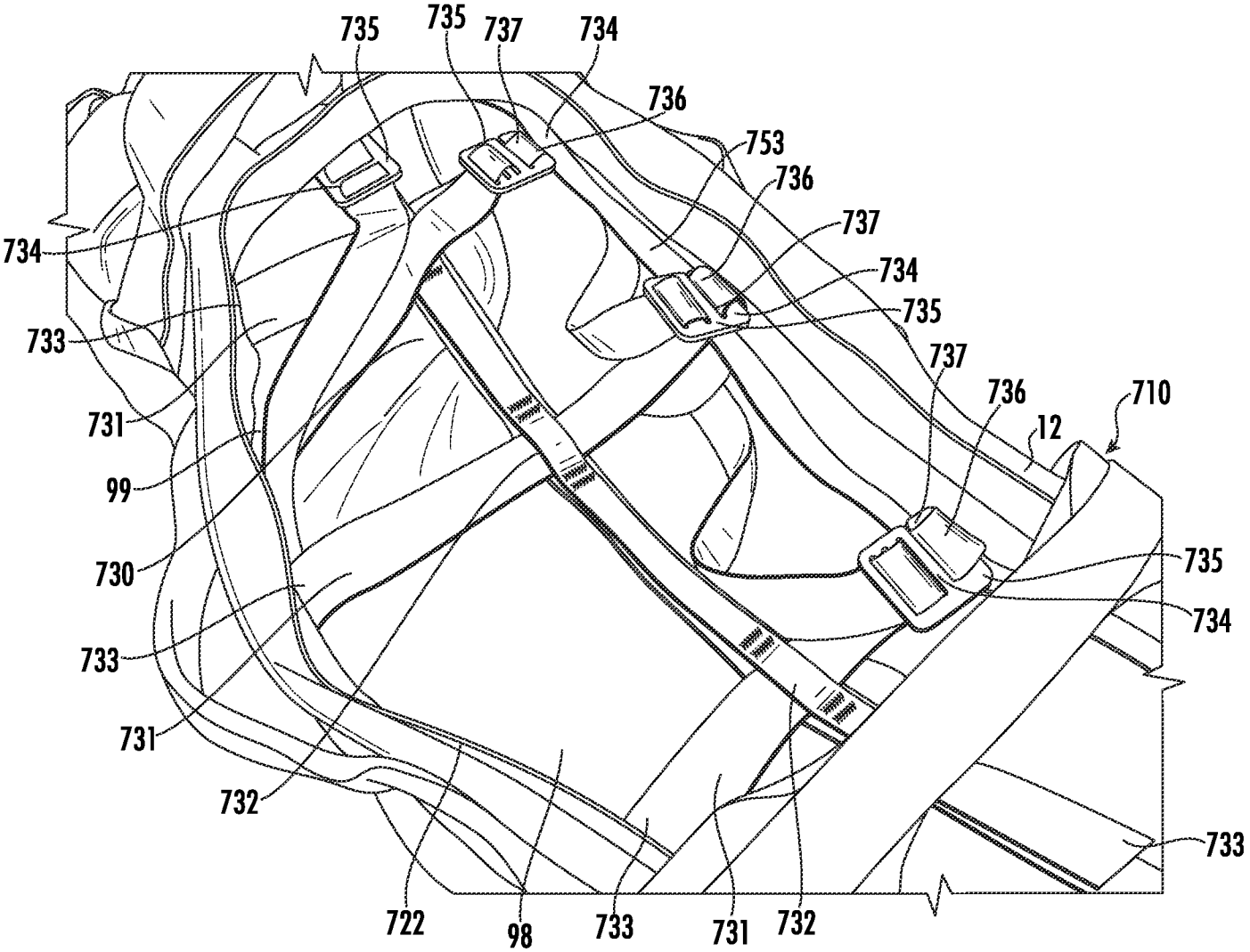
FIG. 36 is a top perspective view photograph of the shell of FIG. 28 with the closure in the open position.
Figure 37:
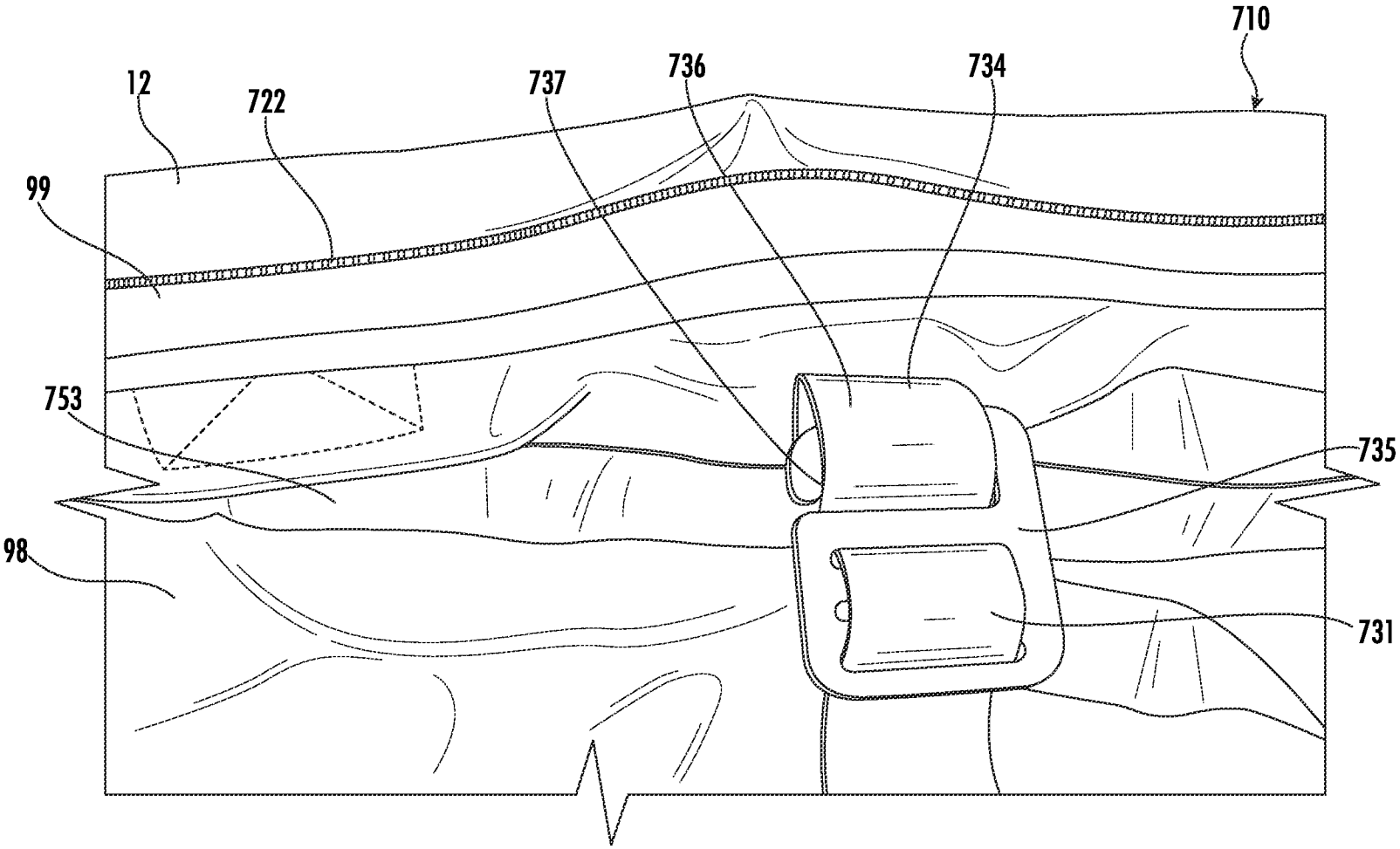
FIG. 37 is a top perspective view photograph of a portion of the shell of FIG. 28 with the closure in the open position.
Figure 38:
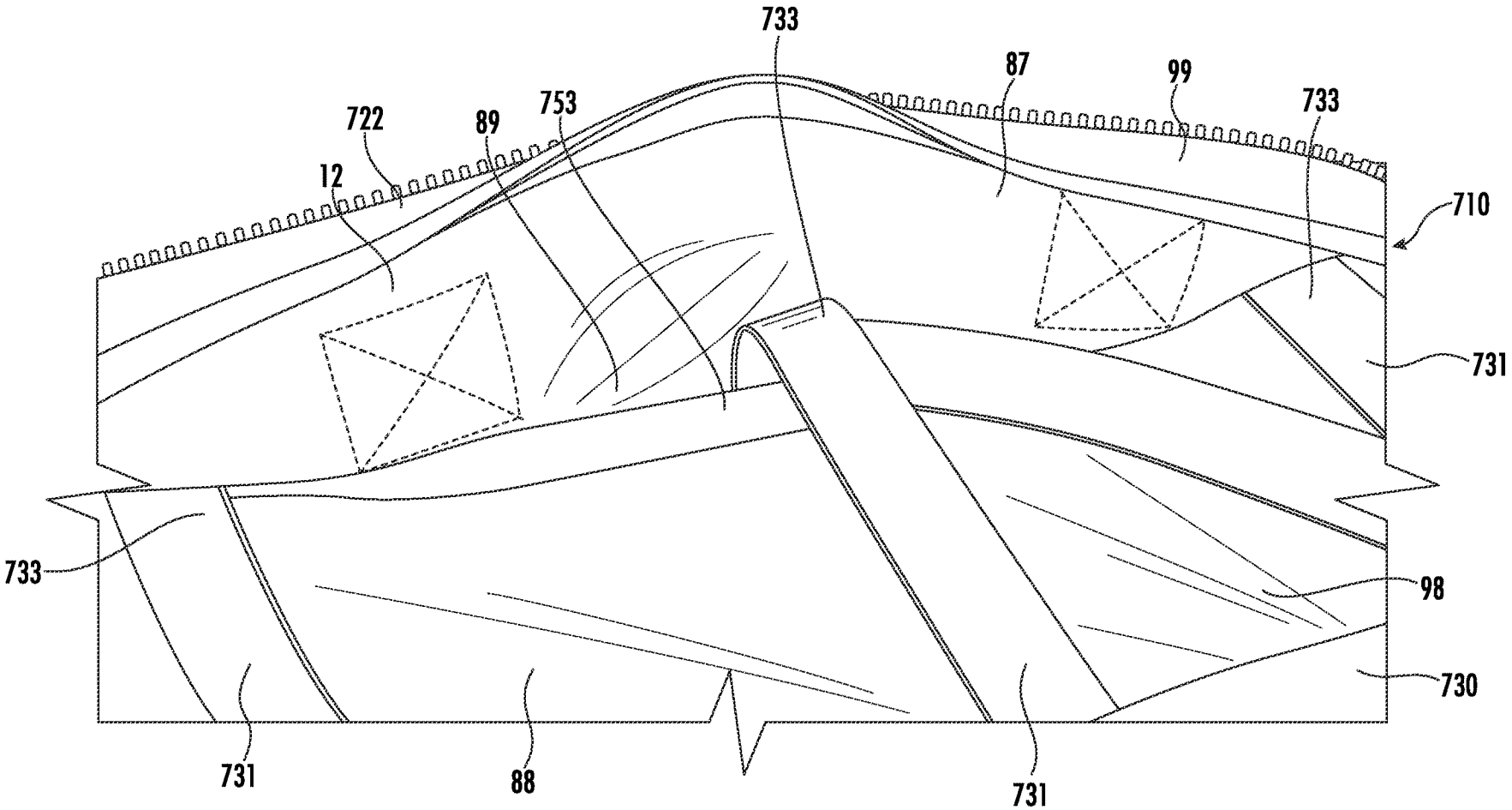
FIG. 38 is a top perspective view photograph of a portion of the shell of FIG. 28 with the closure in the open position.
Figure 39:
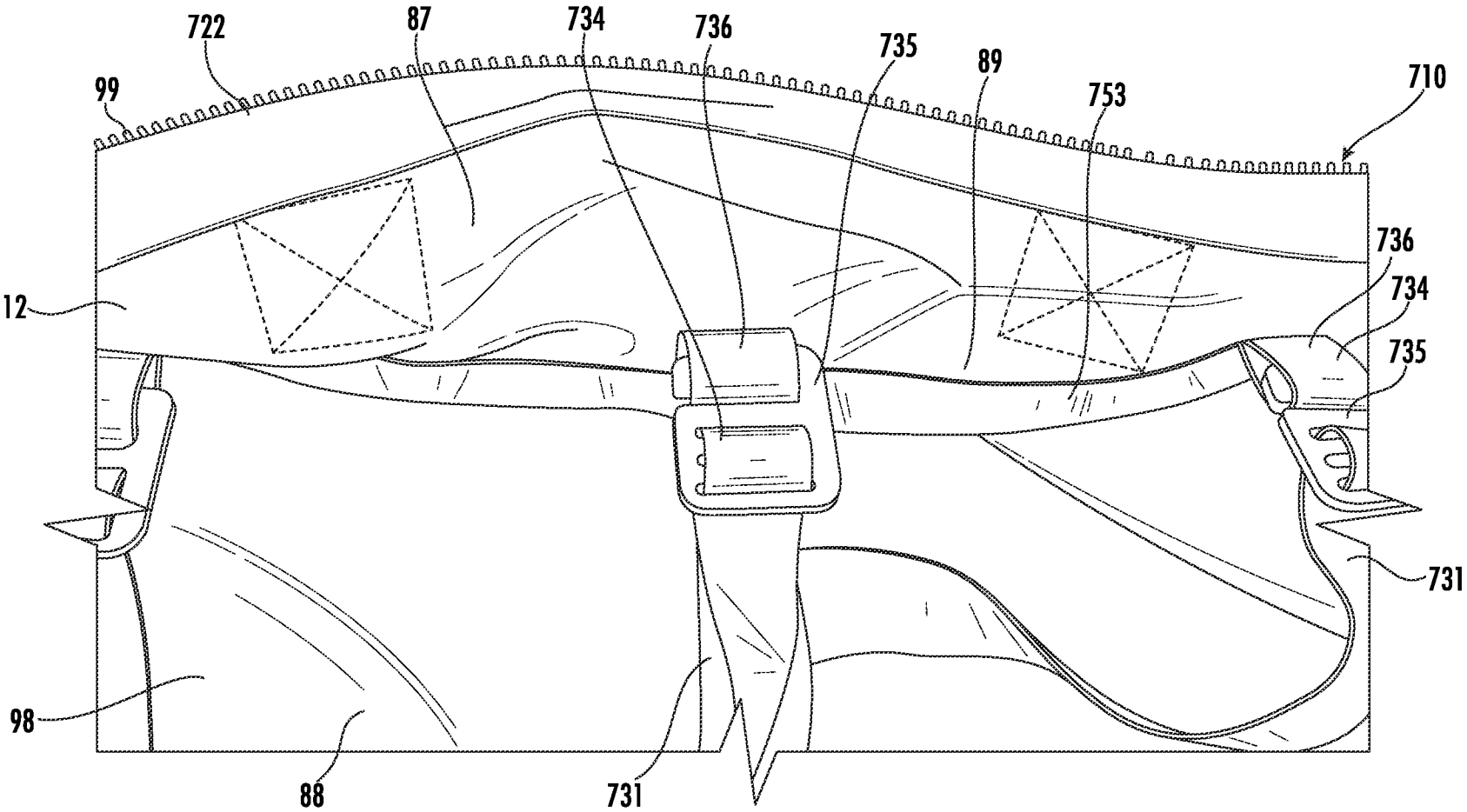
FIG. 39 is a top perspective view photograph of a portion of the shell of FIG. 28 with the closure in the open position.

The straps 730, 731 in this embodiment are made from a non-elastic material with a low degree of stretchability. In this configuration, the straps 730, 731 absorb the majority of stress upon dropping the shell assembly 710 when loaded, which avoids this stress being absorbed by the zipper 722 or other closure 720. In another embodiment, at least some of the straps 730, 731 may be made at least partially of an elastic material that provides some significant degree of stretchability. In one embodiment, the lateral strap(s) 731 may be configured to engage the longitudinal strap(s) 730 when the straps 730, 731 cross each other. For example, the longitudinal strap 730 in FIGS. 35-39 has a plurality of slots 732 formed by strips of material along the length of the strap 730 that engage the lateral straps 731 and receive the lateral straps 731 therethrough. As shown in FIGS. 35-36, the longitudinal strap 730 has three slots 732 spaced from each other along the length thereof (i.e., along the longitudinal direction L), and the three spaced lateral straps 731 each extend through one of the slots 732.

Each of the straps 730, 731 in FIGS. 35-40 is configured to be adjustable in effective length and is connected to the outer shell 12 at a first securing point 733 on one side of the opening 99 and a second securing point 734 on the opposite side of the opening 99, such that the strap extends across the opening. In this configuration, the longitudinal strap 730 has the securing points 733, 734 spaced from each other along the longitudinal length of the outer shell 12 (i.e., longitudinal direction L) and on opposite longitudinal sides of the opening 99, and the lateral straps 730 have the securing points 733, 734 spaced from each other along the lateral width of the outer shell 12 (i.e., transverse or lateral direction T) and on opposite lateral sides of the opening 99. Each of the straps 730, 731 may be fixedly or removably secured to the outer shell 12 at either or both of the securing points 733, 734, in various embodiments. In one embodiment, the straps 730, 731 are each fixedly connected to the outer shell 12 at one of the securing points 733, 734 and removably (and reconnectably) connected to the outer shell 12 at the other securing point 733, 734.

As used herein, adjusting the "effective length" of the strap 730, 731 means adjusting the strap 730, 731 to increase or decrease the length of the portion of the strap 730, 731 between the securing points 733, 734, and thereby increasing or decreasing the spacing between the securing points 733, 734. Adjusting the straps 730, 731 to reduce their effective lengths both engages the straps 730, 731 with the weighted article(s) more tightly and constricts the outer shell 12 around the weighted article(s) to resist movement of the weighted article(s) within the cavity 98. The straps 730, 731 in FIGS. 35-40 are fixedly secured to the inside of the outer shell 12 (e.g., by stitching and/or adhesive) at the first securing points 733. In the embodiment of FIGS. 35-40, the first securing points 733 of the lateral straps 731 are all positioned on the same side of the opening 99, but the lateral straps 731 may have mixed (e.g., alternating) orientations in other embodiments. The straps 730, 731 in FIGS. 35-40 are connected to the second securing points 734 by buckles 735 that are removably connected to the outer shell 12 and that permit adjustment of the effective lengths of the straps 730, 731. The straps 730, 731 are connected to the buckles 735 by threading a free distal end 739 of each strap 730, 731 through the respective buckle 735. The buckles 735 are connected to the inside of the outer shell 12 by fixed connectors 736 in the form of fabric loops that are fixedly connected to the outer shell 12 by stitching and/or adhesive. In one embodiment, the ends of the straps 730, 731 at the first securing points 733 and the fixed connectors 736 at the second securing points 734 may be reinforced by strips of reinforcing material 753 that also internally reinforce the seam 89 between the top panel 87 and the bottom panel 88. The buckles 735 in FIGS. 35-40 each have an open slot 737 that can removably receive a portion of the respective fixed connector 736, to permit the buckles 735 and the straps 730, 731 to be selectively connected to or disconnected from the fixed connectors 736 (see FIGS. 36-37). The straps 730, 731 in FIGS. 35-40 can be pulled through the buckles 735 (e.g., by pulling on the free end 739) to decrease the length of the respective strap 730, 731 to create a desired tightness for securing the weighted article(s), or to increase the length of the respective strap 730, 731 to ease in inserting or removing the weighted article(s) into or from the cavity 98. In other embodiments, the straps 730, 731 may be fixedly connected to the outer shell 12 at the second securing point 734, or may be removably connected to the outer shell 12 at both securing points 733, 734.

FIG. 40 illustrates a shell assembly 710 with weighted articles in the form of four weighted bags 610 received in the cavity 98, with the free distal ends of the three lateral straps 731 being pulled tight to secure the weighted bags 610 in the cavity 98. It is understood that the longitudinal strap 730 may be operated in the same manner. Adjusting the straps 730, 731 to decrease their effective lengths constricts the width and periphery of the outer shell 12, which helps to retain the weighted article(s) in desired position(s). For example, the weighted bags 610 in FIG. 40 are retained in the positions shown, particularly if the shell assembly 710 is turned so that the longitudinal axis of the outer shell 12 is vertically oriented. Adjusting the straps 730, 731 to increase their effective lengths expands the width and periphery of the outer shell 12, such as for removal and/or interchanging of the weighted article(s). In other embodiments, the securing structure may include a different number or arrangement of straps and/or straps that are connected and/or adjusted in a different manner. In further embodiments, a different type of securing structure may be used, such as an internal flap or a netting structure, an adjustable lacing structure (e.g., crisscrossing laces), or an external constricting structure that can constrict the outer shell 12 externally, such as straps or laces. Such securing structures in other embodiments may be incrementally adjustable (such as the straps 730, 731 in FIGS. 35-40), or adjustable between a finite number of adjustment positions (e.g., a flap or strap(s) that is/are fixable to multiple different securing points, such as belt loops), or may not be adjustable (e.g., being positionable in a retaining/restricting position and a released position).

The shell assembly 710 in FIGS. 28-48 also includes a plurality of connections 738 for removable connection of handles and/or other components. The connections 738 in FIGS. 28-48 include a pair of first connections 738A at one end 84 of the outer shell 12 and a pair of second connections 738B at the opposite end 85 of the outer shell 12. The first connections 738A and the second connections 738B of each pair are spaced laterally from each other and located on opposite sides of the end handle 727 on that respective end 84, 85 of the outer shell 12. The first and second connections 738A, 738B are fixedly connected to the end panel 86 at the respective end 84, 85. The removable handle connections 738 in FIGS. 28-48 also include a pair of third connections 738C along one side 729 of the outer shell 12 and a pair of fourth connections 738D along the opposite side 729 of the outer shell 12. The third connections 738C and the fourth connections 738D of each pair are spaced longitudinally from each other on the respective side 729 of the outer shell 12 and are fixed to the outer shell 12 proximate the juncture between the top panel 87 and the bottom panel 88. Each of the connections 738 in FIGS. 28-48 is formed as a fabric loop that is fixedly connected to the outer shell 12 by connection techniques such as stitching, adhesive, heat sealing, etc.

The connections 738 allow for connection of multiple different types of handles configured to be gripped or otherwise engaged by the user for carrying the shell assembly 710. It is understood that the term "handle" as described herein is not limited to structures that are gripped or engaged by the user's hand(s), and may include any structure upon which the user exerts force to lift, carry, or otherwise move the shell assembly 710, such as a carrying strap, harness, etc. The shell assembly 710 may be provided as a kit that includes the shell assembly 710 and one or more handles and/or other components that are connectable to the connections 738 by a removable connecting structure. In the embodiment of FIGS. 28-48, the connections 738 are fixed connections, and the removable connecting structure is configured for connection to the fixed connections. In another embodiment, the connections 738 may have integral structure for removable connection, such as clips or buckles fixedly connected to the outer shell 12. FIGS. 41-48 illustrate embodiments of removable components in the form of handles that can be removably connected to the connections 738 by releasable clips 740 that are fixedly connected to the handles at swivel connections 741.

FIGS. 41-43 illustrate one embodiment of a handle for removable connection to the connections 738 in the form of backpack straps 742. The backpack straps 742 in this embodiment have clips 740 connected with swivel connections 741 at both opposed ends thereof, and each backpack strap 742 is formed as a first strap member 744 and a second strap member 745 connected to each other at a buckle 746 to permit adjustment of the length of the backpack strap 742. The free end of the second strap member 745 can be pulled through the buckle 746 to change the effective length of the second strap member 745 and thereby change the overall effective length of the backpack strap 742. Each backpack strap also includes a cushioning member 743 connected to the first strap member 744 by stitching. FIGS. 42-43 illustrate the backpack straps 742 connected to the shell assembly 710, by connecting the clips 740 on the first strap members 744 to the first connections 738A or the second connections 738B at one of the ends 84, 85, and connecting the clips 740 on the second strap members 745 to the third connection 738C and the fourth connection 738D on the same lateral side and furthest from the end 84, 85 to which the first strap members 744 are connected. In this position, the shell assembly 710 may be worn as a backpack by inserting the user's arms and shoulders between the backpack straps 742 and the outer shell 12. The backpack straps 742 are positioned to extend across the bottom 39 of the outer shell 12 such that the bottom 39 rests on the user's back when the shell assembly 710 is worn as a backpack.

Figure 44:
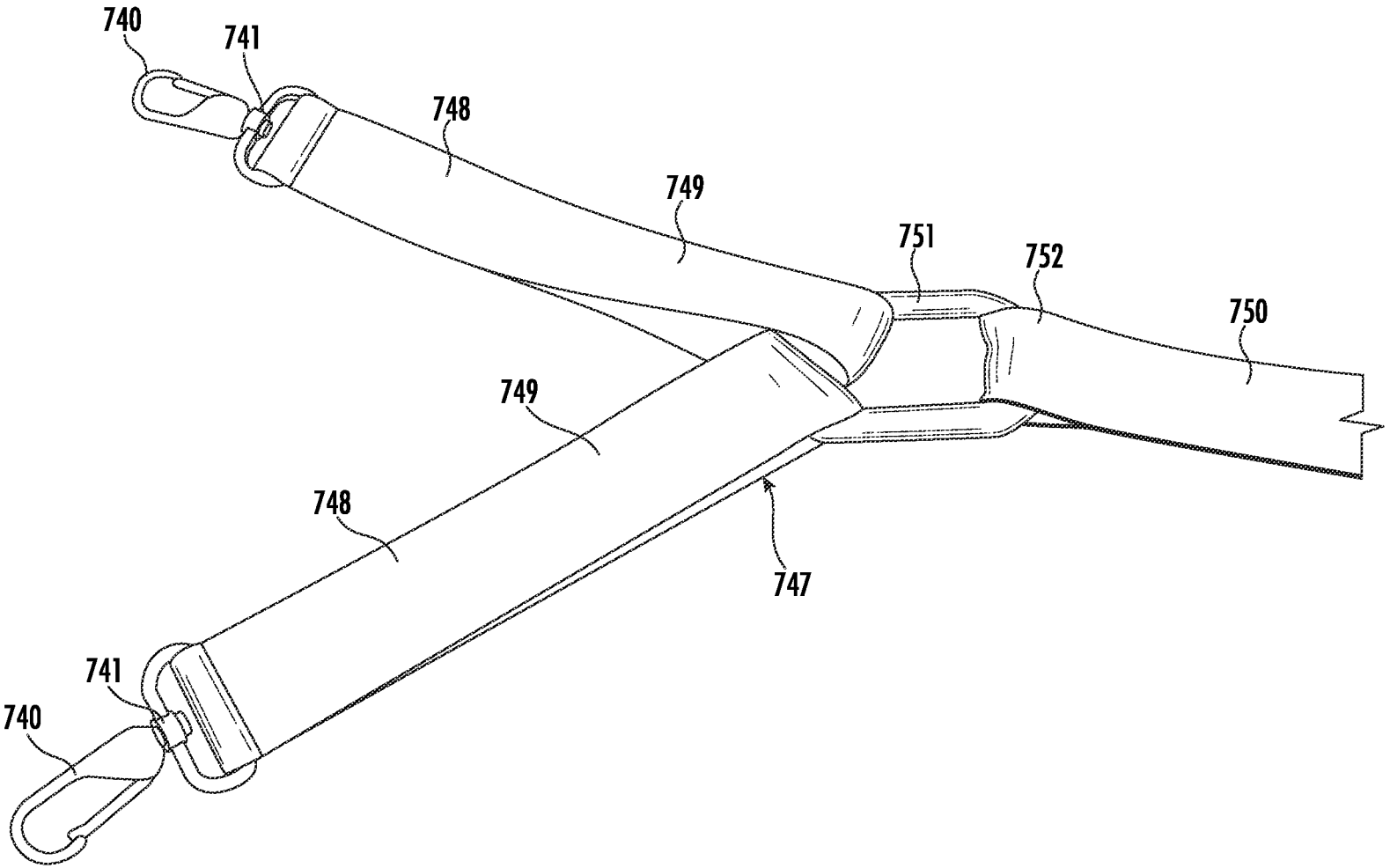
FIG. 44 is a top view photograph of a portion of a pull strap configured for use with the shell of FIG. 28 according to aspects disclosed herein.
Figure 45:
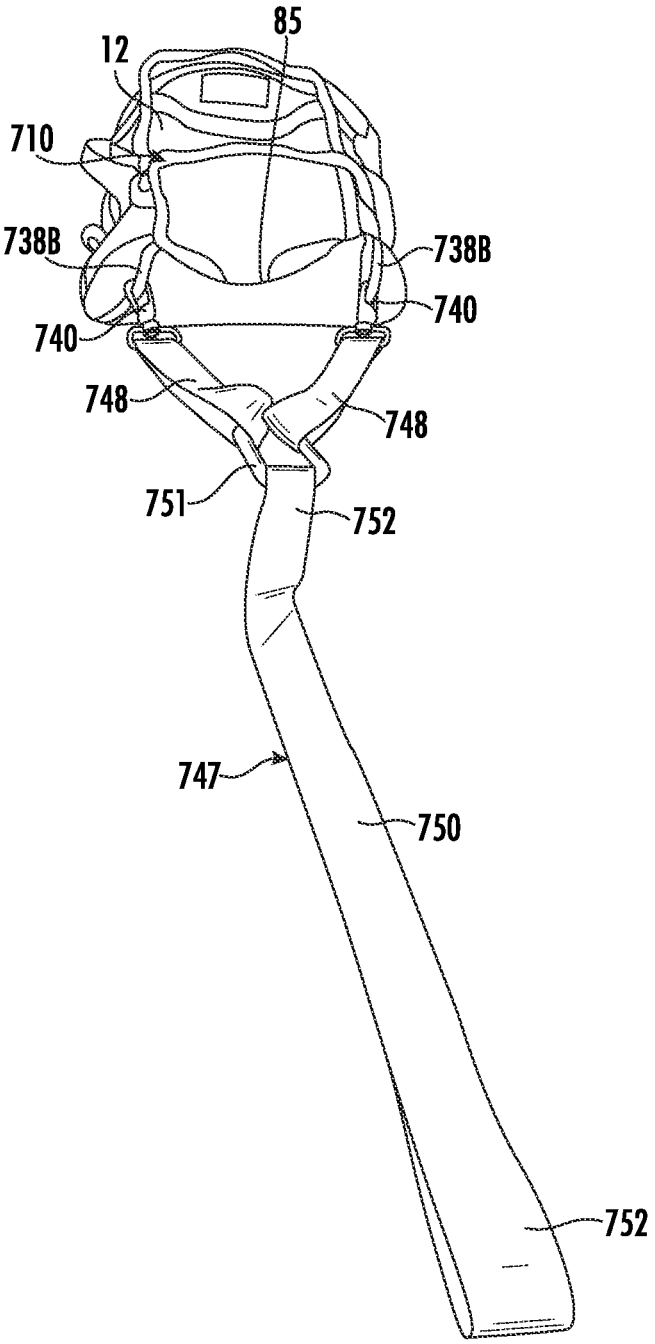
FIG. 45 is a top perspective view photograph of the shell of FIG. 28 with the pull strap of FIG. 44 connected thereto.
Figure 46:
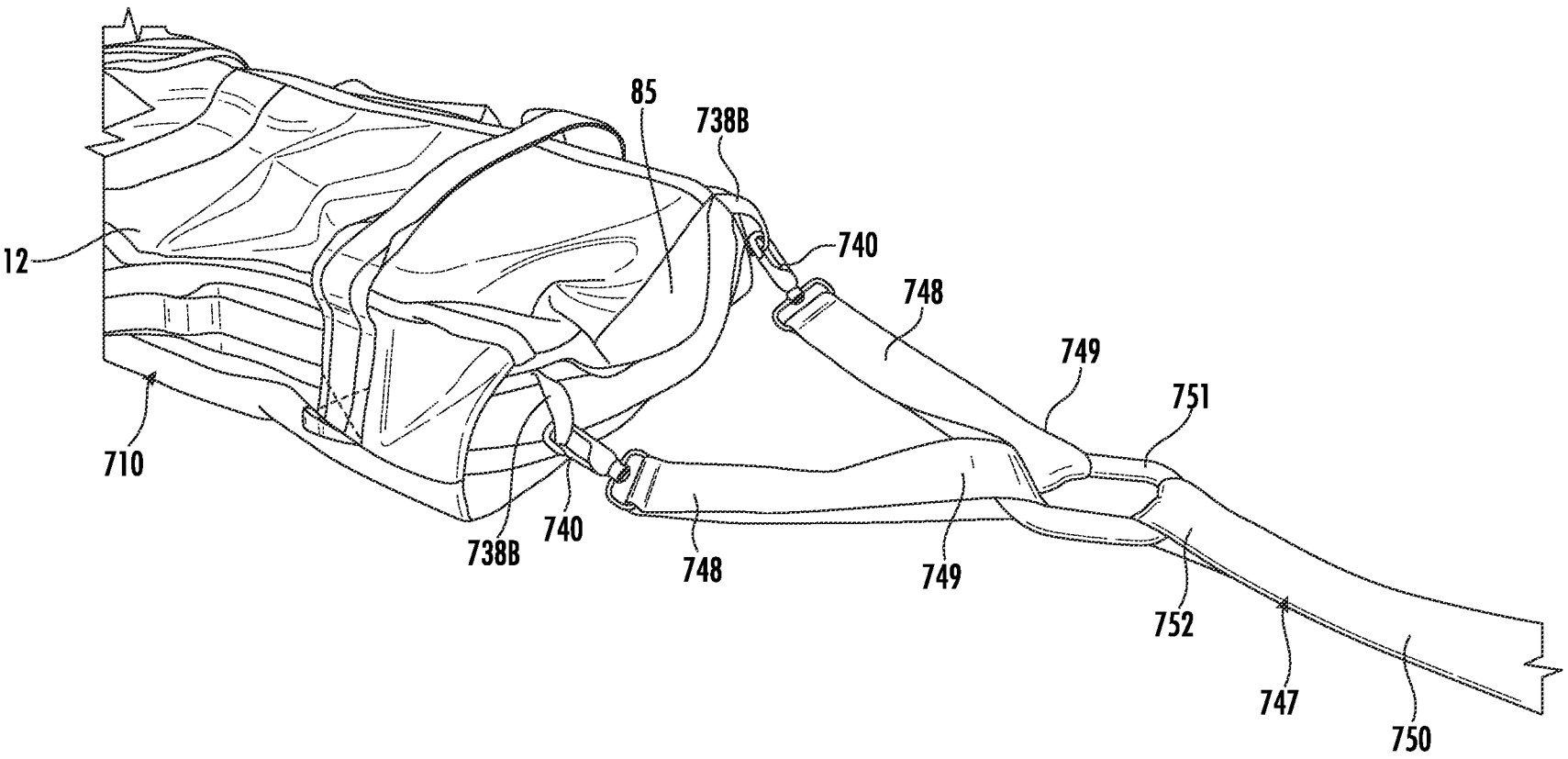
FIG. 46 is a top perspective view photograph of the shell of FIG. 28 with the pull strap of FIG. 44 connected thereto.

FIGS. 44-47 illustrate another embodiment of a handle for removable connection to the connections 738 in the form of a drag strap assembly 747 configured for use to drag the shell assembly 710 across the ground. The drag strap assembly 747 includes two connecting straps for connection to the outer shell 12, which (in the embodiment of FIGS. 44-47) are in the form of loop straps 748 each having a loop member 749 with a clip 740 connected with a swivel connection 741 at one end of the loop member 749. The drag strap assembly 747 also includes a drag strap 750 removably connected to the ends of the loop straps 748 (or other connecting straps) by a connection member 751 in the form of a karabiner clip. The connection member 751 may have a different form in other embodiments. The loop straps 748 in this embodiment are connected to the shell assembly 710 by connecting the clips 740 on the loop straps 748 to the first connections 738A or the second connections 738B at one of the ends 84, 85 of the outer shell 12. The connection member 751 is then connected to both of the loop members 749 by inserting a portion of the clip through both loop members 749. The drag strap 750 has additional loop members 752 at both ends in this embodiment, and one of the loop members 752 of the drag strap 750 is also connected to the connection member 751 by inserting a portion of the clip through the loop member 752. In this configuration, the drag strap assembly 747 is formed in a Y-shape, as shown in FIGS. 44-46. The user can grip the loop member 752 of the drag strap 750 that is distal from the connection member 751 in order to pull the shell assembly 710 horizontally over the ground surface. In FIGS. 44-46, the drag strap 750 has one loop member 752 (shown distally from the outer shell 12 in FIG. 45) that is larger than the other loop member 752 (connected to the clip 751), such that the larger loop member 752 is designed for gripping and the smaller loop member 752 is designed for connection to the clip 751. However, in other embodiments, the loop members 752 may be the same sizes, or different structures may be used for connection to the loop straps 748 and/or for gripping. In another embodiment, the drag strap assembly 747 may be formed as a single strap and/or may be connected to only a single connection 738 of the shell assembly 710.

Figure 47:
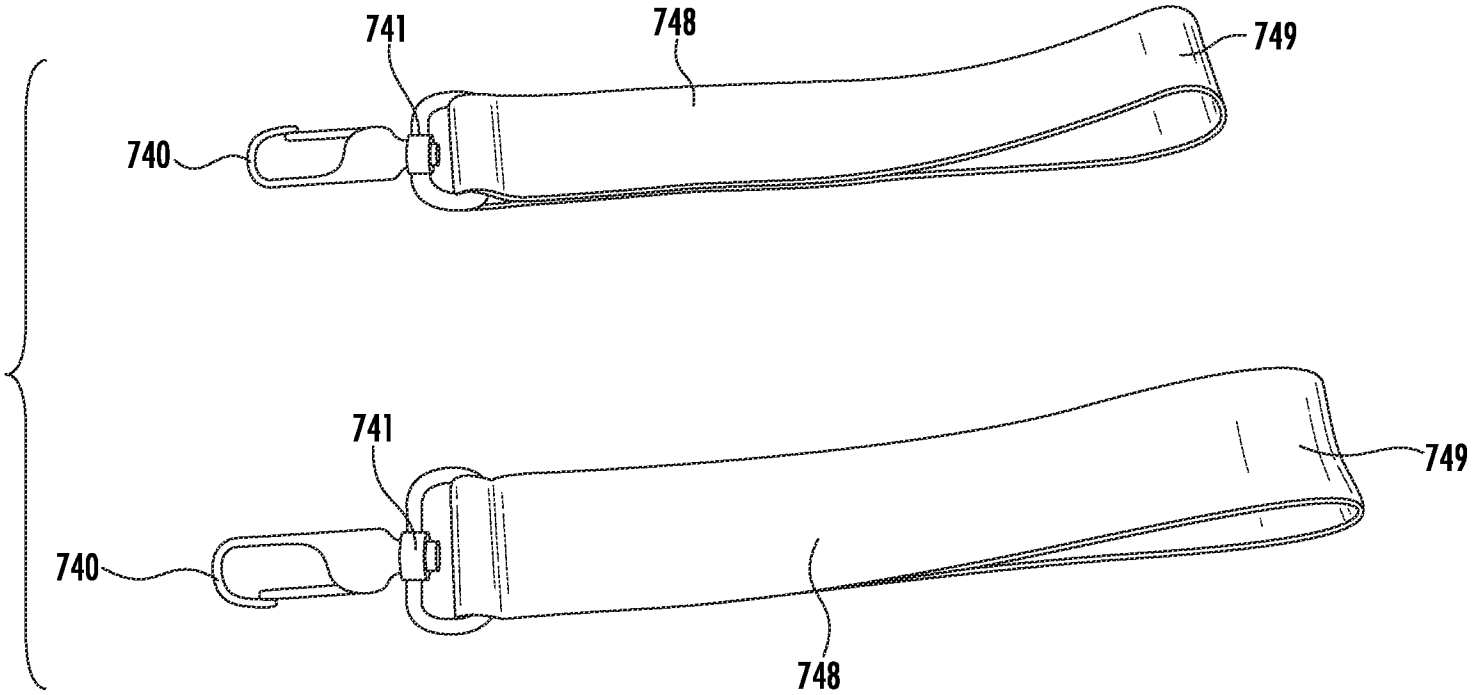
FIG. 47 is a top view photograph of a pair of grip straps configured for use with the shell of FIG. 28 according to aspects disclosed herein.
Figure 48:
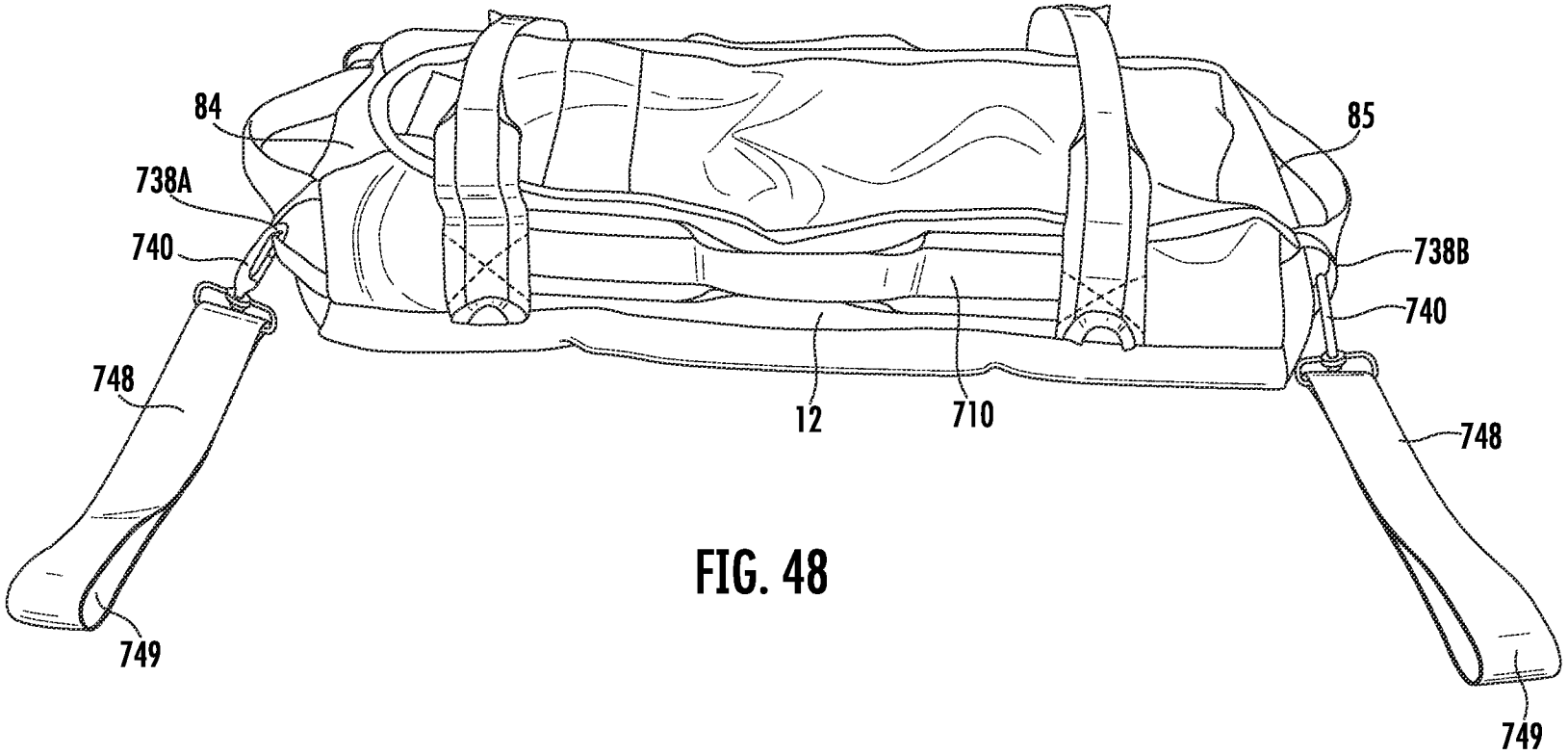
FIG. 48 is a top perspective view photograph of the shell of FIG. 28 with the grip straps of FIG. 47 connected thereto.

FIGS. 47-49 illustrate another embodiment of a handle for removable connection to the connections 738 that includes a pair of grip straps configured for gripping by the user for carrying the shell assembly 710. The grip straps in FIGS. 47-49 are embodied by the same loop straps 748 that are used in the drag strap assembly 747, allowing these straps 748 to be connectable to the shell assembly 710 in two different configurations. This reduces the number of components of the kit and thereby reduces weight and cost, and saves space. In FIGS. 48-49, the loop straps 748 are connected to one of the first connections 738A and to one of the second connections 738B at opposite ends 84, 85 of the outer shell 12, but on the same lateral side of the outer shell 12. In this configuration, the shell assembly 710 is configured to be used in the same manner as the weighted bag 310 in FIGS. 12-18, designed to be picked up by a user and thrown over his/her back for carrying so that the shell assembly 710 rests on the user's neck and shoulders, and the user's head and neck are positioned between the loop straps 748.

The ability of the shell assembly 710 to hold a wide variety of different weighted articles, along with the large number of handle configurations provided by the fixed handles 726, 727, 728 and the removable handles 742, 748, 749, provides a great degree of versatility. This great versatility is provided not only for the shell assembly 710 itself, but also for the weighted article(s) contained within the cavity 98, which are provided with versatility for use in many different exercises that they were not specially designed for. The shell assembly 710 may have additional or alternate handle or attachment configurations in other embodiments. For example, in one embodiment, the shell assembly 710 may be provided with a handle and a compartment that are configured similarly to the handle 90 and compartment 91 shown and described herein with respect to FIGS. 19-25, including any variations thereof.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "side," "rear," "proximal," "distal," and the like, as used herein, are intended for illustrative and relative purposes only and do not limit the embodiments in any way. Nothing in this specification should be construed as requiring a specific three dimensional orientation of structures in order to fall within the scope of this invention, unless explicitly specified by the claims. Additionally, the term "plurality," as used herein, indicates any number greater than one, either disjunctively or conjunctively, as necessary, up to an infinite number. For quantitative values described herein that do not include decimal points, each digit to the left of the decimal point is considered to be a significant digit. Accordingly, while the specific embodiments have been illustrated and described, numerous modifications come to mind without significantly departing from the spirit of the invention and the scope of protection is only limited by the scope of the accompanying claims.

What is claimed is:

1. A shell assembly configured for holding one or more weighted articles, the shell assembly comprising:

an outer shell having an inner surface defining a cavity configured for receiving the one or more weighted articles therein, and an outer surface opposite the inner surface, the outer shell further having an opening providing access to the cavity; and a plurality of adjustable straps configured for securing the one or more weighted articles within the cavity to limit movement of the one or more weighted articles, the plurality of adjustable straps comprising:

a first strap connected to the inner surface of the outer shell at two securing points on opposite sides of the opening and extending across the opening in a first direction;

a second strap connected to the inner surface of the outer shell at two securing points on opposite sides of the opening and extending across the opening in the first direction, the second strap being spaced from the first strap; and a third strap connected to the inner surface of the outer shell at two securing points on opposite sides of the opening and extending across the opening in a second direction perpendicular to the first direction, such that the first and second straps cross the third strap, wherein each of the plurality of adjustable straps is adjustable with respect to the outer shell to increase or decrease an effective length of the respective adjustable strap between the respective securing points, to increase or decrease a distance between the respective securing points and thereby constrict or expand the outer shell around the one or more weighted articles.

2. The shell assembly of claim 1, wherein the outer shell has a bottom configured to contact a ground surface during use, a top opposite the bottom, two opposed ends, and two opposed sides extending between the two ends, and wherein the outer shell comprises a plurality of panels joined together, the plurality of panels including a bottom panel forming a bottom of the outer shell, and extending upward from the bottom along the two ends and along the two sides.

3. The shell assembly of claim 2, wherein the plurality of panels further includes a top panel connected to the bottom panel and at least partially forming a top of the outer shell and the two sides of the outer shell, and two end panels connected to the top panel and the bottom panel at the two opposed ends of the outer shell, wherein the two end panels each form a portion of the respective end of the outer shell.

4. The shell assembly of claim 2, wherein each of the plurality of panels is formed of at least one fabric layer, and wherein the bottom panel comprises a greater number of fabric layers than the other panels.

5. The shell assembly of claim 1, wherein each of the plurality of adjustable straps has a buckle connected to the inner surface of the outer shell at one of the securing points, wherein each of the plurality of adjustable straps is adjustably threaded through the respective buckle to enable adjustment of each of the plurality of adjustable strap with respect to the outer shell.

6. The shell assembly of claim 5, wherein each of the buckles is removably connected to the outer shell.

7. The shell assembly of claim 1, wherein the outer shell is elongated along the second direction, such that the third strap is a longitudinally extending strap, and the first and second straps are laterally extending straps.

8. The shell assembly of claim 7, wherein the plurality of adjustable straps further comprises a fourth strap connected to the inner surface of the outer shell at two securing points on opposite sides of the opening and extending across the opening in the first direction, the fourth strap being spaced from the first strap and the second strap, such that the fourth strap is a laterally extending strap and crosses the third strap.

9. The shell assembly of claim 1, wherein the third strap has a first slot and a second slot spaced along a length of the third strap, wherein the first strap and the second strap extend through the first and second slots.

10. The shell assembly of claim 1, wherein the outer shell has a bottom configured to contact a ground surface during use, and wherein the bottom of the outer shell is seamless.

11. A shell assembly configured for holding one or more weighted articles, the shell assembly comprising:

an outer shell having an inner surface defining a cavity configured for receiving the one or more weighted articles therein, and an outer surface opposite the inner surface, the outer shell further having an opening providing access to the cavity;

a closure configured for selectively opening and closing the opening;

a securing structure configured for securing the one or more weighted articles within the cavity to limit movement of the one or more weighted articles, the securing structure comprising a plurality of adjustable straps each connected to the inner surface of the outer shell at a first securing point and a second securing point on opposite sides of the opening, wherein each of the plurality of adjustable straps is adjustable with respect to the outer shell to increase or decrease an effective length of the respective adjustable strap between the respective first and second securing points, to increase or decrease a distance between the respective first and second securing points and thereby constrict or expand the outer shell around the one or more weighted articles.

12. The shell assembly of claim 11, wherein the outer shell has a bottom configured to contact a ground surface during use, a top opposite the bottom, two opposed ends, and two opposed sides extending between the two ends, and wherein the outer shell comprises a plurality of panels joined together, the plurality of panels including a bottom panel forming a bottom of the outer shell, and extending upward from the bottom along the two ends and along the two sides.

13. The shell assembly of claim 12, wherein the plurality of panels further includes a top panel connected to the bottom panel and at least partially forming a top of the outer shell and the two sides of the outer shell, and two end panels connected to the top panel and the bottom panel at the two opposed ends of the outer shell, wherein the two end panels each form a portion of the respective end of the outer shell.

14. The shell assembly of claim 12, wherein each of the plurality of panels is formed of at least one fabric layer, and wherein the bottom panel comprises a greater number of fabric layers than the other panels.

15. The shell assembly of claim 11, wherein the plurality of adjustable straps comprises:

a first strap extending across the opening in a first direction;

a second strap spaced from the first strap and extending across the opening in the first direction; and a third strap extending across the opening in a second direction perpendicular to the first direction, such that the first and second straps cross the third strap.

16. The shell assembly of claim 15, wherein the third strap has a first slot and a second slot spaced along a length of the third strap, wherein the first strap and the second strap extend through the first and second slots.

17. The shell assembly of claim 11, wherein each of the plurality of adjustable straps has a buckle connected to the inner surface of the outer shell at the second securing point, wherein each of the adjustable straps is adjustably threaded through the respective buckle to enable adjustment of the adjustable strap with respect to the outer shell.

18. The shell assembly of claim 17, wherein each of the buckles is removably connected to the outer shell.

19. The shell assembly of claim 11, wherein the outer shell has a bottom configured to contact a ground surface during use, and wherein the bottom of the outer shell is seamless.

20. The shell assembly of claim 11, wherein the closure comprises a moveable flap having a first portion fixedly connected to the outer shell and a second portion releasably connected to the outer shell for selectively opening and closing the opening.

21. A shell assembly configured for holding one or more weighted articles, the shell assembly comprising:

an outer shell having an inner surface defining a cavity configured for receiving the one or more weighted articles therein, and an outer surface opposite the inner surface, wherein the outer shell is elongated along a longitudinal direction, the outer shell further having an opening providing access to the cavity; and a plurality of adjustable straps configured for securing the one or more weighted articles within the cavity to limit movement of the one or more weighted articles, the plurality of adjustable straps comprising:

a longitudinal strap connected to the inner surface of the outer shell at a first securing point and a second securing point on opposite longitudinal sides of the opening and extending across the opening in the longitudinal direction; and a plurality of lateral straps each connected to the inner surface of the outer shell at a first securing point and a second securing point on opposite lateral sides of the opening and extending across the opening in a lateral direction perpendicular to the longitudinal direction, such that each of the plurality of lateral straps crosses the longitudinal strap, wherein the plurality of lateral straps are spaced from each other along the longitudinal direction, wherein each of the plurality of adjustable straps is adjustable with respect to the outer shell to increase or decrease an effective length of the respective adjustable strap between the respective first and second securing points, to increase or decrease a distance between the respective first and second securing points and thereby constrict or expand the outer shell around the one or more weighted articles.

22. The shell assembly of claim 21, wherein each of the plurality of adjustable straps has a buckle connected to the inner surface of the outer shell at one of the first and second securing points, wherein each of the adjustable straps is adjustably threaded through the respective buckle to enable adjustment of the adjustable strap with respect to the outer shell.

23. The shell assembly of claim 22, wherein each of the buckles is removably connected to the outer shell.

24. The shell assembly of claim 21, wherein the plurality of lateral straps are evenly spaced from each other along the longitudinal direction.

25. The shell assembly of claim 21, wherein the plurality of lateral straps comprise a first lateral strap, a second lateral strap, and a third lateral strap.

26. The shell assembly of claim 21, wherein the longitudinal strap has a plurality of slots spaced along a length of the longitudinal strap, wherein each of the plurality of lateral straps extends through one of the slots of the longitudinal strap.

27. The shell assembly of claim 21, wherein the outer shell has a bottom configured to contact a ground surface during use, and wherein the bottom of the outer shell is seamless.

28. The shell assembly of claim 21, wherein the outer shell has a bottom configured to contact a ground surface during use, a top opposite the bottom, two opposed ends spaced from each other along the longitudinal direction, and two opposed sides spaced from each other along the lateral direction and extending between the two ends, and wherein the outer shell comprises a plurality of panels joined together, the plurality of panels including a bottom panel forming a bottom of the outer shell, and extending upward from the bottom along the two ends and along the two sides.

* * * * *